US007278718B2

(12) United States Patent
Aruga et al.

(10) Patent No.: US 7,278,718 B2
(45) Date of Patent: Oct. 9, 2007

(54) LIQUID INJECTING APPARATUS

(75) Inventors: Yoshiharu Aruga, Nagano-ken (JP); Toshio Kumagai, Nagano-ken (JP); Hitoshi Matsumoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 825 days.

(21) Appl. No.: 10/347,523

(22) Filed: Jan. 21, 2003

(65) Prior Publication Data

US 2003/0146958 A1 Aug. 7, 2003

(30) Foreign Application Priority Data

| | | |
|---|---|---|
| Jan. 22, 2002 | (JP) | P2002-012779 |
| Mar. 25, 2002 | (JP) | P2002-082376 |
| Apr. 9, 2002 | (JP) | 2002-106036 |
| Aug. 28, 2002 | (JP) | 2002-249422 |
| Aug. 28, 2002 | (JP) | 2002-249423 |
| Dec. 12, 2002 | (JP) | 2002-361051 |

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS

| | | | | |
|---|---|---|---|---|
| 6,585,358 | B2 * | 7/2003 | Usui et al. | 347/85 |
| 2002/0196312 | A1 * | 12/2002 | Ishizawa et al. | 347/50 |

FOREIGN PATENT DOCUMENTS

| | | | |
|---|---|---|---|
| GB | 2331488 | | 5/1999 |
| JP | 4-251752 | A | 9/1992 |
| JP | 9-303582 | A | 11/1997 |
| JP | 10-138506 | A | 5/1998 |
| JP | 11-048498 | | 2/1999 |
| JP | 11-157093 | | 6/1999 |
| JP | 11-348310 | A | 12/1999 |
| JP | 2001-38925 | A | 2/2001 |
| JP | 2001-063103 | | 3/2001 |
| JP | 2001-071536 | | 3/2001 |
| JP | 2001-113726 | A | 4/2001 |
| JP | 2001-162825 | | 6/2001 |
| JP | 2001-199080 | | 7/2001 |
| WO | WO 00/03877 | | 7/1999 |

* cited by examiner

*Primary Examiner*—An H. Do
(74) *Attorney, Agent, or Firm*—Sughrue Mion Pllc.

(57) ABSTRACT

A liquid injection apparatus having a liquid reservoir for containing liquid, a recording head for injecting the liquid, and a liquid supply passage for supplying the liquid in the liquid reservoir to the recording head is disclosed. A valve unit is located on the liquid supply passage. The valve unit has pressure chamber for temporarily retaining the liquid. As the recording head injects the liquid, the liquid in the pressure chamber decreases. In response to a negative pressure generated by the decrease of the liquid in the pressure chamber, a valve mechanism of the valve unit selectively establishes a supply state where the liquid is supplied from the liquid supply passage to the pressure chamber and a non-supply state where the liquid is not supplied from the liquid supply passage to the pressure chamber. An flow rate adjuster forcibly changes a flow rate of the liquid that flows through the liquid supply passage.

38 Claims, 31 Drawing Sheets

LIQUID INJECTING APPARATUS

BACKGROUND OF THE INVENTION

The present invention relates to a liquid injecting apparatus that jets liquid from a nozzle to a target.

Inkjet printers are widely known as liquid injecting apparatuses for injecting liquid from a nozzle of a recording head onto target. For example, a serial printing type inkjet printer includes an inkjet recording head (hereinafter referred to as recording head), which is mounted on a carriage and reciprocated in a main scanning direction, and paper feeding means, which feeds sheets of recording paper in a direction perpendicular to the main scanning direction. The recording head jets ink droplets based on printing data, thereby executes printing on the recording paper. Many of inkjet printers that are mainly used at home have ink cartridges for supplying ink to the recording head. Ink cartridges are detachably mounted on the carriage mounting the recording head.

A typical recording head used in inkjet printers has a pressurizing chamber. Ink is pressurized in the pressurizing chamber and discharged through nozzle openings as ink droplets to recording paper. Ink solvent (for example, water) evaporates from the nozzle openings. This increases the viscosity of the ink and solidifies the ink. Also, dust collected on the nozzle opening and bubbles trapped in the ink hinder normal discharge of ink droplets. Abnormal ink discharge results in poor printing.

Therefore, this type of inkjet printer has capping means and wiping means. The capping means seals the surface of the recording head on which the nozzles are located when printing is not being performed. The wiping means wipes and cleans the nozzle surface of the recording head as necessary. When the inkjet printer is not printing, the capping means functions as a cover for preventing ink at the nozzle openings of the recording head from being dried. The capping means also has maintenance function. Specifically, when the nozzle openings are clogged, the capping means seals the nozzle surface, so that the negative pressure of a suction pump acts on the nozzle openings. This draws ink from the nozzle openings and opens the nozzle openings.

The forcible suction of ink to get rid of clogging of the recording head is referred to cleaning operation. For example, when an inkjet printer is used after a long interval, the cleaning operation is automatically executed. Also, when a user discovers poor printing results and turns a cleaning switch, the cleaning operation is executed.

In the maintenance function by the cleaning operation, the nozzle surface of the recording head is sucked using the capping means. Thus, even if the negative pressure is removed after the suction, a slight vacuum pressure remains in the recording head. Further, since there are bubbles in the ink discharged to the capping means, bubbles are drawn into the nozzle openings. Therefore, even if the cleaning operation is executed, the printing quality deteriorates. In other words, the reliability of the cleaning operation is lowered.

In the valve unit of the above inkjet printer, bubbles caught in ink supplied from the ink cartridge, bubbles remained after the initial charging, and bubbles drawn through the nozzle openings of the recording head reside in the pressurizing chambers. The residing bubbles lower the filling factor of ink in the pressurizing chamber. The bubbles in the pressurizing chamber flow out during printing, which degrades the printing quality.

BRIEF SUMMARY OF THE INVENTION

Accordingly, it is an objective of the present invention to provide a liquid injecting apparatus that improves the reliability of the cleaning operation and supply of liquid to the recording head.

To achieve the foregoing and other objectives and in accordance with the purpose of the present invention, a liquid injection apparatus having a liquid reservoir for containing liquid, a recording head for injecting the liquid, and a liquid supply passage for supplying the liquid in the liquid reservoir to the recording head is provided. The device includes a valve unit and an flow rate adjuster. The valve unit includes a pressure chamber and a valve mechanism. The pressure chamber temporarily retains the liquid at the liquid supply passage. The liquid in the pressure chamber is consumed as the liquid is injected from the recording head. In response to a negative pressure generated by the consumption of the liquid in the pressure chamber, the valve mechanism selectively establishes a supply state where the liquid is supplied from the liquid supply passage to the pressure chamber and a non-supply state where the liquid is not supplied from the liquid supply passage to the pressure chamber. The flow rate adjuster forcibly changes a flow rate of the liquid that flows through the liquid supply passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 18(*b*) is a cross-sectional view taken along line 18-18 of FIG. 17, showing a forcibly opened state of the valve unit;

FIG. 23(*b*) is a cross-sectional view taken along line 23-23 of FIG. 21, showing an opened state of the valve unit;

FIG. 24(*b*) is a cross-sectional view showing an opened sate of the valve unit;

FIG. 25(*b*) is a cross-sectional view showing an opened sate of the valve unit;

FIG. 29(*b*) is a perspective view showing a leaf spring;

DETAILED DESCRIPTION OF THE PREFERRED EMBODIMENTS

A preferred embodiment of the present invention will now be described with reference to FIGS. 1 through 13.

Figure 1:
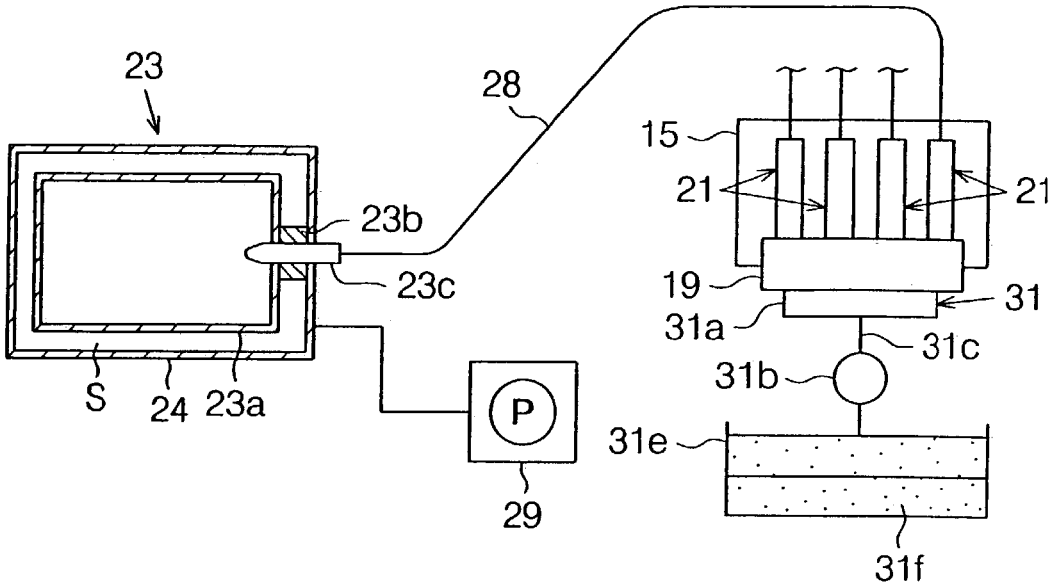
FIG. 1 is a diagrammatic view showing a first ink supply system of an inkjet printer according to a first embodiment of the present invention.
Figure 2:
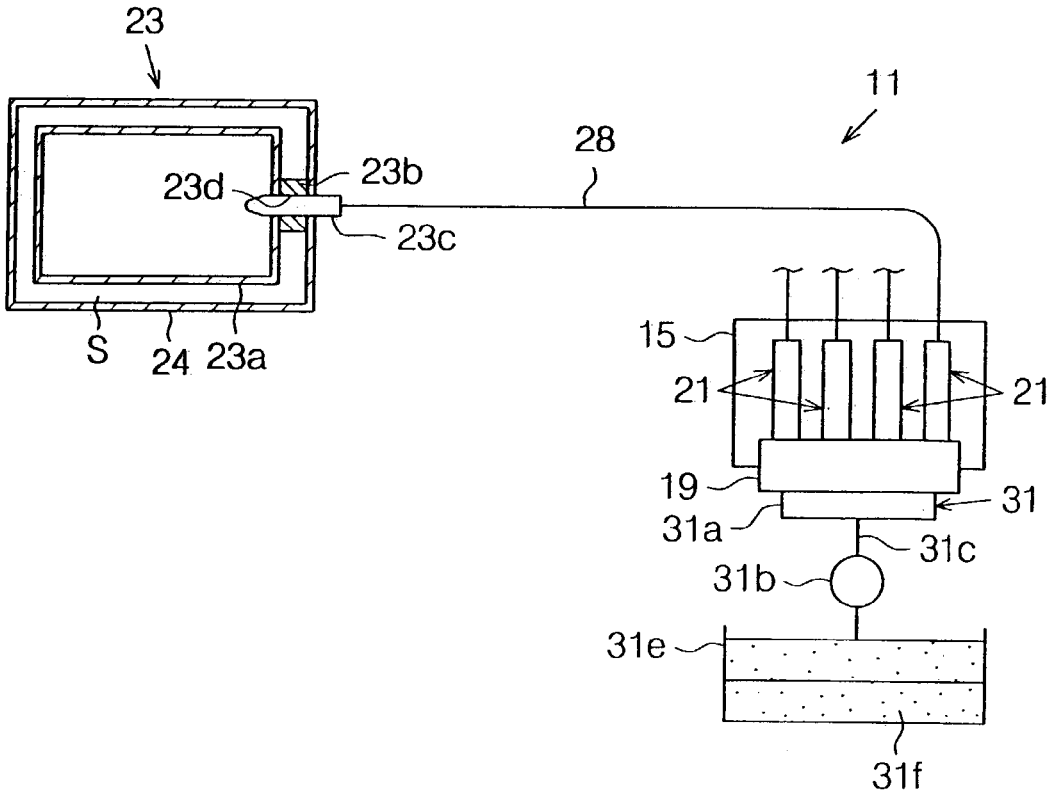
FIG. 2 is a diagrammatic view showing a second ink supply system of an inkjet printer.

FIGS. 1 and 2 are diagrammatic views showing a liquid injecting apparatus, which is an inkjet printer 11 in this embodiment. Liquid storing means and liquid packs are provided in the main body of the inkjet printer 11. In this embodiment, the liquid storing means is ink cartridges 23, and the liquid packs are ink packs 23*a*. Liquid stored in each ink pack 23*a*, which is ink in this embodiment, is supplied to a liquid injecting head through a supply tube 28 and a liquid supplying valve unit. In this embodiment, the liquid supplying valve unit is a valve unit 21, and the liquid injecting head is a recording head 19. The supply tube 28 and the valve unit 21 form a liquid supply passage.

Such inject printers include a printer that prints on a large format target such as an A0 sized sheet of paper. This printer consumes a great amount of ink and thus needs to store a great amount of ink. Such a printer has an off-carriage configuration having no ink cartridges 23 on the carriage 15.

In recent years, compact and slim off-carriage type printers that add to flexibility in ink cartridge arrangement are used. Therefore, although the present invention is applied to a printer that prints on large formant sheets of paper in this embodiment, the present invention may be applied to compact and slim printers.

The ink supply system shown in FIG. 1 is an air pressurizing type. That is, FIG. 1 shows the inkjet printer 11 that pressurizes the ink packs 23*a* with air to supply ink. Each ink cartridge 23 includes an airtight outer case 24. In the outer case 24 is located the ink pack 23*a*. The ink pack 23*a* is made of a flexible material such as a laminate film of a polyethylene film on which aluminum is deposited. The ink pack 23*a* is filled with ink. A needle receiving portion 23*b* is formed on a side of the ink pack 23*a*. A needle 23*c* is attached to an ink cartridge holder (not shown). The needle 23*c* is held by the needle receiving portion, 23*b*. The needle 23*c* is coupled to one end of a supply tube 28 and supplies ink to the valve unit 21. The supply tubes 28 are made of a flexible material such as polyethylene. The supply tubes 28 may have a two-layer structure having an inner layer and an outer layer. In this case, the inner layer is made of a flexible material having a high chemical resistance, and the outer layer is made of polyvinyl chloride having a high airtight property or of a metal film.

A space S is defined between each ink cartridge 23 and the associated ink pack 23*a*. A pressurizing pump 29 sends pressurized air to the spaces S. The ink cartridges 23 are airtight. The pressurizing pump 29 sends pressurized air to the spaces S, which pressurizes the ink packs 23*a*. Positive pressure flows the ink filling each ink pack 23*a* to the corresponding valve unit 21 on the carriage 15 through the corresponding supply tube 28.

FIG. 2 is a diagrammatic view showing the inkjet printer 11, which supplies ink using pressure head. An outlet portion, which is an ink outlet 23*d* in this embodiment, is formed in each ink pack 23*a*. The ink outlets 23*d* are located above the valve units 21 and the recording head 19 in the gravitational direction, or in a direction along which force of gravity acts. This creates pressure head and a positive pressure. The positive pressure supplies ink to the recording head 19 through the supply tubes 28 and the valve units 21.

Figure 3:
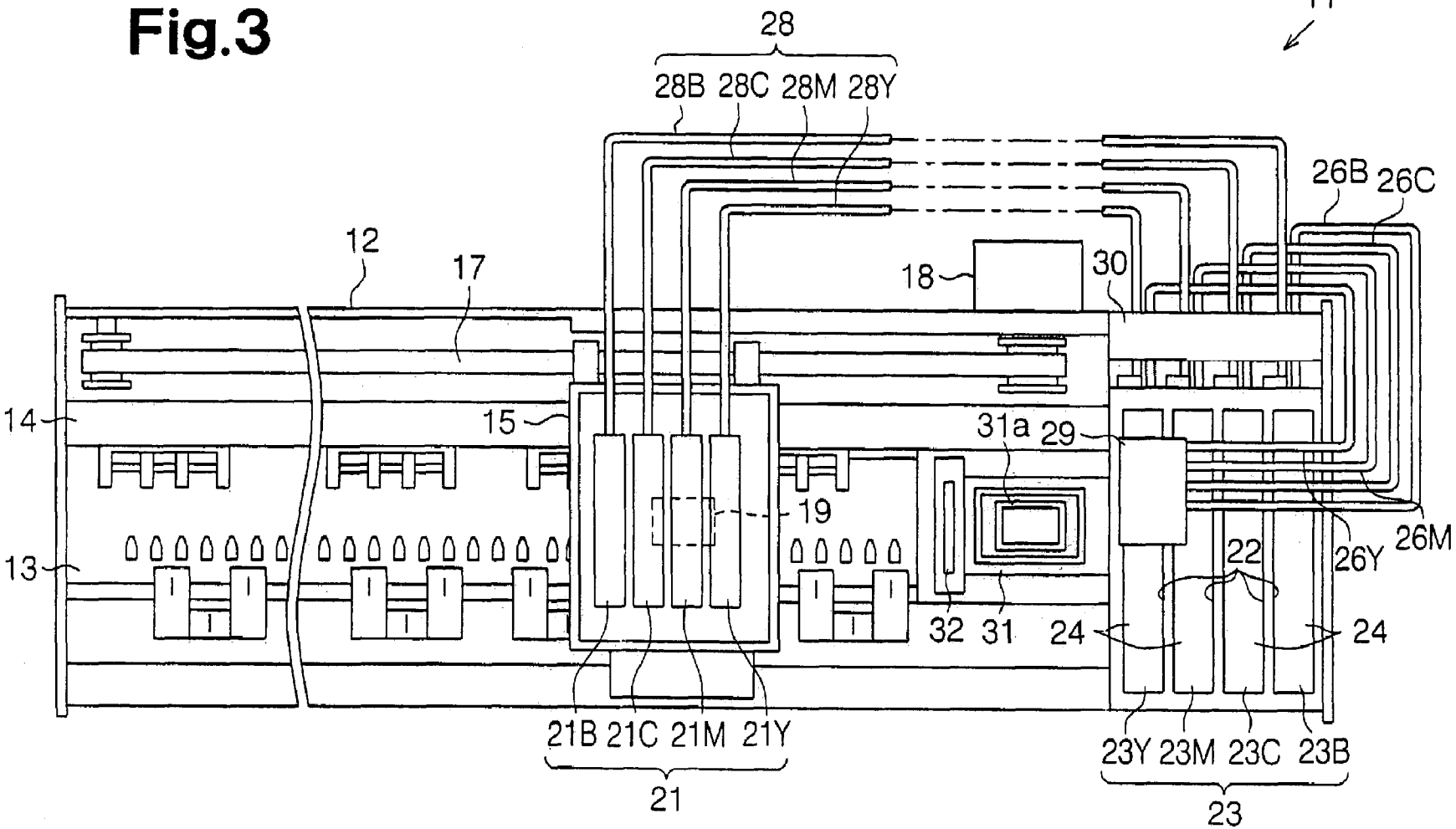
FIG. 3 is a plan view showing the inkjet printer of the first embodiment.

In this invention, the inkjet printer 11 may use any of the above ink supply systems. FIG. 3 is a plan view that illustrates a basic configuration of the inkjet printer 11, which uses the ink supply system shown in FIG. 1.

As shown in FIG. 3, the inkjet printer 11 has a rectangular parallelepiped frame 12 having an open upper end. A paper feeding member 13 is supported by the frame 12. A paper feeding mechanism (not shown) feeds paper along the paper feeding member 13. The frame 12 also has a guide member 14 that extends parallel to the paper feeding member 13. The guide member 14 supports the carriage 15 such that the carriage 15 is movable along the axial direction of the guide member 14. The carriage 15 is coupled to a carriage motor 18 with a timing belt 17. The carriage motor 18 reciprocates the carriage 15 along the guide member 14.

On a side of the carriage 15 that faces the paper feeder 13 is mounted the recording head 19. The valve units 21B, 21C, 21M, 21Y for supplying ink to the recording head 19 are mounted on the carriage 15. Hereinafter, the valve units 21B, 21C, 21M, 21Y are sometimes typified by "valve unit 21". In this embodiment, the number of the valve units 21B, 21C, 21M, 21Y is four for temporarily storing inks of four colors (black ink B and color inks of cyan C, magenta M, yellow Y).

Nozzle ports are located in the lower side of the recording head 19. Inks are supplied to the recording head 19 from the valve units 21B, 21C, 21M, 21Y by operation of piezoelectric elements (not shown). Accordingly, ink droplets are sprayed onto the paper.

Four cartridge holders 22 are formed at the right end of the frame 12. The ink cartridges 23B, 23C, 23M, 23Y are detachably supported by the cartridge holders 22. Hereinafter, the ink cartridges 23B, 23C, 23M, 23Y are sometimes typified by "ink cartridge 23". Each of the ink cartridges 23B, 23C, 23M, 23Y includes the airtight case 24 and the ink pack 23*a* located in the case 24 (see FIG. 1). The ink packs 23*a* store the black ink B and the color inks C, M, Y.

The ink packs 23*a* of the ink cartridges 23 are connected to the valve units 21 by the flexible supply tubes 28B, 28C, 28M, 28Y. Hereinafter, the supply tubes 28B, 28C, 28M, 28Y are sometimes typified by "supply tube 28".

The pressurizing pump 29 is located above the ink cartridge 23Y, which stores the yellow ink Y. The pressurizing pump 29 is connected to the cases 24 of the ink cartridges 23B, 23C, 23M, 23Y through air supply tubes 26B, 26C, 26M, 26Y. Therefore, air pressurized by the pressurizing pump 29 is sent to the outer cases 24 of the ink cartridges 23B, 23C, 23M, 23Y through the air supply tubes 26B, 26C, 26M, 26Y and is guided to the space S between each outer case 24 and the corresponding ink pack 23*a* (see FIG. 1).

That is, when the pressurizing pump 29 is actuated and sends air to the outer cases 24, the ink packs 23*a* are collapsed by the pressurized air. The inks stored in the ink packs 23*a* are supplied to the valve units 21B, 21C, 21M, 21Y through the supply tubes 28B, 28C, 28M, 28Y.

Flow rate adjusting means, which is a passage valve 30, is located on the supply tubes 28B, 28*c*, 28M, 28Y upstream of the valve units 21B, 21C, 21M, 21Y. The passage valve 30 is fixed to the frame 12 in the vicinity of the ink cartridges 23 and regulates the flow rate of the ink flowing through the supply tubes 28B, 28C, 28M, 28Y.

Capping means 31 is located at a non-printing area (home position). The capping means 31 seals a nozzle surface of the recording head 19. A cap member 31*a* is located on the upper side of the capping means 31. The cap member 31 is made of an elastic material such as rubber and closely contacts the nozzle surface of the recording head 19 to seal the nozzle surface. When the carriage 15 is moved to the home position, the capping means 31 is moved (upward) toward the recording head 19, so that the cap member 31*a* seals the nozzle surface of the recording head 19.

As shown FIG. 1, the cap member 31*a* functions as a lid to seal the nozzle surface of the recording head 19 when the inkjet printer 11 is not operating, thereby preventing the nozzle openings from being dry. The bottom portion of the cap member 31*a* is connected to a tube 31*c* of suction means, which is a suction pump (tube pump) 31*b*. Negative pressure produced by the suction pump 31*b* is applied to the recording head 19 so that ink is discharged from the recording head 19, which cleans the head 19.

One of the methods for executing suction with the suction pump 31*b* to discharge bubbles from the valve units 21 and the recording head 19 is "choke cleaning". In "choke cleaning", the passage valve 30, which is located upstream of the recording head 19, is closed (choked), and suction is applied to the nozzle surface by the suction pump 31*b*. The pressure in the valve units 21 and the recording head 19 is increased to expand the bubbles, so that the bubbles are drawn to a section downstream of the filter of the recording head 19. In this state, the passage valve 30 is opened to discharge the bubbles. Ink drawn by the suction pump 31*b* is collected in a waste collecting box 31*e*. A multilayer waste absorbent 31*f* is accommodated in the waste collecting box 31*e* to store collected ink.

A rectangular wiping member 32 is located adjacent to the printing area of the capping means 31. The wiping member 32 is made of an elastic member such as rubber. The wiping member 32 is moved horizontally as necessary to wipe and clean the nozzle surface.

The valve units 21 will now be described with reference to FIGS. 4 through 11.

Figure 4:
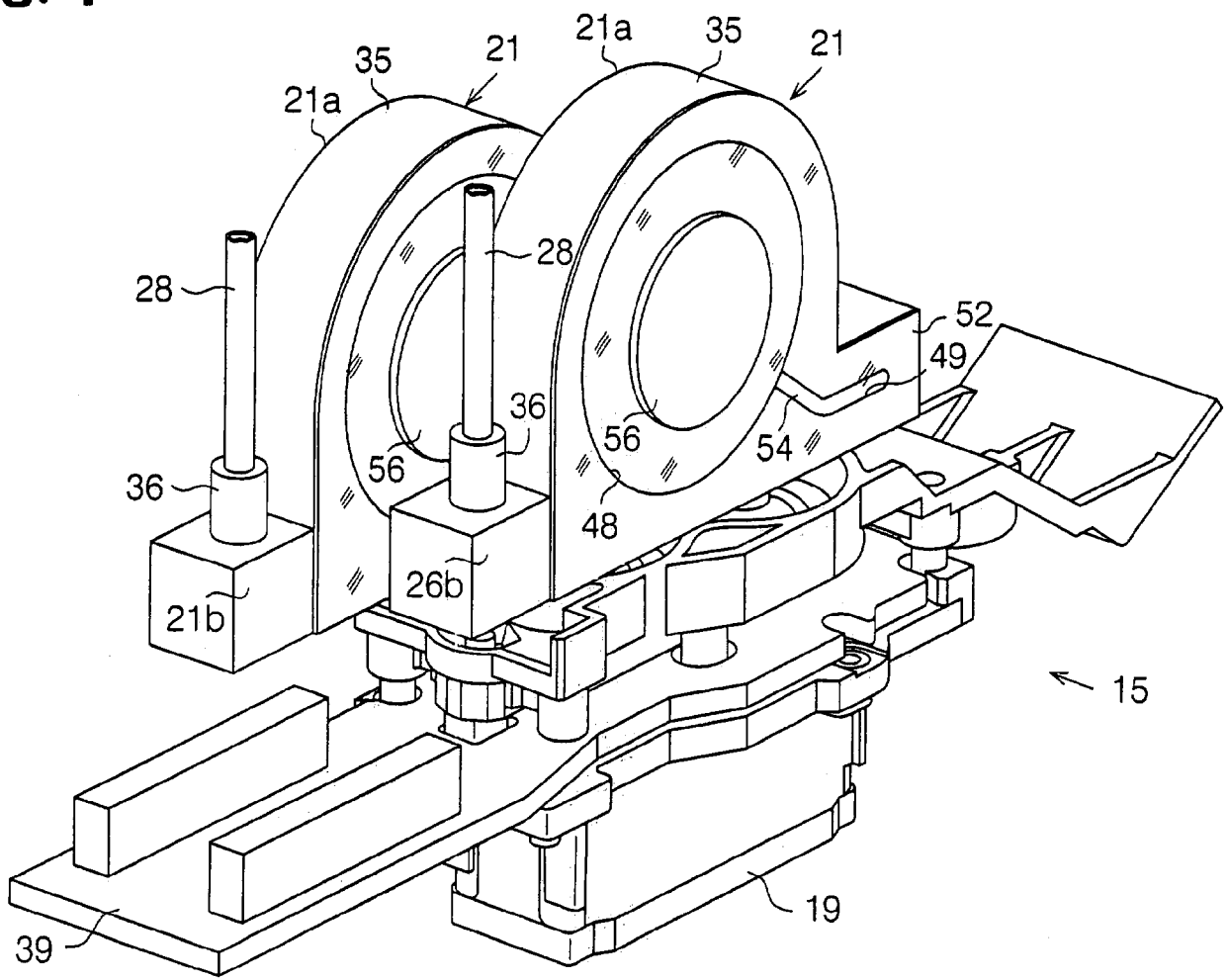
FIG. 4 is a left perspective view illustrating the recording head and valve units of the printer shown in FIG. 3.
Figure 5:
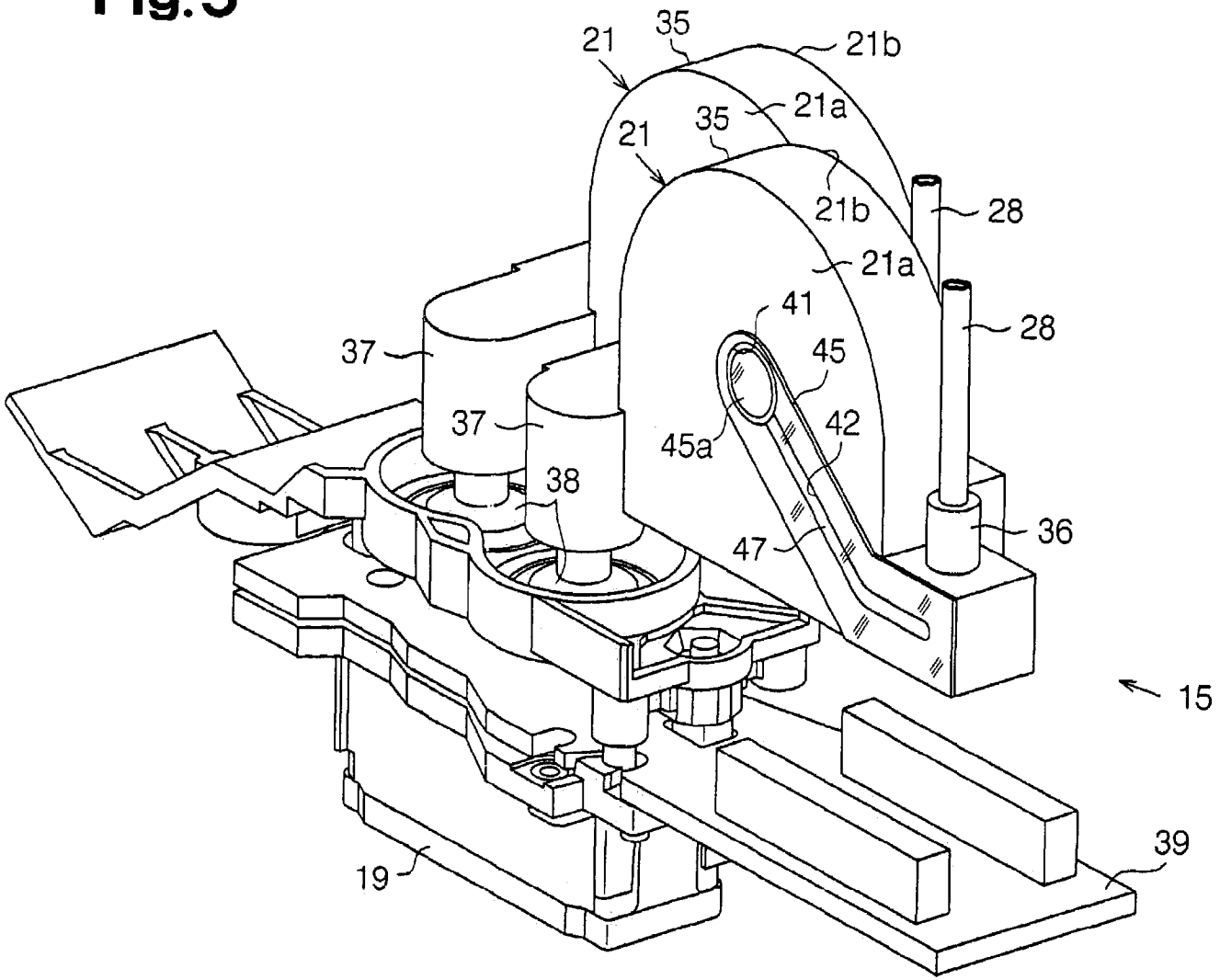
FIG. 5 is a right perspective view of the recording head and the valve units.
Figure 6:
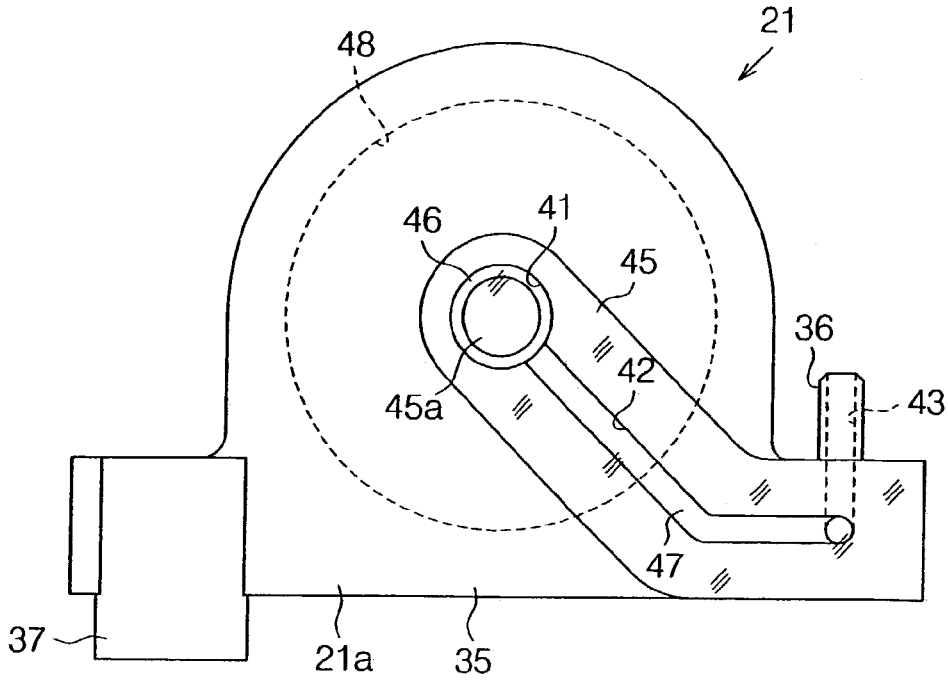
FIG. 6 is a right side view showing the valve unit.
Figure 7:
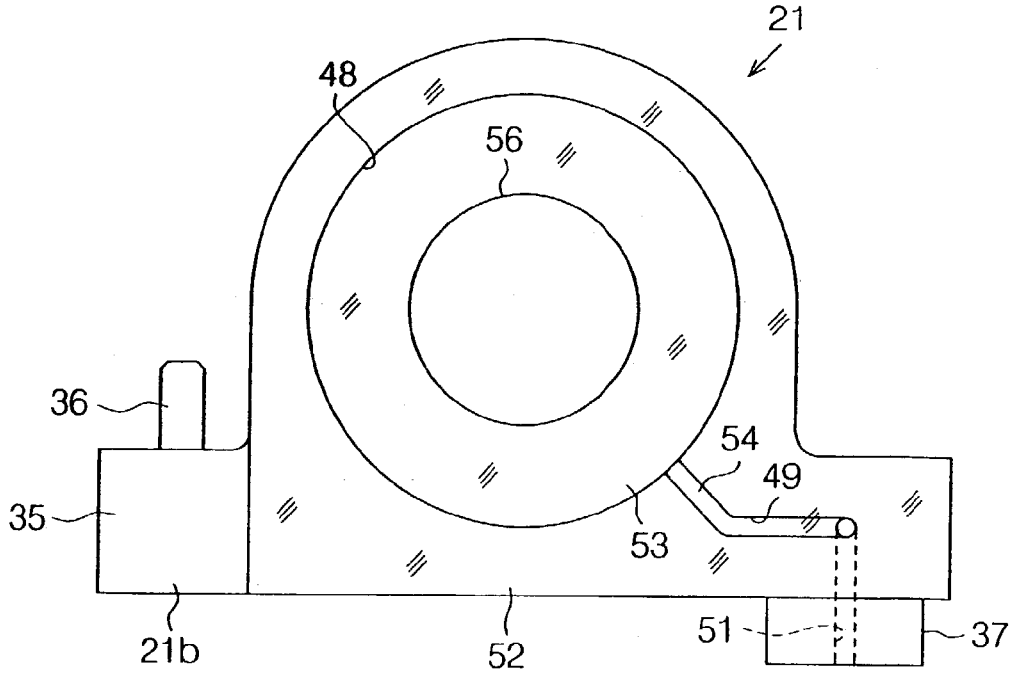
FIG. 7 is a left side view showing the valve unit.
Figure 8:
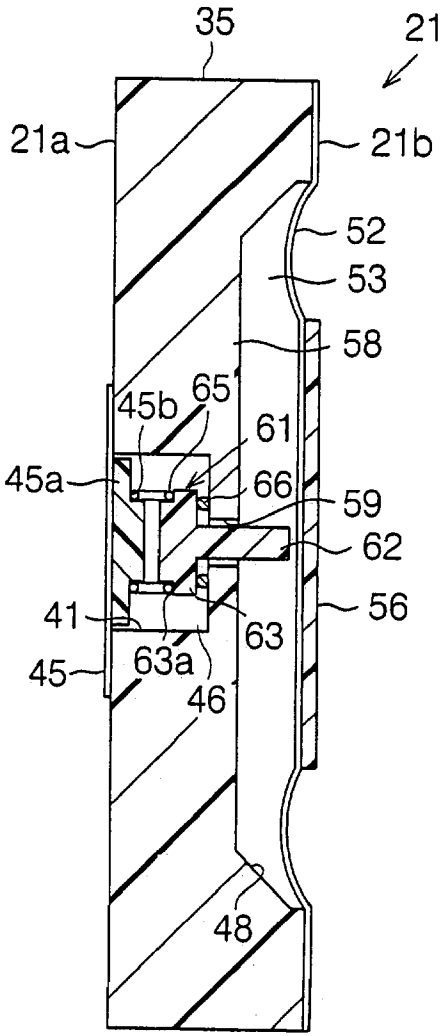
FIG. 8 is a right side view showing the valve unit.
Figure 9:
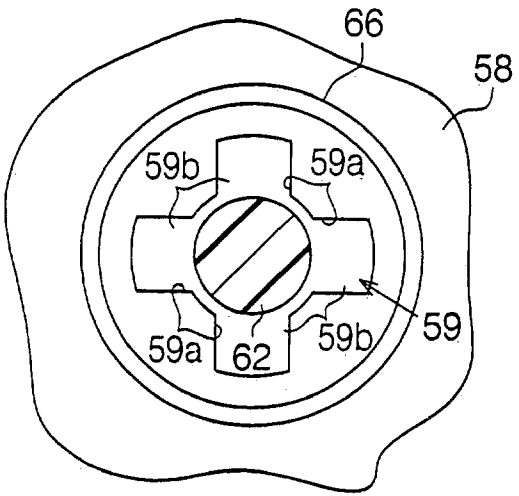
FIG. 9 is a partial enlarged side cross-sectional view of the valve unit taken along line 9-9 of FIG. 8.
Figure 10:
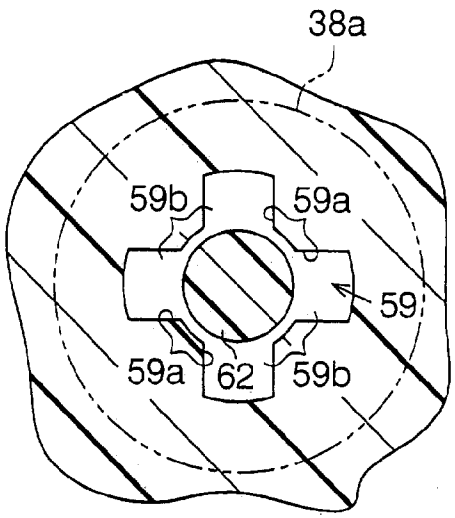
FIG. 10 is a partial enlarged cross-sectional view of the valve unit taken along line 10-10 of FIG. 8.

FIGS. 4 and 5 are perspective views showing the recording head 19 and two of the valve units 21. FIGS. 6 and 7 are side views showing one of the valve units 21. FIG. 8 is a cross sectional view showing one of the valve units 21. FIGS. 9 and 10 are partial cross-sectional views showing one of the valve units 21. For purposes of illustration, only two of the valve units 21 of the recording head 19 are shown in FIGS. 4 and 5, and the remaining two valve units 21 are omitted.

Other than the illustrated structure, a plurality of valve units may be used to correspond to a color of ink discharged from the single recording head 19. Further, the number of the recording heads 19, which has a plurality of the valve units 21, may be two or more.

As shown in FIGS. 4 and 5, each valve unit 21 includes a substantially circular flat unit case 35 made of synthetic resin. A connection portion 36 is formed at one end of each unit case 35. The connection portion 36 is connected to the corresponding supply tube 28. An ink discharging portion 37 is located at the other end of each unit case 35. The ink discharging portion 37 is connected to the recording head 19 with an annular connecting member 38 and a plate-like head support 39.

As shown in FIGS. 6 and 8, a substantially cylindrical small recess 41 is formed in a first side 21*a* of each unit case 35. As shown in FIG. 6, a substantially L-shaped groove 42 is formed on the first side 21*a*. The groove 42 extends from the small recess 41 toward the connection portion 36. One end of the groove 42 is communicated with a hole 43 formed in the connection portion 36. A flexible liquid supply chamber film member is heat welded to the first side 21*a* to cover the small recess 41 and the groove 42. The liquid supply chamber film member is a first film member 45 in this embodiment. The small recess 41 and the first film member 45 define a substantially cylindrical liquid supply chamber, which is an ink supply chamber 46 in this embodiment. The groove 42 and the first film member 45 define an ink introducing channel 47. Ink that flows in through the supply tube 28 flows into the ink supply chamber 46 through the hole 43 of the connection portion 36 and the ink introducing channel 47.

It is important that the material for the first film member 45 have no chemical influences on the property of the ink, a low water permeability, a low oxygen permeability, and a low nitrogen permeability. Therefore, the first film member 45 is preferably made of laminated and adhered nylon films each formed by coating polyvinylidene chloride (saran) on a high-density polyethylene film or a polypropylene film. Alternatively, the first film member 45 may be formed of a polyethylene terephthalate material on which alumina or silica is deposited.

As shown in FIGS. 6 and 8, a spring seat 45*a* is formed on the side of the first film member 45 facing the ink supply chamber 46. The spring seat 45*a* is concentric with the ink chamber 46. The outer diameter of the spring seat 45*a* is slightly less than the inner diameter of the ink supply chamber 46. The spring seat 45*a* may be heat welded to the first film member 45 in advance. Alternatively, the spring seat 45*a* may be attached to the first film member 45 with adhesive or two-sided tapes. An annular step 45*b* is formed on a side of the spring seat 45*a* opposite from the first film member 45.

As shown in FIGS. 7 and 8, a substantially truncated cone shaped large recess 48 is formed in a second side 21*b* of each unit case 35. The large recess 48 has a greater diameter than that of the small recess 41 and concentric with the small recess 41.

As shown in FIG. 7, a groove 49 is formed in the second side 21*b* of the unit case 35. The groove 49 extends from an end of the large recess 48 toward the ink discharging portion 37. One end of the groove 49 is communicated with a hole 51 formed in the ink discharging portion 37. A flexible pressure chamber film member is heat welded to the second side 21*b* to cover the large recess 48 and the groove 49. The pressure chamber film member is a second film member 52 in this embodiment. The large recess 48 and the second film member 52 define a substantially truncated cone shaped pressure chamber 53. The groove 49 and the second film member 52 define an ink discharging channel 54. Ink in the pressure chamber 53 is sent to the recording head 19 through the ink discharging channel 54 and the hole 51 of the ink discharging portion 37.

It is important that the material for the second film member 52 be sufficiently soft to effectively detect the negative pressure in the pressure chamber 53 and have no chemical influences on the property of the ink, a low water permeability, a low oxygen permeability, and a low nitrogen permeability. Therefore, the second film member 52 is preferably made of laminated and adhered nylon films each formed by coating polyvinylidene chloride (Saran) on a high-density polyethylene film or a polypropylene film. Alternatively, the first film member 45 may be formed of a polyethylene terephthalate material on which alumina or silica is deposited.

A pressure receiving plate 56 is attached to a side of the second film member 52 opposite from the pressure chamber 53. The pressure receiving plate 56 is made of a material that is harder than the second film member 52. The pressure receiving plate 56 has a smaller outer diameter than that of the pressure chamber 53. The pressure receiving plate 56 needs to be sufficiently light so that, when the carriage 15 is moved in a printing operation, the weight of the plate 56 and the acceleration of the carriage 15 do not move the second film member 52 and thus vary the pressure in the pressure chamber 53. Accordingly, the pressure receiving plate 56 is preferably made of a light plastic material such as polyethylene or polypropylene.

The pressure sensing plate 56 may be heat welded to second film member 52 in advance. Alternatively, the pressure sensing plate 56 may be attached to the second film member 52 with adhesive or two-sided tapes. As shown in FIGS. 4 and 5, the pressure receiving plate 56 is shaped as a disk. However, the pressure receiving plate 56 may have a different shape. However, in a case where the pressure chamber 53 is a thin cylindrical space, the pressure receiving plate 56 is preferably disk shaped and concentric with the pressure chamber 53.

As shown in FIG. 8, a partition 58 is formed between the ink supply chamber 46 and the pressure chamber 53 of each unit case 35 to define the chambers 46, 53. A support hole 59 is formed in the partition 58 to communicate the ink supply chamber 46 with the pressure chamber 53.

A valve body 61 is slidably supported by the support chamber 59. The valve body 61 forms a valve mechanism. Specifically, the valve body 61 includes a cylindrical rod member 62 and a plate member 63 having a circular cross-section. The plate member 63 is integrally formed with the rod member 62. The outer diameter of the plate member 63 is greater than the outer diameter of the rod member 62. Only the rod member 62 of the valve body 61 is slidably supported by the support hole 59.

As shown in FIGS. 9 and 10, each support hole 59 has four equally spaced notches 59*a*. Therefore, when the rod member 62 is supported by the support hole 59, the rod member 62 and the notches 59*a* define four liquid supply holes, which are ink channels 59*b* in this embodiment. As shown in FIG. 8, the plate member 63 is located in the ink supply chamber 46. A step 63*a* is formed on the plate member 63 at the side opposite from the rod member 62.

A sealing coil spring 65 is engaged with the step 45*b* of the spring seat 45*a* and the step 63*a* of the plate member 63. The sealing spring 65 urges the spring seat 45*a* and the plate member 63 away from each other.

On the other hand, as shown in FIGS. 8 and 9, an annular rubber sealing member 66 is attached to the partition 58 to surround the support hole 59. The force of the sealing spring 65 causes the plate member 63 of the valve body 61 to contact the sealing member 66. The sealing member 66 may be an O-ring. Alternatively, the sealing member 66 may be integrally formed with the partition 58 through two-color molding method (coinjection molding method) of elastomer resins. When the plate member 63 contacts the sealing member 66, the ink channels 59*b* are closed.

When the recording head 19 is in the non-printing state, or in a state to use no ink, spring load W1 of the sealing spring 65 acts on the plate member 63 of the valve body 61. The plate member 63 also receives the pressure load P1 of the ink supplied to the ink supply chamber 46. As a result, the plate member 63 contacts the rubber sealing member 66, and the ink channels 59*b* (see FIG. 9) are closed. In other words, the ink supply chamber 46 and the pressure chamber 53 are in a non-communicated state, and the valve unit 21 is in a self-closing state.

On the other hand, when the recording head 19 is in printing state and ink is used, the second film member 52 is displaced into the ink supply chamber 46 as the amount of ink in the pressure chamber 53 decreases. As a result, the center portion of the second film member 52 contacts the end of the rod member 62, which forms the valve body 61. The reactive force required for displacing the second film member 52 at this time is referred to as Wd. When ink is used by the recording head 19 further, negative pressure P2 is produced in the pressure chamber 53. At this time, if an equality P2>W1+P1+Wd is satisfied, the second film member 52 presses the rod member 62, which, in turn, separates the plate member 63 from the sealing member 66. As a result, the ink channels 59*b* are open as shown in FIG. 11.

Therefore, the ink in the ink supply chamber 46 is supplied to the pressure chamber 53 through the ink channels 59*b* that extend from the ink supply chamber 46 to the pressure chamber 53. The flow of ink into the pressure chamber 53 cancels the negative pressure in the pressure chamber 53. Accordingly, the valve body 61 is moved to the closed position as shown in FIG. 8, which stops the supply of ink from the ink supply chamber 46 to the pressure chamber 53.

Figure 11:
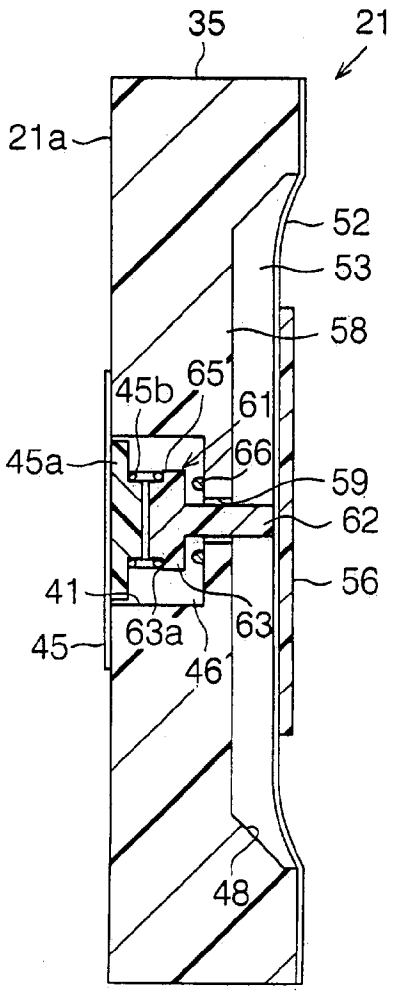
FIG. 11 is a cross-sectional view, showing the opened state of the valve unit.

The actions of the open/close valve of the valve body 61 need not be achieved by repeating the extreme actions shown in FIGS. 8 and 11. In a real printing operation, the second film member 52 is in equilibrium contacting the end of the rod member 62, which forms the valve body 61. As ink is used, the second film member 52 gradually opens and successively supplies ink to the pressure chamber 53.

Pressure fluctuations in the pressure chamber 53 is restricted within a certain range by the opening and closing action of the valve body 61 and is isolated from the pressure fluctuations in the ink supply chamber 46. Therefore, even if pressure fluctuations are created in the supply tubes 28 by reciprocation of the carriage 15, the pressure in the pressure chamber 53 is not influenced. As a result, ink is reliably supplied from the pressure chamber 53 to the recording head 19.

The pressure receiving plate 56 is capable of receiving the displacement of the second film member 52 by the entire area. Therefore, displacement of the second film member 52 is reliably transmitted to the valve body 61, which improves the reliability of the opening and closing actions of the valve body 61.

Also, the ink supply system from the ink cartridge 23 to the recording head 19 is formed as a sealed path, which can be filled with ink. Therefore, by using deaerated ink, a small amount of bubbles in the supply system is absorbed by the ink. Thus, printing defect called "missing dots" caused by bubbles in the ink supply system is far less likely to be caused.

The passage valve 30 will now be described with reference to FIGS. 12 and 13.

Figure 12:
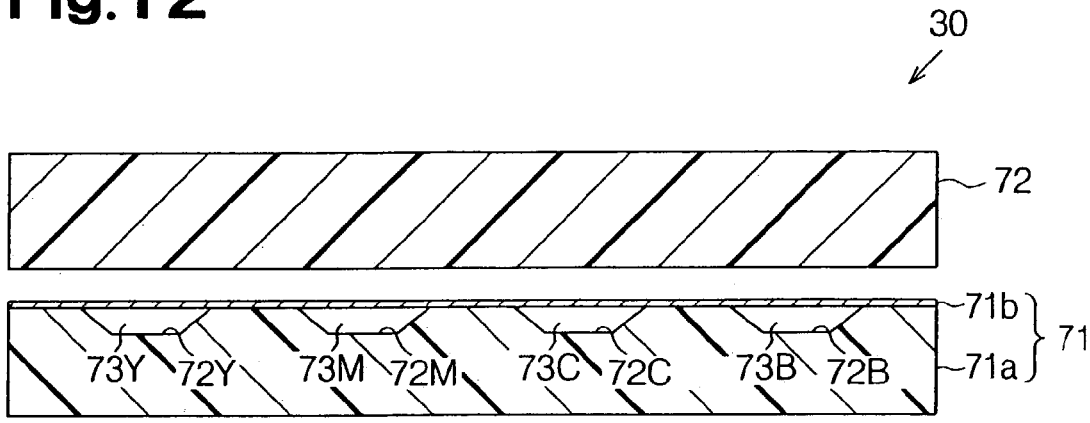
FIG. 12 is a cross-sectional view of a passage valve.

As shown in FIG. 12, the passage valve 30 includes a flexible member 71 and a pressing member 72. The flexible member 71 includes an ink channel main body 71*a*, which is substantially rectangular parallelepiped. Four grooves 72B, 72C, 72M, 72Y are formed on the upper surface of the ink channel main body 71*a*. A flexible member, which is a sealing film 71*b* in this embodiment, is heat welded to the upper surface of the ink channel main body 71*a* to cover the grooves 72B, 72C, 72M, 72Y. The grooves 72B, 72C, 72M, 72Y and the sealing film 71*b* form ink supply channels 73B, 73C, 73M, 73Y.

The ink supply channels 73B, 73C, 73M, 73Y are located in the supply tubes 28B, 28C, 28M, 28Y, respectively. Therefore, ink that flows out of sections of the tubes 28 that are upstream of the passage valve 30 flows to the ink supply channels 73B, 73C, 73M, 73Y and then flows to sections of the tubes 28 that are downstream of the passage valve 30.

The pressing member 72 is made of a material that is harder than that of the flexible member 71. The pressing member 72 is moved vertically by a drive motor (not shown). Therefore, as shown in FIG. 12, when the pressing member 72 is located above the flexible member 71, the ink supply channels 73B, 73C, 73M, 73Y each have the maximum cross-sectional area, which maximizes the flow rate of ink. When the pressing member 72 descends as shown in FIG. 13, the pressing member 72 presses the flexible member 71 and deforms the flexible member 71, which squeezes the ink supply channels 73B, 73C, 73M, 73Y. As a result, the cross-sectional area of each ink supply channel 73B, 73C, 73M, 73Y is reduced and the flow rate of ink is decreased accordingly. Therefore, the passage valve 30 changes the flow rate of ink flowing through the supply tubes 28 between the maximum value and the minimum values by vertically moving the pressing member 72.

As the volume of the channels of the passage valve 30 is changed, ink in the supply tubes 28 are subjected to great pressure fluctuations. However, since valve units 21 are located downstream of the passage valve 30, the pressure fluctuations in the pressure chamber 53 of each valve unit 21 is constantly limited within a predetermined range. Therefore, the influence of the pressure fluctuations in the passage valve 30 on the supply of ink to the recording head 19 is minimized. Thus, when designing the passage valve 30, pressure fluctuations of ink need not be taken into account. Therefore, the passage valve 30 need not be located above the carriage 15 and can be fixed to the frame 12 as in this embodiment, which adds to the flexibility of the design.

An operation of the above described inkjet printer 11 to improve the ink filling factor of the pressure chamber 53 of each valve unit 21 will now be described.

When bubbles exist in the pressure chamber 53 of the valve unit 21 and decrease the ink filling factor, and bubbles flow to the recording head 19 to cause defective printing, the carriage 15 is moved to the non-printing area (home position). Thereafter, the nozzle surface of the recording head 19 is sealed by the cap member 31*a*.

Figure 13:
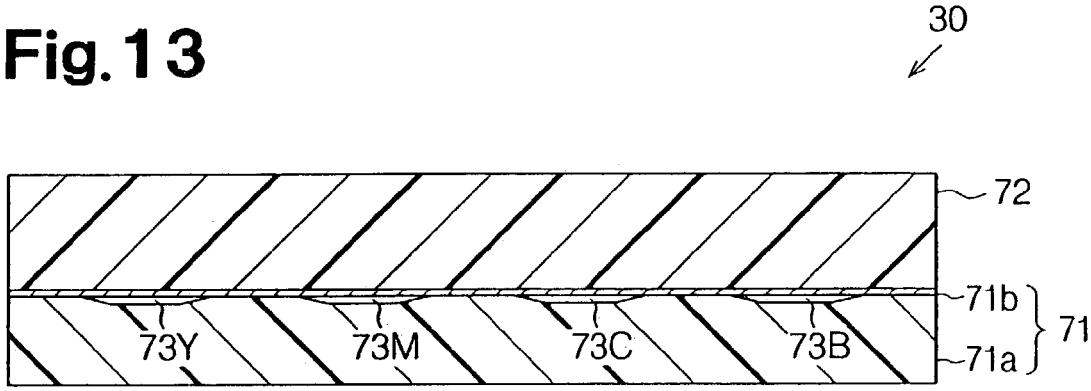
FIG. 13 is a cross-sectional view showing an operation of the passage valve.

Next, as shown in FIG. 13, the pressing member 72 of the passage valve 30 is lowered to minimize the cross-sectional area of each ink supply channels 73B, 73C, 73M, 73Y, thereby minimizing the flow rate of ink. In this state, the suction pump is actuated to create a great negative pressure in the pressure chambers 53. When the inequality P2>W1+P1+Wd is satisfied, the ink channels 59*b* are opened as shown in FIG. 11.

As a result, section of each supply tube 28 that is downstream of the passage valve 30 is communicated with the corresponding pressure chamber 53 through the corresponding ink supply chamber 46, which creates a great negative pressure in the section downstream of the passage valve 30. The volume of bubbles mixed in the ink in the pressure chamber 53 is increased.

In this state, the pressing member 72 of the passage valve 30 is raised as shown in FIG. 12 to quickly open the channel vale 30. This causes ink to rush out of the ink cartridge 23. The ink is then discharged from the recording head 19 through the supply tubes 28, the ink supply chambers 46, and the pressure chambers 53. At this time, the flow of ink discharges the expanded bubbles in the pressure chambers 53 from the recording head 19 with ink. Thereafter, the suction pump is stopped as necessary, and the cap member 31*a* is separated from the recording head 19. The operation is thus terminated. The choke cleaning is performed in this manner. As a result, bubbles in the pressure chamber 53 of the valve unit 21 are discharged and the operation for increasing the ink filling factor is terminated.

The first embodiment has the following advantages.

(1) In the first embodiment, the valve units 21 and the passage valve 30 are located on the supply tubes 28, which supply ink from the ink cartridges 23 to the recording head 19.

Therefore, by pressing the flexible member 71 with the pressing member 72, the flow rate of ink flowing through the supply tubes 28 is decreased. In this state, the recording head 19 is covered by the cap member 31*a* and is subjected to suction of the suction pump 31*b*, which lowers the pressure of ink in sections downstream of the passage valve 30. Thereafter, the suction pump 31*b* is stopped, and the pressing member 72 of the passage valve 30 is quickly separated from the flexible member 71, thereby quickly flowing ink in the ink cartridges 23 to the recording head 19.

As a result, bubbles in the pressure chamber 53 of the valve unit 21 are quickly discharged from the recording head 19. The choke cleaning is thus performed. Therefore, bubbles in the pressure chamber 53, which degrade the ink injection of the recording head 19, are reduced, and the ink filling factor of the pressure chamber 53 is improved. Thus, the recording head 19 reliably injects ink.

(2) In the first embodiment, the passage valve 30 is located upstream of the valve units 21.

Therefore, when ink is sucked from the recording head 19 while the flow rate of ink through the supply tubes 28 is decreased by the passage valve 30, the pressure in the pressure chamber 53 in each valve unit 21 is lowered. Accordingly, the volume of bubbles in the pressure chambers 53 is increased. In this state, the pressing member 72 of the passage valve 30 is raised to open the passage valve 30, which discharges the expanded bubbles from the recording head along with ink.

Thus, compared to a case where the passage valve 30 is located downstream of the valve unit 21, bubbles are more readily discharged since the volume of bubbles, the pressure of which can be lowered. As a result, bubbles in the pressure chambers 53, which degrade the injection performance of the recording head 19, are minimized. Also, the filling factor of the pressure chambers 53 and the injection of the recording head 19 are improved.

(3) In the first embodiment, the pressure chamber 53 of each valve unit 21 is supplied with ink as the amount of stored ink is decreased. Pressure fluctuations in the pressure chamber 53 are limited within a predetermined range. Therefore, even if pressure fluctuations occur in sections upstream of the pressure chambers 53, the recording head 19 is not influenced by the fluctuations. As a result, the passage valve 30, which is located upstream of the valve units 21, may be an apparatus that applies pressure fluctuations to ink. This adds to flexibility of the design.

(4) In the first embodiment, the passage valve 30 is formed of the flexible member 71, which is made of a flexible material, and the pressing member 72, which is made of a material harder than the flexible member 71. The channels are squeezed by pressing the pressing member 72 against the flexible member 71. Also, the channels are expanded by separating the pressing member 72 from the flexible member 71. The flow rate of ink is changed accordingly.

Accordingly, the structure of the passage valve 30 is simplified. This improves the production efficiency of the inkjet printer.

(5) In the first embodiment, the carriage 15 reciprocates relative to the recording paper onto which ink is injected, and the recording head 19 is mounted on the carriage 15. The passage valve 30 is mounted on the frame 12. That is, the passage valve 30 is located at a position other than the carriage 15. However, since pressure fluctuations generated in the passage valve 30 are absorbed by the valve units 21, which are downstream of the passage valve 30, the recording head 19 is not affected by the pressure fluctuations. Also, the filling factor of the pressure chambers 53 of the valve units 21 and the injection of the recording head 19 are improved.

(6) In the first embodiment, the valve unit 21 mounted on the carriage 15 has the valve body 61, which sends ink from the supply tubes 28 to the pressure chambers 53. Each valve unit 21 includes the second film member 52. With the second film member 52, the valve unit 21 detects negative pressure created by a decrease of ink in the corresponding pressure chamber 53, which is used at the recording head, and slides the valve body 61 to open the ink channels 59*b*. Therefore, in accordance with the amount of ink used at the recording head 19, ink is supplied to the pressure chamber 53 in response to the vacuum pressure as occasion demands. This ensures that ink droplets are reliably injected from the recording head 19.

(7) In the first embodiment, the second film members 52 are provided in the unit cases 35. When receiving negative pressure from the corresponding pressure chamber 53, each second film member 52 is displaced into the pressure chamber 53 and moves the valve body 61, thereby opening or closing the ink channels 59*b*. In other words, reliable injection of liquid form the recording head 19 is ensured by a simple structure.

(8) In the first embodiment, each second film member 52 has the pressure receiving plate 56. Therefore, each pressure receiving plate 56 receives displacement of the corresponding flexible second film member 52 at the entire contacting area, thereby reliably transmitting the displacement of the second film member 52 to the corresponding rod 62. The reliability of the opening action and the closing action of the valve unit 21 are improved.

(9) In the first embodiment, the inkjet printer 11 has an off-carriage configuration, in which the ink cartridges 23 are provided on the main body. Pressurized air is sent to the space between the ink pack 23*a* of each ink cartridge 23 and the corresponding outer case 24 to supply ink to the pressure chamber 53. Therefore, ink is reliably supplied to the pressure chamber 53. A configuration where the ink outlets 23*d* are located below the valve units 21 in the gravitational direction to utilize a head to supply ink to the vale units 21 eliminates the necessity of a pressurizing pump and thus provides an ink supply system having a simple structure.

(10) In the first embodiment, each valve body 61 is urged by the corresponding sealing spring 65, which is a coil spring, to close the ink channel 59*b*. Therefore, each valve body 61 is urged by a simple structure, and the corresponding valve unit 21 is opened and automatically closed by displacing and not displacing the second film member 52 of the valve body 61. Thus, the valve units 21 having a self-closing function are obtained.

(11) In the first embodiment, each valve body 61 includes the plate member 63 and the rod member 62. The plate member 63 receives the urging force of the sealing spring 65 at one side and closes the ink channel 59*b* at the other side. The rod member 62 is formed integrally with the center portion of the plate member 63 and slides in the unit case 35 of the valve unit 21. One end of the rod member 62 receives the pressing action caused by displacement of the second film member 52. This structure permits the ink channels 59*b* to be reliably closed and opened.

(12) In the first embodiment, the support hole 59 is formed in each unit case 35 to slidably support the rod member 62. The ink channels 59*b* are formed by forming equally spaced notches on the circumference of the support hole 59. If there no notches in the hole 59, the channel for supplying ink to the pressure chamber 53 is closed by the rod member 62 even if the plate member 63 of the valve body 61 is separated form the ink channels 59*b*. However, in this embodiment, the ink channels 59*b* are formed by making notches so that ink readily flows into the pressure chamber 53.

(13) In the first embodiment, the annular seal member 66 is located about the ink channels 59*b*. The plate member 63 of the valve body 61 contacts the seal member 66 to close the ink channels 59*b*. Therefore, when the valve unit 21 is opened, the ink channels 59*b* are reliably closed by the valve body 61.

(14) In the first embodiment, suction is executed while the passage valve 30 is closed, and then, the passage valve 30 is opened. Thus, the passage valve 30 is opened when negative pressure is created in the pressure chamber 53, which flushes ink to the recording head 19.

A liquid injecting apparatus according to a second embodiment of the present invention will now be described with reference to FIGS. 14 through 18. The second embodiment is different from the first embodiment in that the passage valve 30 is omitted and the structure of the valve units 21 are changed. Thus, like or the same reference numerals are given to those components that are like or the same as the corresponding components of the first embodiment.

Figure 14:
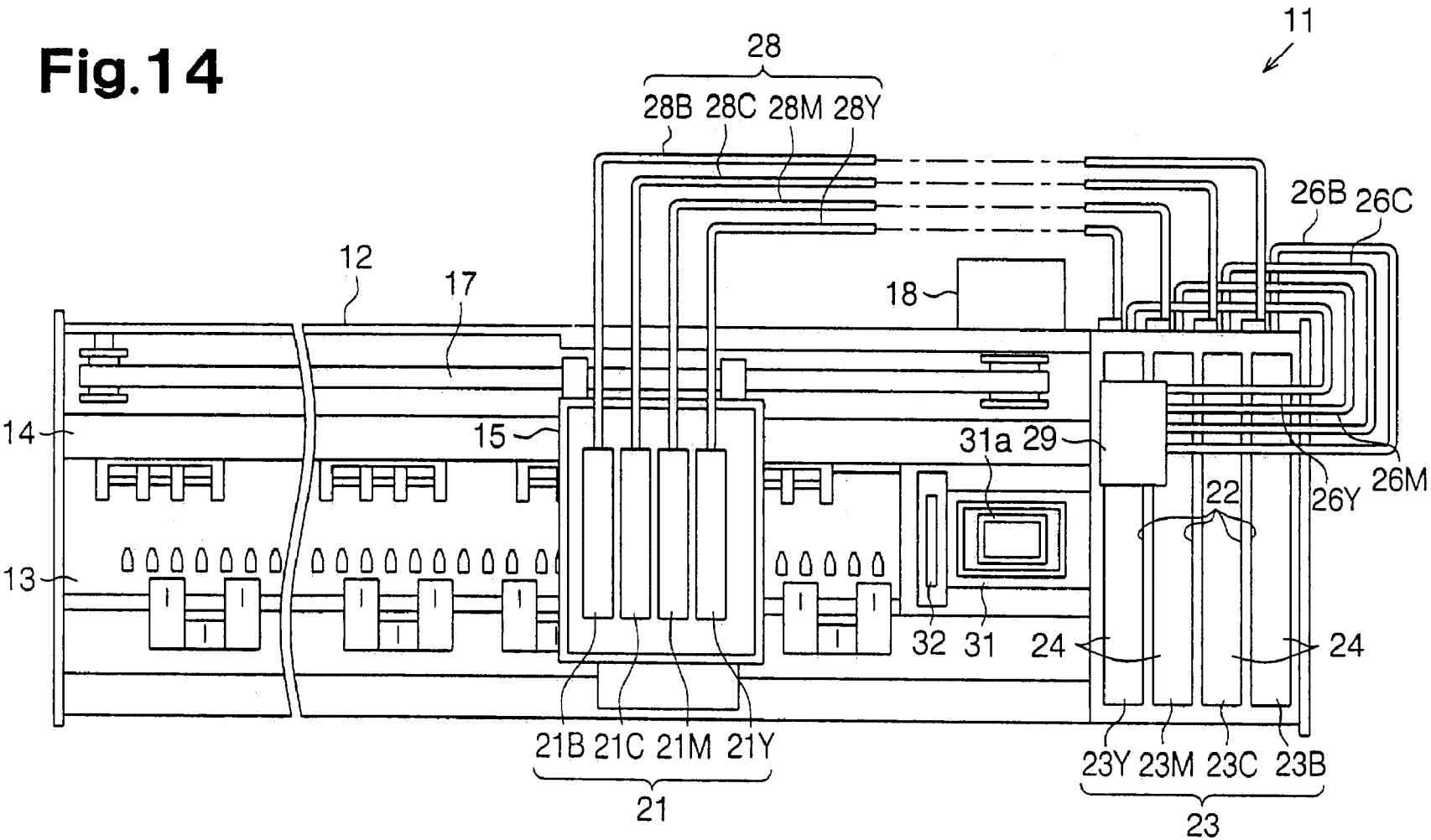
FIG. 14 is a plan view showing an inkjet printer according to a second embodiment.

In the first embodiment, the passage valve 30 is located on the supply tubes 28 at a position upstream of the valve unit 21. As shown in FIG. 14, the passage valve 30 is not provided in the second embodiment.

Figure 15:
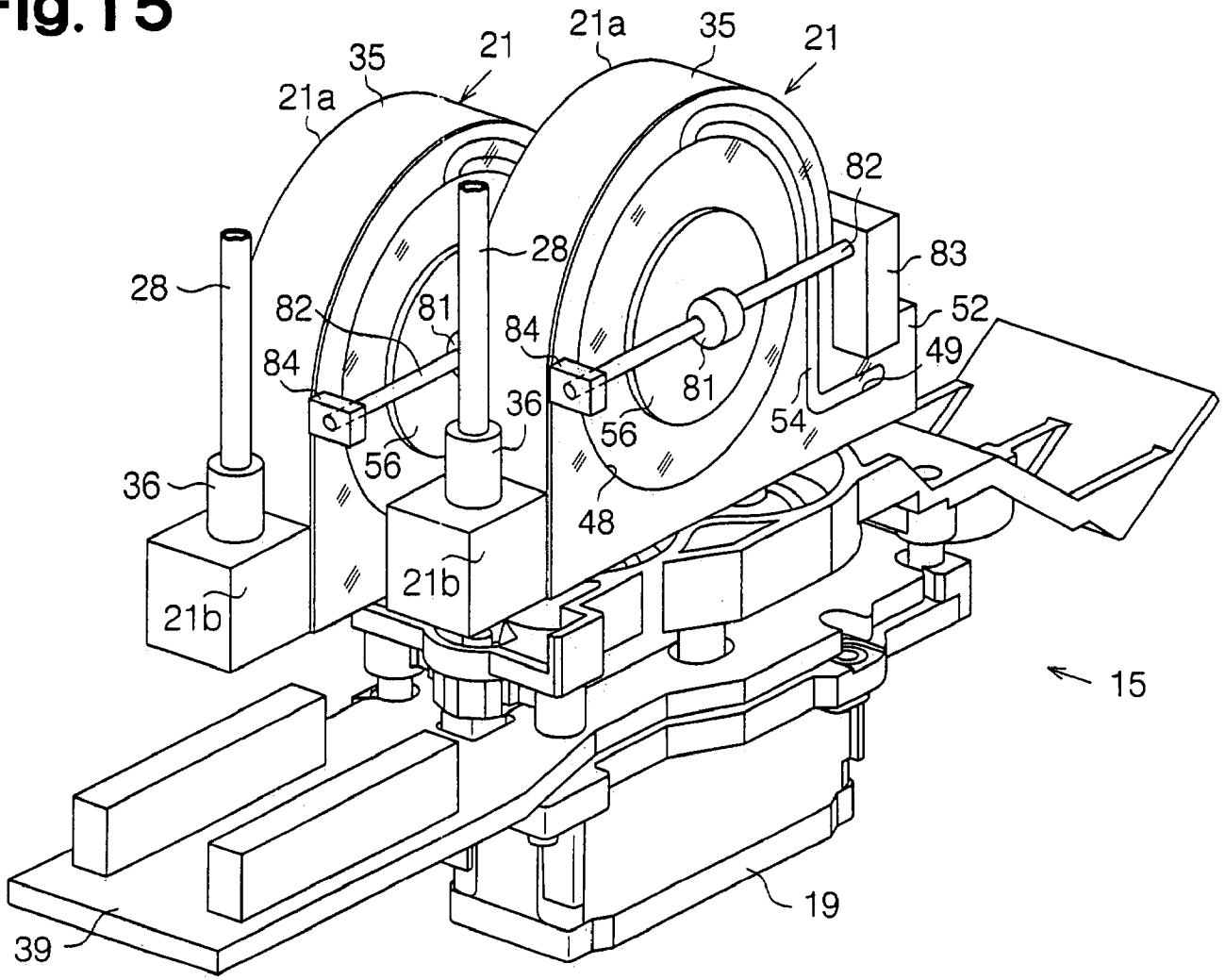
FIG. 15 is a left perspective view illustrating the recording head and valve units of the printer shown in FIG. 14.
Figure 16:
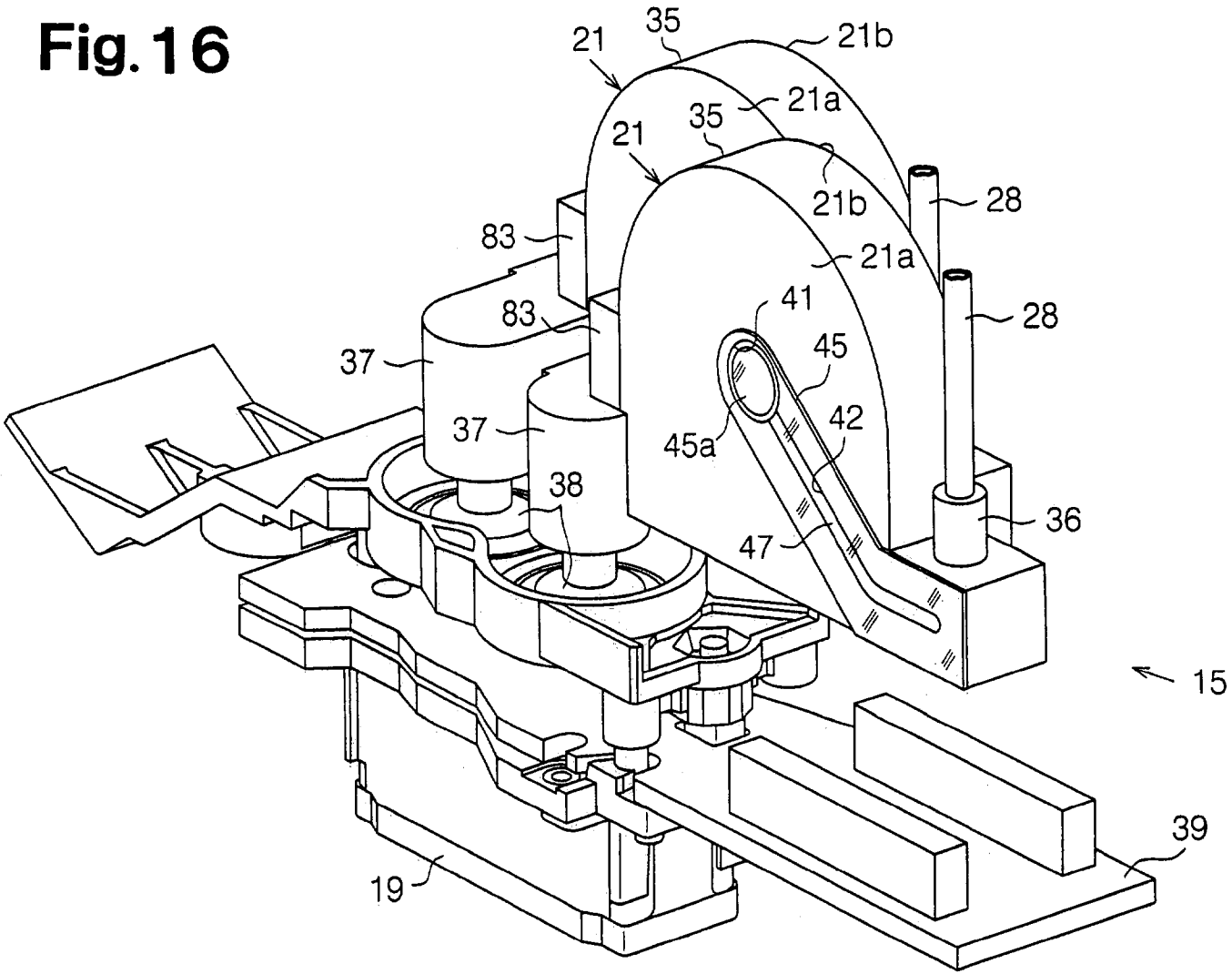
FIG. 16 is a right perspective view of the recording head and the valve units.
Figure 17:
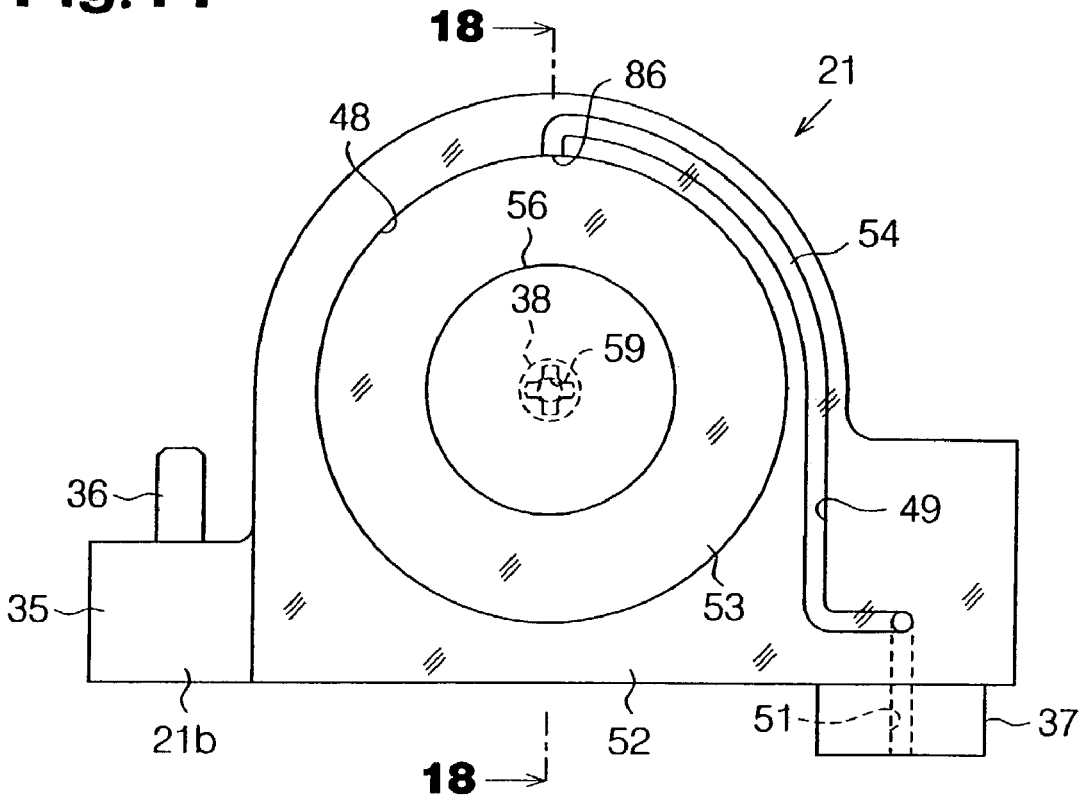
FIG. 17 is a left side view showing the valve unit.

FIGS. 15 and 16 are perspective views illustrating a recording head 19 and valve units 21 of the second embodiment. In addition to the components of the valve unit of the first embodiment, the valve unit 21 of the second embodiment includes drive means, which is a first pressing eccentric cam 81.

Specifically, as shown in FIG. 15, the first pressing eccentric cam 81 is located at a side of the unit case 35 of each valve unit 21. In other words, the first pressing eccentric cam 81 faces the pressing plate 56 attached to the corresponding second film member 52. As discussed below, each pressing eccentric cam 81 is eccentrically attached to a drive rod 82, which extends horizontally and rotates. As shown in FIGS. 15 and 16, a drive unit 83 for rotating the drive rod 82 is located at the rear portion of each unit case 35. As shown in FIG. 15, a rod support 84 is attached to the front portion of each unit case 35 to rotatably support the corresponding drive rod 82.

Each first pressing eccentric cam 81 is rotated by the corresponding drive rod 82 to press a side of the pressure receiving plate 56 toward the unit case 35. The second film member 52 is displaced in the same direction. This forcibly opens the valve body 61, which is located in the valve unit 21, and ink that receives positive pressure is sent to the recording head 19. In this embodiment, the flow rate adjusting means includes the first pressing eccentric cams 81, the pressure receiving plates 56, the second film members 52, the valve body 61, and the ink channels 59*b*.

The valve unit 21 of the first embodiment is constructed such that the outlet of the pressure chamber 53 connected to the ink discharging channel 54 is located at a relatively lower part of the pressure chamber 53. However, in this embodiment, an outlet 86 is located at the topmost position in the gravitational direction. An arcuate ink discharging channel 54 is formed along the large recess 48 defining the pressure chamber 53. The ink discharging channel 54 is communicated with the outlet 86 of the pressure chamber 53. Therefore, in this embodiment, the outlet 86 of the pressure chamber 53, which extends from the pressure chamber 53 to the recording head 19, is located at the topmost position in the gravitational direction. Thus, for example, when the inkjet printer 11 is charged with ink for the first time, ink is charged without air (bubbles) remaining in the pressure chamber 53.

In other words, if air exists in the pressure chamber 53, the volume of bubbles changes according to the ambient temperature, which changes the internal pressure of the pressure chamber 53. As a result, an increased internal pressure may cause ink to leak from the recording head 19. On the other hand, a decreased internal pressure may cause air to be drawn through the nozzles of the recording head 19. Thus, providing the outlet 86 of the pressure chamber 53, which extends from the pressure chamber 53 to the recording head, at the topmost location in the gravitational direction is imperative to the valve units 21.

The above is a description of the structure of the inkjet printer 11 according to this embodiment. In the inkjet printer 11 according to this embodiment, the operation of the valve units 21 when ink is used at the recording head 19 is the same as the first embodiment. Therefore, the description is omitted. In this embodiment, only the operation of the first pressing eccentric cam 81, which forcibly open the valve body 61 located at the valve units 21, will be described.

Figure 18B:
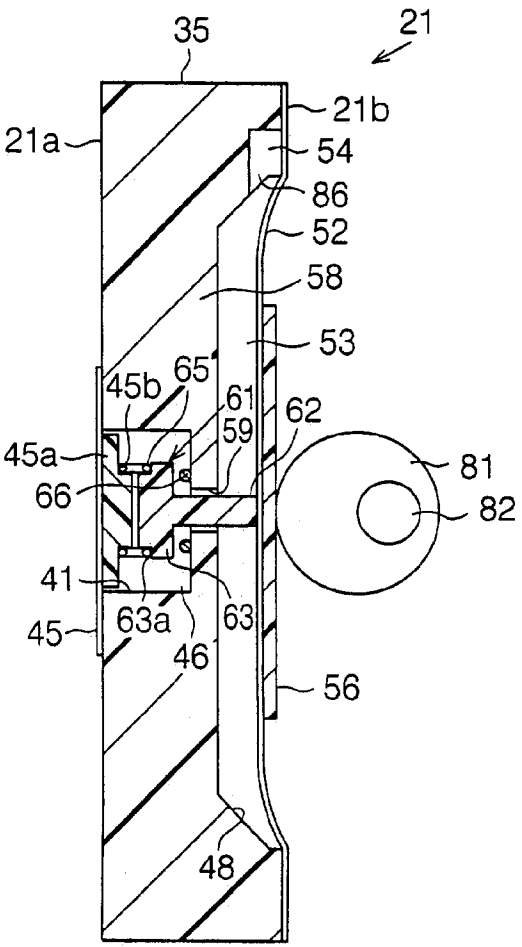
FIG. 18(*a*) is a cross-sectional view taken along line 18-18 of FIG. 17, showing a closed state of the valve unit.
Figure 18A:
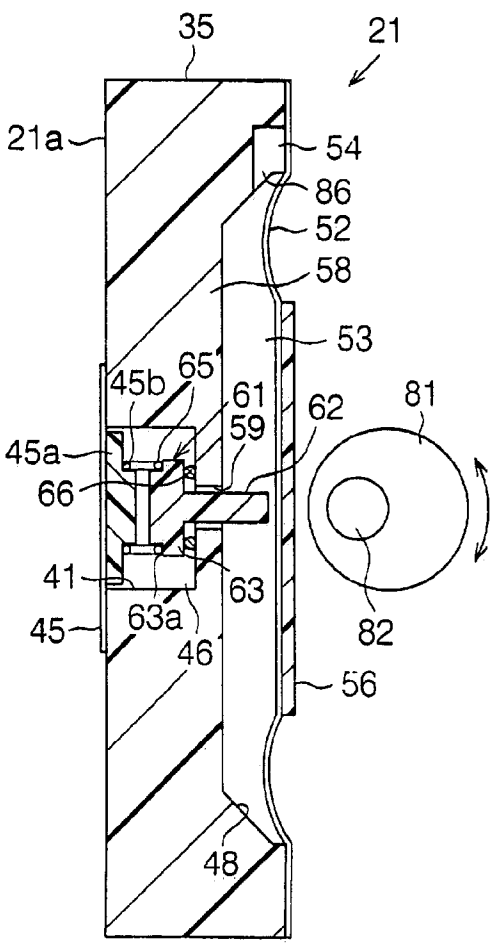
Figure 19:
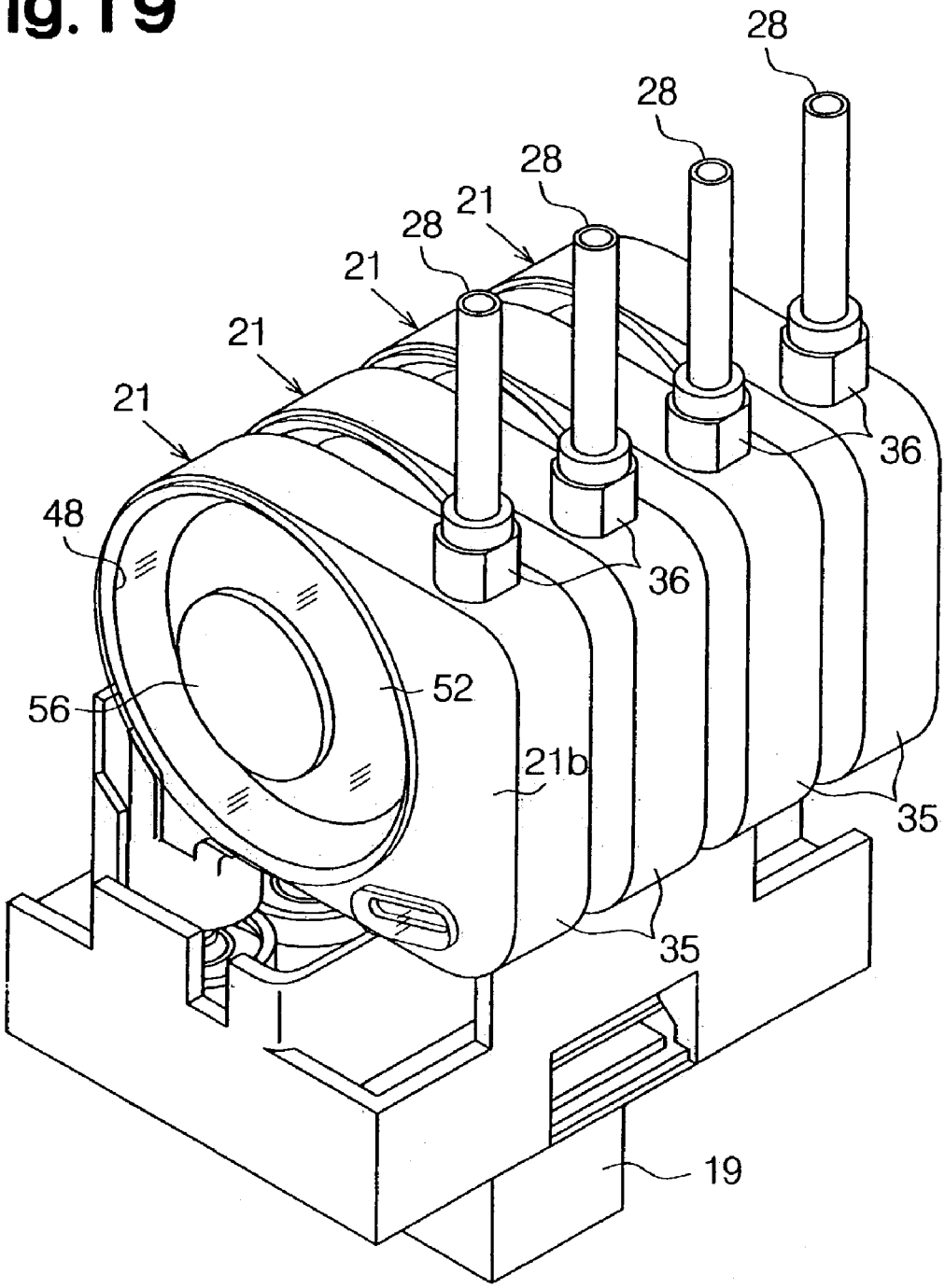
FIG. 19 is a left perspective view illustrating a recording head and valve units according to a third embodiment.

As already described referring to FIG. 15, the first pressing eccentric cam 81 is used as drive means for forcibly opening the valve body 61 located at the valve unit 21. Each first pressing eccentric cam 81 is rotated with the corresponding drive rod 82 and presses the pressure receiving plate 56 against the unit case 35. FIG. 18(*a*) illustrates a state of the valve unit 21 in which the first pressing eccentric cam 81 is not operating, or a state in which the valve unit 21 functions as a self-closing valve. FIG. 18(*b*) illustrates a state in which the first pressing eccentric cam 81 operates to forcibly open the valve body 61, which functions as an open/close valve.

When the first pressing eccentric cam 81 operates to forcibly open the valve body 61 as shown in FIG. 18(*b*), ink supplied by the ink cartridge 23 in a positive pressure is supplied to the recording head 19 through the pressure chamber 53. As a result, ink flows through the ink channel in the recording head 19 and injected from the nozzle opening. Accordingly, clogging of the recording head 19 is eliminated and ink of an increased viscosity is drained.

In this manner, the valve unit 21 located upstream of the recording head 19 forcibly open the valve body 61 to perform cleaning. Compared to a case where ink is sucked and discharged by means of the capping means 31, less negative pressure remains in the recording head 19. Therefore, bubbles are not drawn into the nozzle openings after a cleaning operation. This improves the reliability of the cleaning operation and eliminates a problem that a cleaning operation degrades printing. Further, the suction pump 31*b* for creating negative pressure by means of the capping means 31 is not necessary.

In this embodiment, the first pressing eccentric cam 81 is used as the drive means for forcibly opening the valve body 61 of the valve unit 21. The first pressing eccentric cam 81 rotates to move the valve body 61. An electromagnetic plunger or other types of actuators may be used as the drive means.

In addition to the advantages (6)-(13) of the first embodiment, the second embodiment provides the following advantages.

(15) In the second embodiment, the first pressing eccentric cam 81 presses the valve body 61 of the valve unit 21 with the second film member 62 and the pressure receiving plate 56, thereby forcibly moving the valve body 61. Therefore, ink supplied to the ink cartridge in a positive pressure is supplied to the recording head 19. Then, clogging of the recording head 19 is eliminated and a cleaning operation for draining ink of an increased viscosity is executed. Therefore, while maintaining the self-closing function of the valve unit 21, the reliability of the maintenance operation is improved.

(16) In the second embodiment, the outlet 86 of the pressure chamber 53 is located at the topmost position in the gravitational direction. Bubbles in the pressure chamber 53 usually stay at the top portion of the pressure chamber 53. When the pressure chamber 53 is filled with ink, bubbles are readily discharged to the outside from the outlet of the pressure chamber 53 through the recording head 19. Thus, bubbles are efficiently discharged and few bubbles remain in the pressure chamber, which improves the quality of printing.

An inkjet printer according to a third embodiment of the present invention will now be described with reference to FIGS. 19 through 23. The third embodiment is different from the first embodiment in that the passage valve 30 is omitted and the structure of the valve units 21 are changed. Thus, like or the same reference numerals are given to those components that are like or the same as the corresponding components of the first embodiment.

In the first embodiment, the valve units 21 are described referring to a case in which two valve units 21 are located on the recording head 19. In this embodiment, for purposes of illustration, description will be made referring to a recording head 19 for printing different colors with four valve units 21 mounted on the head 19.

In the first embodiment, the passage valve 30 is located on the supply tubes 28 at a position upstream of the valve unit 21. Like the inkjet printer of the second embodiment, the inkjet printer according to the third embodiment does not have the passage valve 30.

Figure 20:
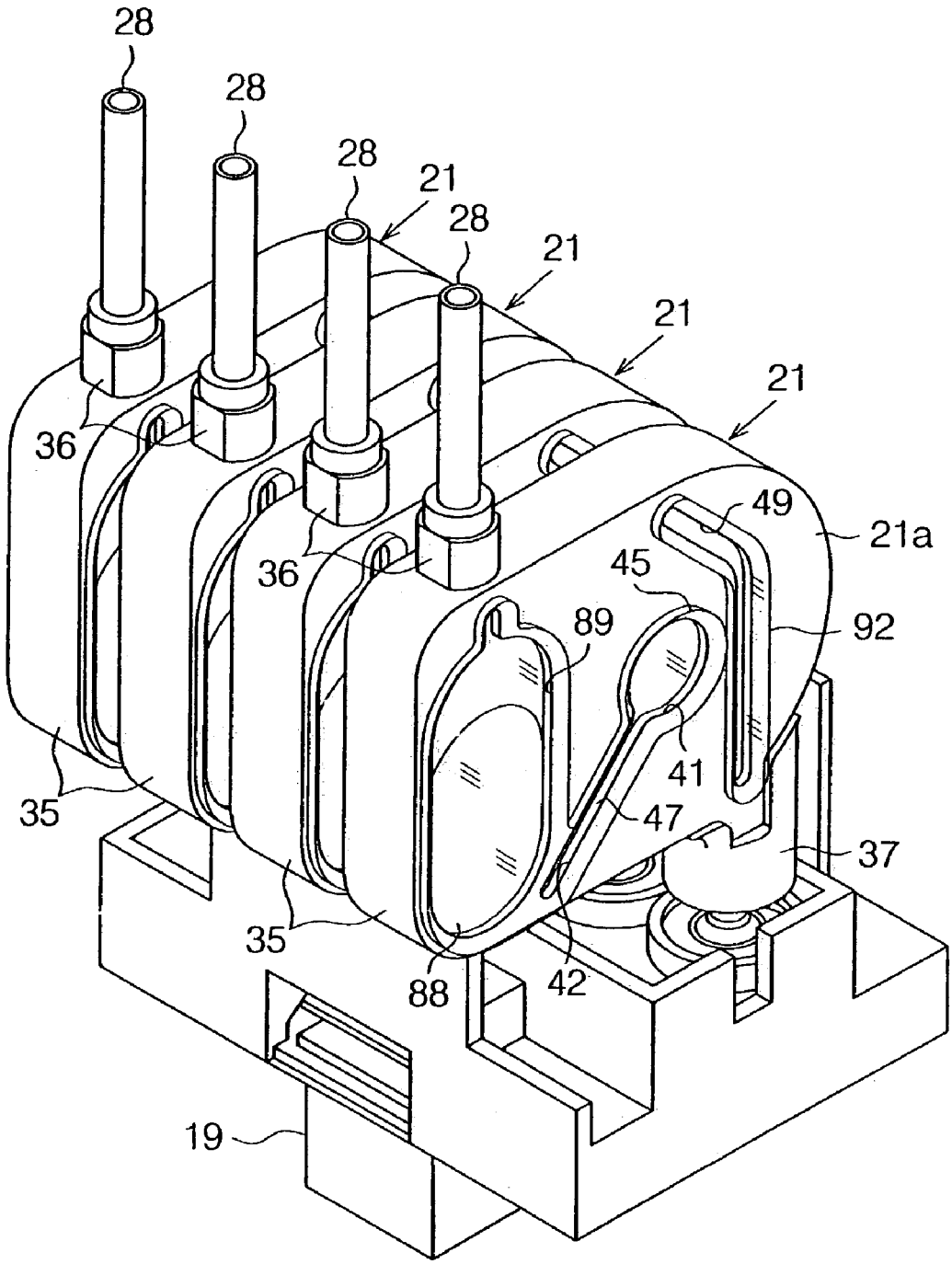
FIG. 20 is a right perspective view of the recording head and the valve units.
Figure 22:
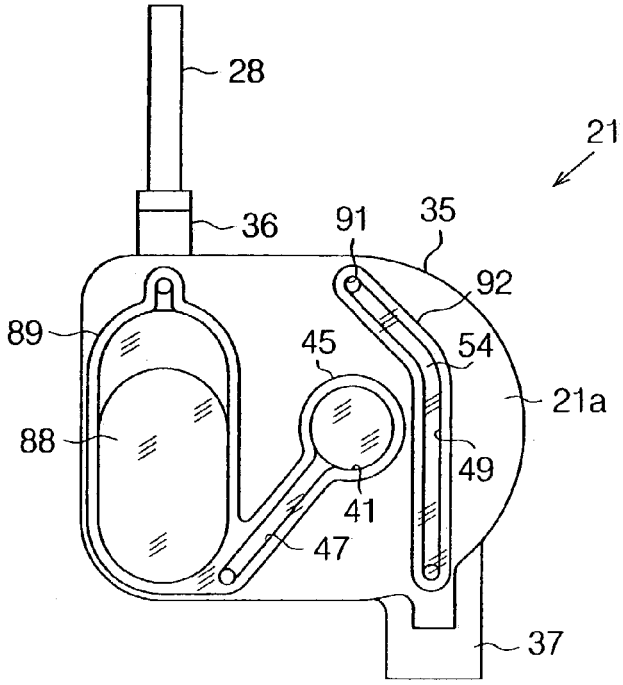
FIG. 22 is a left side view showing the valve unit.

As shown in FIGS. 20 and 22, the unit case 35 of this embodiment has a filter portion 89 that is formed between the connection portion 36 and the ink introducing channel 47. The filter portion 89 accommodates a filter 88. Therefore, ink supplied from the supply tube 28 connected to the connection portion 36 is supplied to the ink supply chamber 46 formed in the substantial center of the unit case 35 through the ink introducing channel 47 and the filter portion 89.

Figure 21:
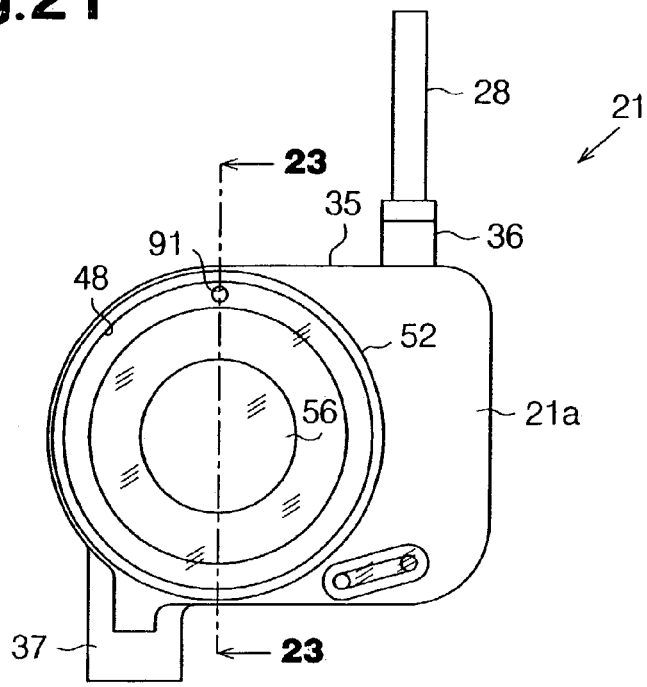
FIG. 21 is a right side view showing the valve unit.
Figure 23B:
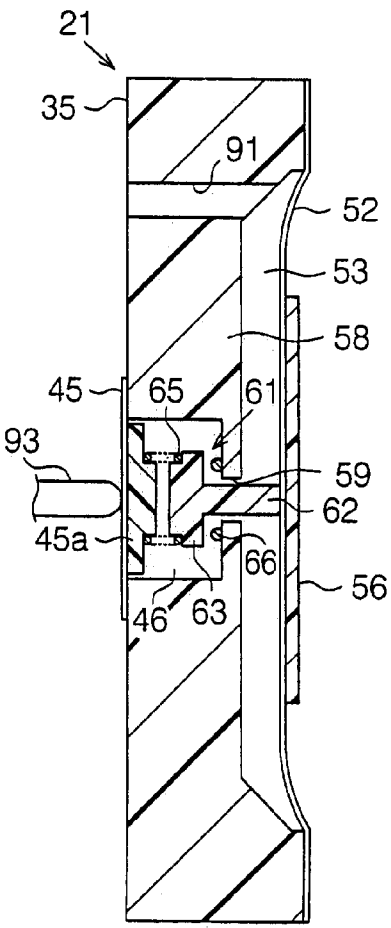
FIG. 23(*a*) is a cross-sectional view taken along line 23-23 of FIG. 21, showing a forcibly closed state of the valve unit.
Figure 23A:
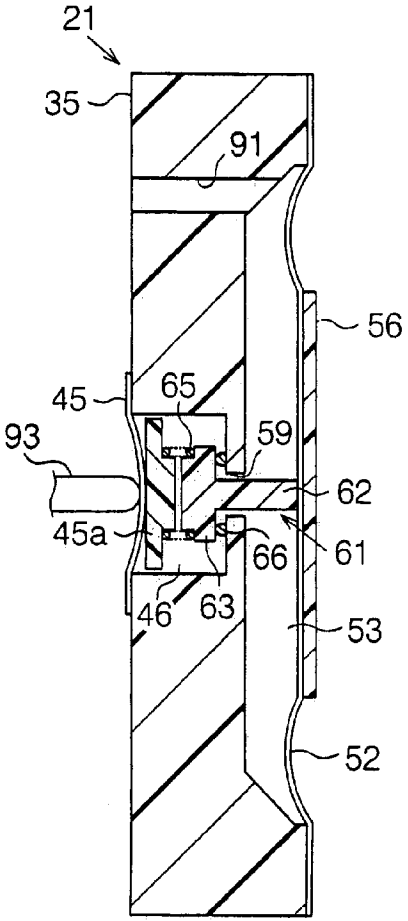

As shown in FIGS. 21 through 23, an ink discharging hole 91 is formed in the inner wall of the pressure chamber 53 to conduct ink out of the pressure chamber 53. When the valve unit 21 is mounted on the recording head 19, the ink discharging hole 91 is located at the topmost position in the pressure chamber 53 in the gravitational direction. In the first embodiment, the ink discharging channel 54 is located at the second side of the unit case 35. In this embodiment, an ink discharging channel 54 is located at the first side 21*a* as shown in FIGS. 20 and 22. The ink discharging channel 54 is communicated with the ink discharging hole 91 of the pressure chamber 53 and is formed as a groove extending from top to bottom of the unit case 35.

Further, in the first embodiment, the ink discharging channel 54 is formed by the second film member 52, which defines the pressure chamber 53. In this embodiment, the ink discharging channel 54 is formed by heat welding a discharging channel film member 92 to the unit case 35.

In this embodiment, a movable member 93 is located outside of the unit case 35 at the side corresponding to the ink supply chamber 46 as shown in FIGS. 23(*a*) and 23(*b*). The movable member 93 is made of a magnetic material and functions as an electromagnetic plunger. The movable member 93 is fitted in and reciprocates along the center of an electromagnet (not shown). The movable member 93 is arranged to press the valve body 61 toward the seal member 66 through the first film member 45 when magnetized by the electromagnet. In this embodiment, the flow rate adjusting means includes the movable member 93, the first film member 45, the valve body 61, and the ink channel 59*b*.

In the inkjet printer 11 according to this embodiment, the operation of the valve units 21 when ink is used at the recording head 19 is the same as the first embodiment. Therefore, the description is omitted.

In this embodiment, the operation of the movable member 93 provided for the valve unit 21 is described.

As shown in FIG. 23(*a*), the movable member 23(*a*) moves toward the first film member 45 to press the first film member 45. Since the pressing force is greater than the spring load W1 of the sealing spring 65, the sealing spring 65 contracts and transmits pressing force to the plate member 63 of the valve body 61. Accordingly, the pressed plate member 63 presses the seal member 66 and closes the valve. In this state, the recording head 19 is capped by the capping member 31*a* located at the non-printing position, and the choke cleaning is performed to suck ink from the nozzle surface of the recording head 19. At this time, ink is sucked from the pressure chamber 53 through the ink discharging channel 54. The section that is downstream of the support hole 59 is under a high negative pressure. In this state, the second film member 52 contacts an end of the rod member 62. However, the pressing force of the movable member 93 is sufficiently greater than the pressing force of the second film member 52 and the urging force of the sealing spring 65. Therefore, the valve body 61 is not separated from the seal member 66 by the pressing force applied by the second film member 52 and the sealing spring 65.

As a result, bubbles at a section downstream of the support hole 59 are inflated and increases the volume when subjected to high negative pressure. Particularly, when exposed to a high negative pressure, bubbles in the pressure chamber 53 are inflated and float to the upper portion of the pressure chamber 53.

The suction of the suction pump 31*b* is terminated when a section downstream of the support hole 59, or the pressure chamber 53 and a section downstream of the pressure chamber 53 are exposed to a high negative pressure. Then, as shown in FIG. 23(*b*), the movable member 93 is separated from the second film member 52 to cancel the pressing force. In this case, the valve body 61 is separated form the seal member 66 by the pressing force of the second film member 52, which has been contacting the rod member 62. Accordingly, the valve is opened. At this time, since the pressure chamber 53 is exposed to a negative pressure, ink in the ink supply chamber 46 rushes into the pressure chamber 53. Since the ink discharging hole 91 of the pressure chamber 53 is located at the topmost position in the gravitational direction, bubbles floated to the upper portion of the pressure chamber 53 are discharged from the ink discharging hole 91 with ink flowing from below. Ink discharged from the ink discharging hole 91 is discharged to the outside of the valve unit 21 through the ink discharging channel 54 and the ink discharging portion 37. Ink in the recording head 19 and bubbling ink in the cap member 31*a* generated by suction operation are discharged.

In addition to the advantages (6)-(14) of the first embodiment and the advantage (16) of the second embodiment, the third embodiment provides the following advantages.

(17) In the third embodiment, the movable member 93 presses the plate member 63 through the first film member 45 of the valve body 61 to forcibly open the valve body 61. Therefore, when performing choke cleaning, the valve body 61 is forcibly closed, and a section downstream of the ink channels 59*b* is exposed to a high negative pressure. Further, since the valve is opened while a high negative pressure is maintained, the amount of ink flowing in is increased, and bubbles in the ink are readily discharged. Also, bubbling ink in the cap member 31*a* generated by suction operation is discharged. The reliability of the cleaning is thus improved.

(18) In the third embodiment, the first film member 45 is provided in the unit cases 35. The first film member 45 is deformed by the pressing force of the movable member 93 and transmits the pressing force of the movable member 93 to the valve body 61.

(19) In the third embodiment, the movable member 93 presses the first film member 45 in the direction along which the valve body 61 is moved, thereby closing the valve. Therefore, the pressing force of the movable body 93 is directly transmitted to the valve body 61, which effectively transmits the pressing force of the movable member 93.

A liquid injecting apparatus according to a fourth embodiment of the present invention will now be described with reference to FIGS. 24(*a*) and 24(*b*). The fourth embodiment is different from the third embodiment in the structure of the drive means. Thus, like or the same reference numerals are given to those components that are like or the same as the corresponding components of the third embodiment.

In this embodiment, an eccentric cam 95 and a cam receiving portion 98 formed on the pressure receiving plate 56 are used as drive means for forcibly closing the fluid channel. As shown in FIGS. 24(*a*) and 24(*b*), the eccentric cam 95 having a rotary shaft 96 and a cam body 97 is provided on a side of the unit case 35 that corresponds to the pressure receiving plate 56. The rotary shaft 96 extends horizontally and fixed to a drive rod and a rod support (neither is shown). The cam body 97 is eccentrically attached to the rotary shaft 96. The eccentric cam 95 faces the pressure receiving plate 56. The cam receiving portion 98 is provided on the pressure receiving plate 56 about the cam body 97.

The cam receiving portion 98 selectively receives pressing force generated by rotation of the eccentric cam 95. When the cam receiving portion 98 receives pressing force from the eccentric cam 95 as shown in FIG. 24(*a*), the pressure receiving plate 56, which is integral with the cam receiving portion 98, and the second film member 52, which is attached to the pressure receiving plate 56, are attracted away from the ink supply chamber 46. When the cam receiving portion 98 does not receive pressing force from the eccentric cam 95 as shown in FIG. 24(*b*), the second film member 52 and the pressure receiving plate 56 approach the ink supply chamber 46.

Figure 24B:
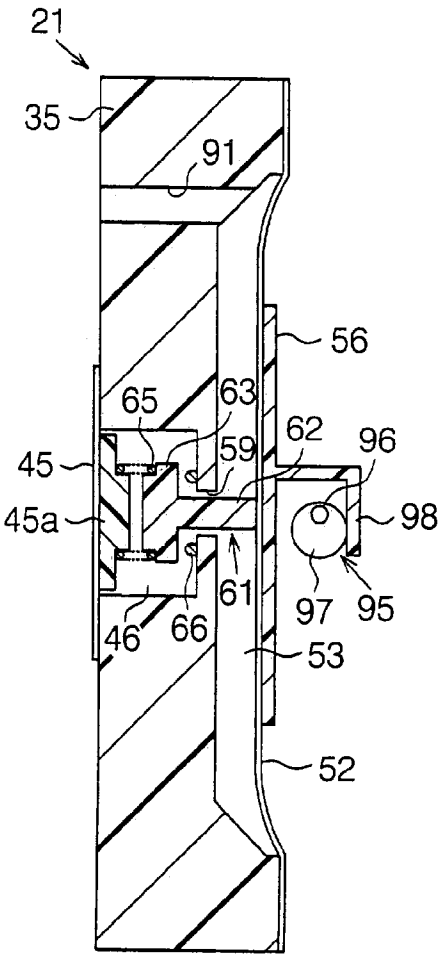
FIG. 24(*a*) is a cross-sectional view of a valve unit according to a fourth embodiment, showing a forcibly closed stat of the valve unit.
Figure 24A:
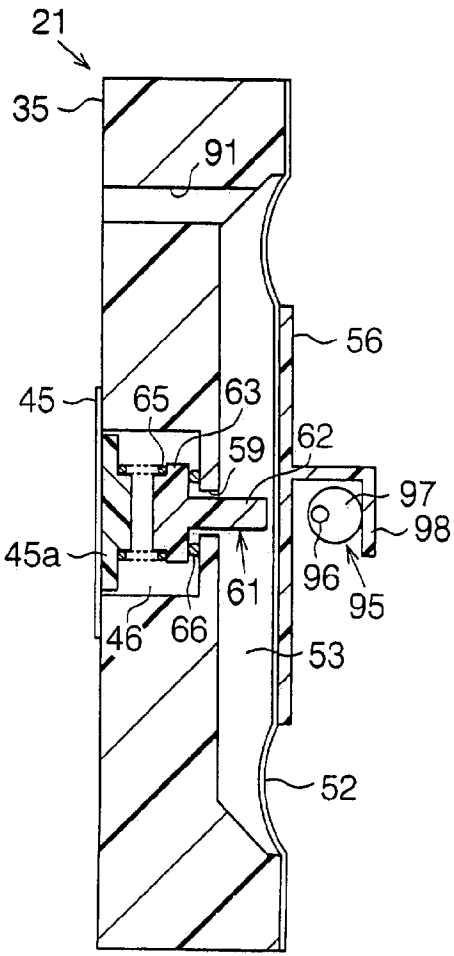

Therefore, when the cam receiving portion 98 receives pressing force from the eccentric cam 95 as shown in FIG. 24(*a*), the force is transmitted to the second film member 52 and the pressure receiving plate 56, and the second film member 52 is moved away from the valve body 61. At this time, since the valve body 61 contacts the seal member 66 due to the force of the sealing spring 65 and the ink pressure in the ink supply chamber 46, the passage is closed. In this state, if ink is conducted out of the pressure chamber 53 through the ink discharging hole 91, the pressure chamber 53 is in a high negative pressure.

Under this high negative pressure, bubbles in the pressure chamber 53 are inflated and increase the volume. The bubbles can be easily discharged. In this state, if the eccentric cam 95 is further rotated while suction of the suction pump 31*b* is continued, the pressing force applied to the cam receiving portion 98 is canceled. This cancels the force applied to the pressure receiving plate 56 and the second film member 52. Then, the second film member 52 displaced into the pressure chamber 53 and the rod member 62 of the valve body 61, thereby separating the plate member 63 from the seal member 66. The channel is thus opened. Accordingly, the suction force of the suction pump 31*b* and the negative pressure in the pressure chamber 53 causes ink to rush into the pressure chamber 53. Bubbles in the pressure chamber 53 is discharged from the ink discharging hole 91, which is located in the upper portion.

In this embodiment, the flow rate adjusting means includes the suction eccentric cam 95, the cam receiving portion 98 formed on the pressure receiving plate 56, the valve body 61, and the ink channels 59*b*.

Therefore, in addition to the advantages (6)-(13) of the first embodiment and the advantage (16) of the second embodiment, the fourth embodiment has the following advantages.

(20) In the fourth embodiment, the drive means for forcibly closing the channel is formed with the eccentric cam 95 and the cam receiving portion 98. Force in a direction opposite to the ink supply chamber 46 is applied to the second film member 52 and the pressure receiving plate 56. Therefore, even if the pressure chamber 53 is exposed to a high negative pressure, the second film member 52 is prevented from contacting the valve body 61. The channel is thus not opened. This improves the reliability of the operation for keeping the channel closed. When performing choke cleaning, the valve can be forcibly closed to create a high negative pressure in a section downstream of the ink channel 59*b*. Further, since the valve is opened while maintaining high negative pressure, the amount of ink flowing in is increased, which permits bubbles in ink to be easily discharged. Also, bubbling ink in the cap member 31*a* generated by suction are drained, which improves the reliability of cleaning.

(21) When performing choke cleaning in the fourth embodiment, the valve unit 21 is opened while the suction pump 31*b* is performing suction. Thus, the valve is opened in a state where the pressure chamber 53 is exposed to negative pressure during the process of suction, which increases the attracting force. Accordingly, ink rushes to the recording head 19.

A liquid injecting apparatus according to a fifth embodiment of the present invention will now be described with reference to FIGS. 25 and 26. The fifth embodiment is different from the first embodiment in the structure of the valve units 21. Thus, like or the same reference numerals are given to those components that are like or the same as the corresponding components of the first embodiment.

Figure 25A:
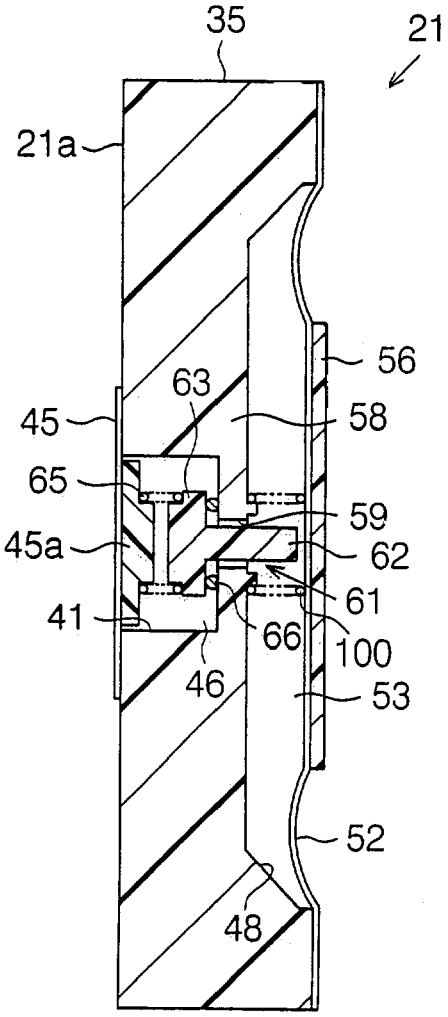
FIG. 25(*a*) is a cross-sectional view of a valve unit of a fifth embodiment, showing a closed state of the valve unit.
Figure 25B:
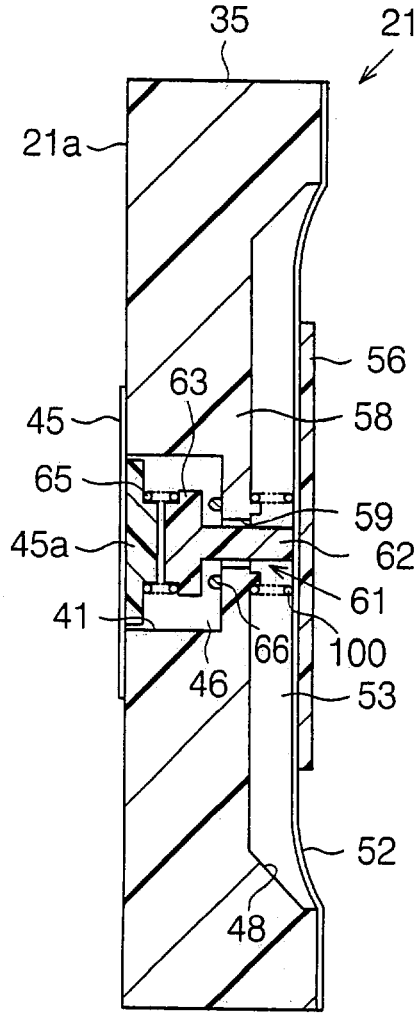

As shown in FIG. 25, the valve unit 21 according to this embodiment has a negative pressure maintaining coil spring 100. The negative pressure maintaining spring 100 is located about the rod member 62, which forms the valve body 61, in the pressure chamber 53. One end of the spring 100 is held by an annular projection formed on the partition 58. The other end of the spring 100 is urged to contact the second film member 62. That is, the negative pressure maintaining spring 100 is arranged to apply its force in a direction along which the pressure receiving plate 56 attached to the second film member 52 is moved, thereby generating force to increase the volume of the pressure chamber 53.

In this embodiment, the diameter of the negative pressure maintaining spring 100 is relatively small and substantially equal to the diameter of the sealing spring 65. Therefore, the negative pressure maintaining spring 100 contacts substantially the center of the pressure receiving plate 56 with the second film member 52 in between.

The operation of the valve unit 21 according to this embodiment will now be described.

FIG. 25(*a*) shows a state in which as the recording head 19 is in the non-printing state, or in a state to use no ink. In this state, spring load W1 of the sealing spring 65 in the valve unit 21 acts on the plate member 63 of the valve body 61 as shown in FIG. 25(*a*). The plate member 63 also receives the pressure load P1 of ink supplied to the ink supply chamber 46. Accordingly, the plate member 63 contacts the seal member 66 to close the valve. That is, the valve unit 21 is in the self-closing state.

On the other hand, when the recording head 19 is in the printing state and uses ink, the second film member 52 is displaced toward the large recess 48 formed in the unit case as the ink in the pressure chamber 53 decreases. The pressure receiving plate 56 attached to the second film member 52 is moved in a direction decreasing the volume of the pressure chamber 53. At this time, the negative pressure maintaining spring 100 contracts and the center portion of the pressure receiving plate 56 contacts one end of the rod member 62, which forms the valve body 61, with the second film member 52 in between.

The load of the negative pressure maintaining spring 100 at this time is referred to as W2, and the reactive force required for displacing the second film member 52 at this time is referred to as Wd. When ink is used by the recording head 19 further, negative pressure P2 is produced in the pressure chamber 53. At this time, if an inequality P2>W1+P1+Wd+W2 is satisfied, the second film member 52 presses the rod member 62, which, in turn, separates the plate member 63 from the sealing member 66. As a result, the valve is opened.

Therefore, the ink in the ink supply chamber 46 is supplied to the pressure chamber 53 through the support hole 59 that extends from the ink supply chamber 46 to the pressure chamber 53. The flow of ink into the pressure chamber 53 cancels the negative pressure in the pressure chamber 53. Accordingly, the valve body 61 is moved to the valve closing position as shown in FIG. 25(*a*), which stops the supply of ink from the ink supply chamber 46 to the pressure chamber 53.

In this embodiment, the actions of the open/close valve of the valve body 61 need not be achieved by repeating the extreme actions shown in FIGS. 25(*a*) and 25(*b*). In a real printing operation, the second film member 52 is in equilibrium contacting the end of the rod member 62, which forms the valve body 61. As ink is used, the second film member 52 gradually opens and successively supplies ink to the pressure chamber 53.

The negative pressure maintaining spring 100 contacts the second film member 52 and presses the pressure receiving plate 56 to increase the volume of the pressure chamber 53. Therefore, even if the pressure receiving plate 56 receives accelerating force or decelerating force by reciprocation of the carriage 15, the pressure receiving plate 56 is not moved. The possibility of erroneous opening and closing actions of the valve body 61 is effectively decreased.

The negative pressure maintaining spring 100 also effectively prevents the lower part of the second film member 52 from bulging outward due to the gravity acting on ink in the pressure chamber 53. That is, since the negative pressure maintaining spring 100 constantly acts to create a negative pressure in the pressure chamber 53, the spring 100 always maintains the pressure receiving plate 56 attached to the second film member 52 to a vertical state. This effectively decreases the possibility of erroneous opening and closing actions of the valve body 61.

Further, when ink is supplied to the pressure chamber 53, the negative pressure maintaining spring 100 expands and maintains negative pressure in the pressure chamber 53, which suppresses pressure fluctuations in the pressure chamber 53. Accordingly, reliable injection of ink droplets from the recording head is ensured.

Additionally, according to this embodiment, negative pressure is created in the pressure chamber 53 by the spring load of the negative pressure maintaining spring 100 and the sealing spring 65. In other words, the spring load is divided by the negative pressure maintaining spring 100 and the sealing spring 65. Therefore, the load of the sealing spring 65, which causes the valve body 61 to contact the sealing member 66 when closing the valve, can be reduced.

Therefore, the contact pressure of elastomer resin applied to the sealing member 66 can be reduced, which prevents the sealing member 66 from being abnormally deformed. Also, since no improper spring load is applied to the sealing member 66, impurity such as fat contained in elastomer resin forming the sealing member 66 does not contaminate ink.

On the other hand, the measurements are preferably determined such that the negative pressure maintaining spring 100 can further contract when the valve body 61 is moved maximally as the volume of the pressure chamber is decreased. FIG. 26 illustrates such an example. The substantially center of the valve unit 21 is shown in an enlarged view. FIG. 26 shows a state in which the negative pressure maintaining spring 100 is maximally deformed (contracts) as the volume of the pressure chamber 53 is decreased.

Figure 26:
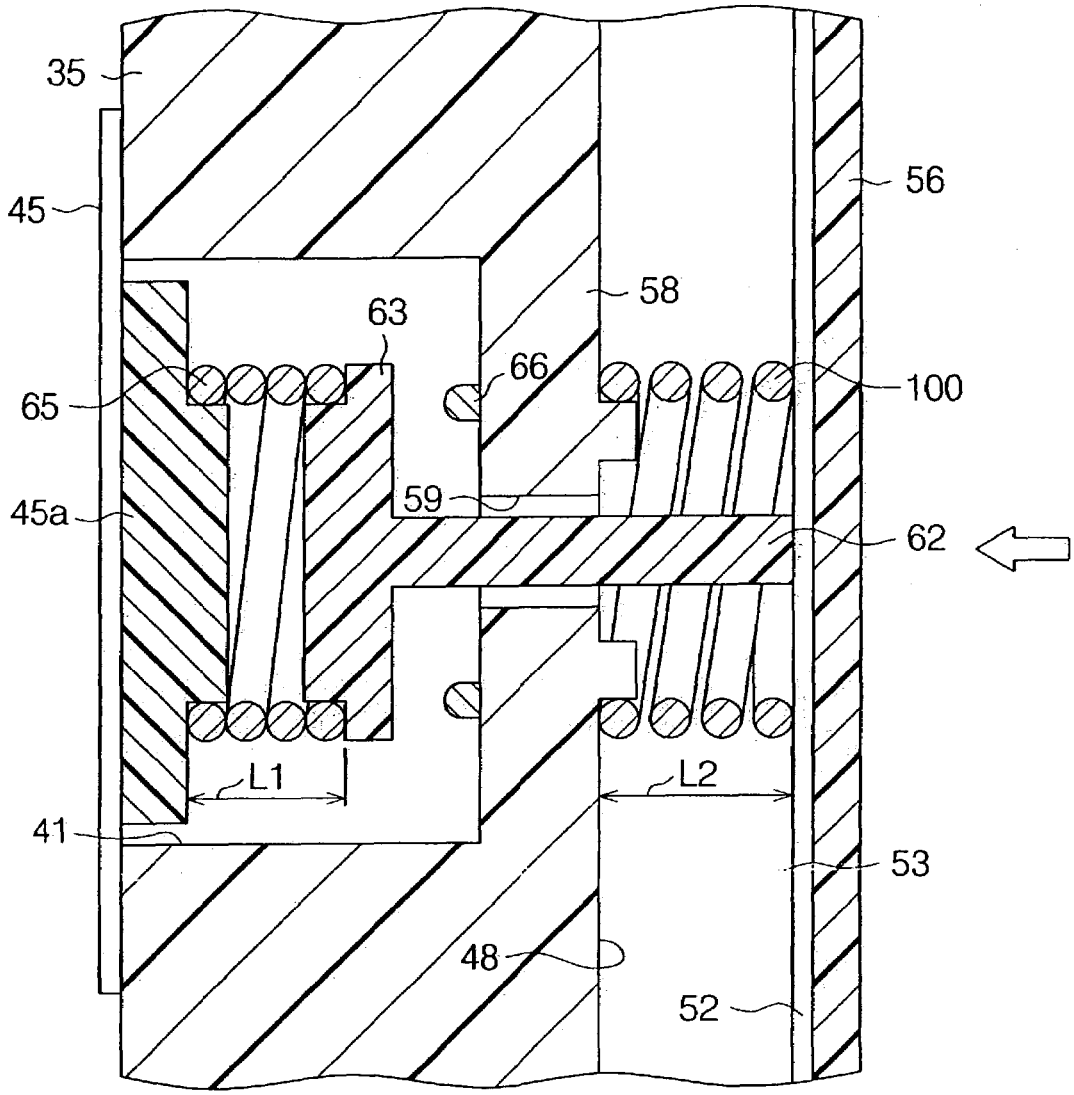
FIG. 26 is an enlarged cross-sectional view showing the relationship between a negative pressure maintaining spring and a valve body.

As shown in FIG. 26, the length of the sealing spring 65 when the valve body 61 is moved maximally, or the fully contracting length, is represented by L1. The length of the negative pressure maintaining spring 100 in this state is represented by L2. That is, when the sealing spring 65 fully contracts, the negative pressure maintaining spring 100 does not fully contract. In other words, if the sealing spring 65 and the negative pressure maintaining spring 100 are formed using springs under the same standard, an inequality L1<L2 is satisfied. Ink flows into the pressure chamber 53 through spaces in the negative pressure maintaining spring 100. Therefore, if there is no spaces in the negative pressure maintaining spring 100, the ink channel is blocked and no ink would be supplied to the pressure chamber 53. Thus, this problem is eliminated by satisfying the inequality L1<L2.

For example, in the pressurized ink supply system shown in FIG. 1, ink can be supplied to the pressure chamber 53 by slightly opening the valve body 61. Thus, the measurement shown in FIG. 26 is not necessarily required. However, in the system of FIG. 2, which uses pressure head to supply ink, the supplying pressure of ink is relatively low. Thus, the valve body 61 is maintained open widely. Therefore, it is important that the minimum length of the negative pressure maintaining spring 100 is sufficient for the stroke of the valve body 61.

As the first embodiment, the present invention has the passage valve 30 (see FIG. 3), and the passage valve 30 is opened and closed in the same manner as the first embodiment. Accordingly, the filling factor of the pressure chamber 53 of the valve unit 21 is improved. Since the operation of the passage valve 30 is the same as that of the first embodiment, the description is omitted.

In addition to the advantages of the first embodiment, the fifth embodiment provides the following advantages.

(22) In the fifth embodiment, the negative pressure maintaining spring 100 contacts the second film member 52 to press the pressure receiving plate 56 in the moving direction, thereby expanding the volume of the pressure chamber 53. Therefore, even if the pressure receiving plate 56 is slightly accelerated or decelerated by reciprocation of the carriage 15, the movement of the pressure receiving plate 56 is suppressed. This effectively lowers the possibility of erroneous opening and closing actions of the valve body 61.

(23) According to the fifth embodiment, the negative pressure maintaining spring 100 effectively prevents the second film member 52 from bulging outward in the lower portion of the pressure chamber 53 where ink receives gravity. That is, the negative pressure maintaining spring 100 always maintains a negative pressure in the pressure chamber 53. This always holds the pressure receiving plate 56 attached to the second film member 52 vertical. Thus, the possibility of erroneous opening and closing actions of the valve body 61 is effectively lowered.

(24) According to the fifth embodiment, when ink is supplied to the pressure chamber 53, the negative pressure maintaining spring 100 expands and maintains a slight negative pressure in the pressure chamber 53. This reduces pressure fluctuations in the pressure chamber 53. This ensures that ink droplets are reliably injected from the recording head 19.

(25) According to the fifth embodiment, negative pressure is created in the pressure chamber 53 by applying the spring load of the negative pressure maintaining spring 100 and the sealing spring 65. In other words, the spring load is divided by the negative pressure maintaining spring 100 and the sealing spring 65. Therefore, the load of the sealing spring 65, which presses the valve body 61 against the sealing member 66 when the valve is closed, can be reduced. As a result, the contact pressure of elastomer resin applied to the sealing member 66 can be reduced, which prevents the sealing member 66 from being abnormally deformed. Also, since no improper spring load is applied to the sealing member 66, impurity such as fat contained in elastomer resin forming the sealing member 66 does not contaminate ink.

(26) In the fifth embodiment, the negative pressure maintaining spring 100 is configured such that the spring 100 can further contract when the valve unit 21 detects a negative pressure due to a decrease of ink and is maximally opened. Therefore, when the valve unit 21 is maximally opened, the negative pressure maintaining spring 100 can further contract, ink passes through the spaces in the negative pressure maintaining spring 100. As a result, the supply of ink is not hindered.

(27) In the fifth embodiment, the negative pressure maintaining spring 100 is a coil spring, and this coil spring is arranged to contact the center portion of the pressure receiving plate 56. In other words, the second film member 52 is urged by a simply constructed coil spring.

Figure 27:
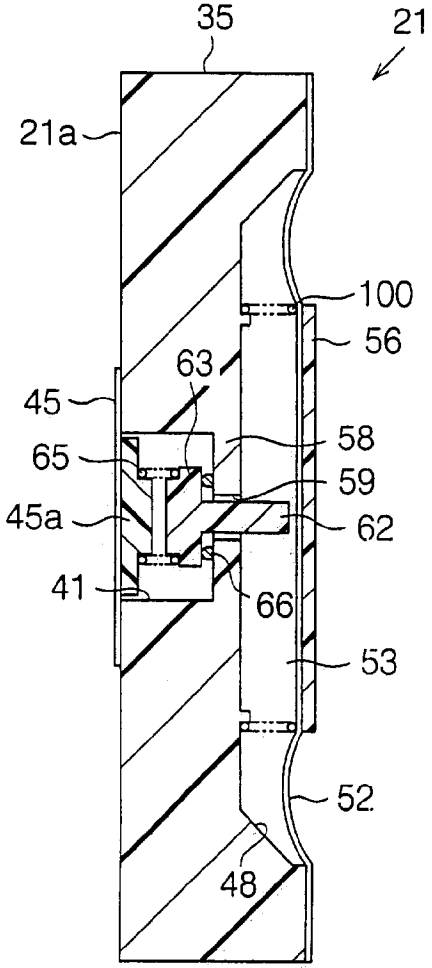
FIG. 27 is a cross-sectional view showing a valve unit according to a sixth embodiment.

A liquid injecting apparatus according to a sixth embodiment of the present invention will now be described with reference to FIG. 27. The sixth embodiment is different from the fifth embodiment in the structure of the negative pressure maintaining spring 100. Thus, like or the same reference numerals are given to those components that are like or the same as the corresponding components of the fifth embodiment. As shown in FIG. 27, a coil spring that is similar to that of the fifth embodiment is used as a negative pressure maintaining spring 100 in this embodiment. The diameter of the coil is greater than that of the spring shown in FIG. 25. Therefore, the negative pressure maintaining spring 100 contacts the peripheral portion of the disk shaped pressure receiving plate 56 with the second film member 52 in between.

The pressure receiving plate 56 contacts the negative pressure maintaining spring 100 at the peripheral portion. Thus, even if ink receives gravity and bulges the second film member 52 at the lower portion of the pressure chamber 53, the pressure receiving plate 56 is always maintained vertical. This effectively lowers the possibility of erroneous opening and closing actions of the valve body 61.

Therefore, in addition to the advantages (1) through (14) of the first embodiment and the advantages (22) through (26) of the fifth embodiment, the sixth embodiment provides the following advantages.

(28) In the sixth embodiment, the negative pressure maintaining spring 100 is a coil spring, and this coil spring is arranged to contact the peripheral portion of the pressure receiving plate 56. Therefore, the second film member 52 is stably urged, and erroneous operations of the valve body 61, which successively supplies ink to the pressure chamber 53, are effectively suppressed.

Figure 28:
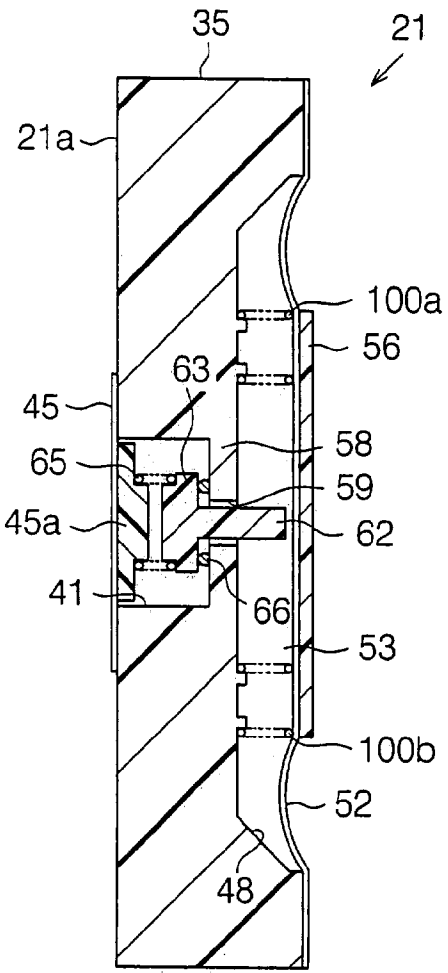
FIG. 28 is a cross-sectional view showing a valve unit according to a seventh embodiment.

An ink injecting apparatus according to a seventh embodiment of the present invention will now be described with reference to FIG. 28. The seventh embodiment is different from the fifth embodiment in the structure of the negative pressure maintaining spring 100. Thus, like or the same reference numerals are given to those components that are like or the same as the corresponding components of the fifth embodiment.

Like the fifth embodiment, coil springs are used as negative pressure maintaining spring in this embodiment. However, in this embodiment, a plurality of small diameter negative pressure maintaining springs 100*a*, 100*b* are used. The negative pressure maintaining springs 100*a*, 100*b* each contact a peripheral portion of the disk shaped pressure receiving plate 56. Thus, even if ink receives gravity and bulges the second film member 52 at the lower portion of the pressure chamber 53, the pressure receiving plate 56 is always maintained vertical. This effectively lowers the possibility of erroneous opening and closing actions of the valve body 61.

Although the two negative pressure maintaining springs 100*a*, 100*b* are used in this embodiment, three or more springs may be used as negative pressure maintaining springs. Therefore, when the number of the coils springs is represented by n, the spring load of each coil spring needs to be W2/n, in which the total spring load of all the negative pressure maintaining springs is W2.

Therefore, in addition to the advantages (1) through (14) of the first embodiment and the advantages (22) through (26) of the fifth embodiment, the seventh embodiment provides the following advantages.

(29) In the seventh embodiment, the negative pressure maintaining spring 100 includes a plurality of coil springs, and each coil spring is arranged to contact a peripheral portion of the pressure receiving plate 56. Therefore, the entire second film member 52 is stably urged, and erroneous operations of the valve body 61, which successively supplies ink to the pressure chamber 53, are effectively suppressed.

A liquid injecting apparatus according to an eighth embodiment of the present invention will now be described with reference to FIGS. 29(*a*) and 29(*b*). The eighth embodiment is different from the fifth embodiment in the structure of the negative pressure maintaining spring 100. Thus, like or the same reference numerals are given to those components that are like or the same as the corresponding components of the fifth embodiment.

Figure 29A:
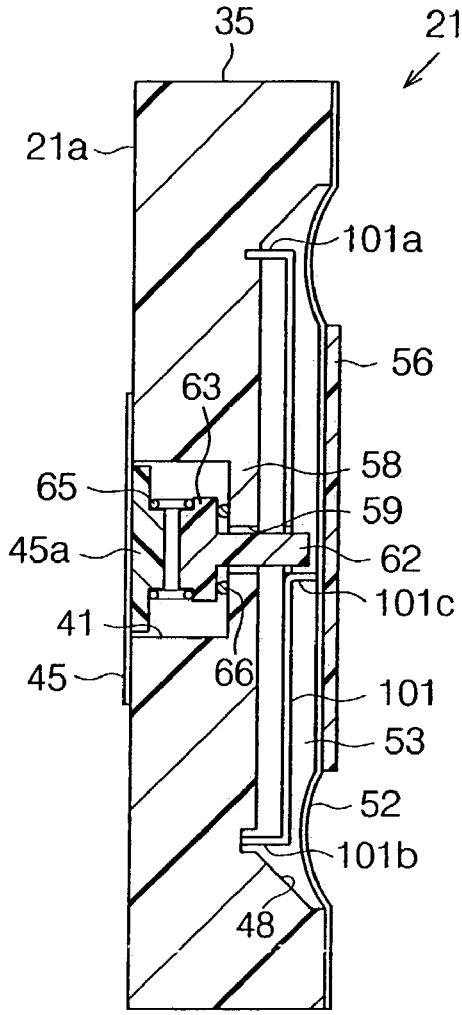
FIG. 29(*a*) is a cross-sectional view showing a valve unit according to an eighth embodiment.
Figure 29B:
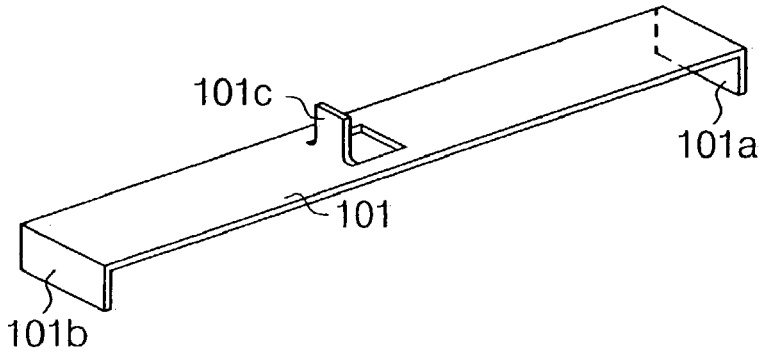

As shown in FIG. 29(*a*), a leaf spring 101 is used as the negative pressure maintaining spring in this embodiment. The leaf spring 101 is bent at the ends in the same direction as shown in FIG. 29(*b*) and has a pair of end portions. In this embodiment, the end portions are legs 101*a*, 101*b*. A projection 101*c* is formed in a central portion of the leaf spring 101. The projection 101*c* is formed by cutting a section of the spring 101 and bending it in the direction opposite to the direction in which the legs 101*a*, 101*b* are bent.

As shown in FIG. 29(*a*), the leg 101*a* of the leaf spring 101 is fixed to the unit case 35 in the pressure chamber 53. The rod member 62 is inserted in the hole formed by forming the projection 101*c*. The distal end of the projection 101*c* contacts substantially the center of the pressure receiving plate 56 with the second film member 52 in between.

The leaf spring 101 applies a force in a direction increasing the pressure chamber 53. For example, even if the spring 101 is accelerated or decelerated by reciprocation of the carriage, erroneous operations of the open/close valve are effectively suppressed.

Therefore, in addition to the advantages (1) through (14) of the first embodiment and the advantages (22) through (26) of the fifth embodiment, the eighth embodiment provides the following advantages.

(30) In the eighth embodiment, the negative pressure maintaining spring is the leaf spring 101. The legs 101*a*, 101*b* of the leaf spring 101 are supported. A central portion contacts the substantially the center of the pressure receiving plate 56. In other words, the second film member 52 is urged by the simply constructed leaf spring 101.

A liquid injecting apparatus according to a ninth embodiment of the present invention will now be described with reference to FIGS. 30 through 32. The ninth embodiment is different from the first embodiment in the structure of the valve unit 21. Thus, like or the same reference numerals are given to those components that are like or the same as the corresponding components of the first embodiment.

Figure 30:
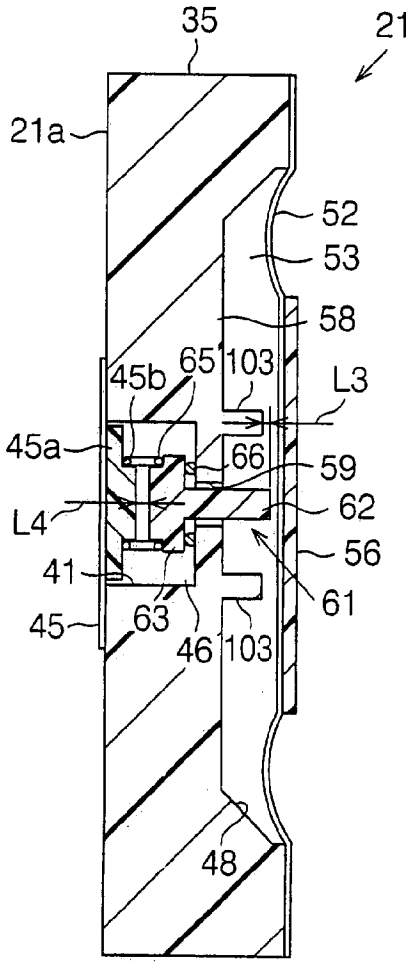
FIG. 30 is a cross-sectional view showing a valve unit according to a ninth embodiment.
Figure 31:
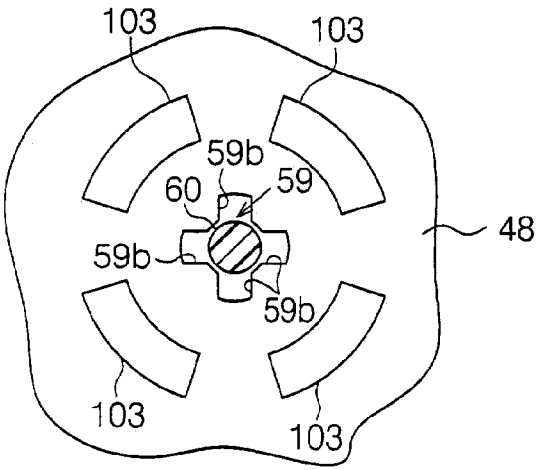
FIG. 31 is a partial enlarged cross-sectional view showing the valve unit of FIG. 30.

As shown in FIGS. 30 and 31, the valve unit 21 of this embodiment has four restriction members, which are projections 103, in the pressure chamber 53. Specifically, the projections 103 project from the partition 58 of the valve unit 21 toward the pressure chamber 53 along the main scanning direction. As shown in FIG. 31, the projections 103 is formed by making equally spaced notches in an annular member that surrounds the support hole 59.

When the valve body 61 contacts the sealing member 66 as shown in FIG. 30, or when the valve is opened, distance between the end of each projection 103 closer to the pressure receiving plate 56 and the end of the end of the valve body 61 closer to the pressure receiving plate 56 is represented by L3. The distance between the spring seat 45*a* and the valve body 61 is represented by L4. The length of each projection 103 in the main scanning direction is determined such that an inequality L3<L4 is satisfied.

In this embodiment, the projections 103 are integrally formed with the unit case 35 of the valve unit 21. However, the projections 103 may be formed by two-color molding elastomer resin with the partition 58. The projections 103 may be formed with rubber and then attached to the partition 58.

The operation of the valve unit 21 of this embodiment will now be described.

When the recording head 19 is in the non-printing state, or in a state to use no ink, spring load W1 of the sealing spring 65 of the valve unit 21 acts on the plate member 63 of the valve body 61 as shown in FIG. 30. The plate member 63 also receives the pressure load P1 of the ink supplied to the ink supply chamber 46. Accordingly, the plate member 63 contacts the sealing member 66 to close the valve. That is, the valve unit 21 is in a self-closing state.

On the other hand, when the recording head 19 is in the printing state and uses ink, the second film member 52 is displaced toward the large recess 48 formed in the unit case 35 as the pressure in the pressure chamber 53 decreases. The pressure receiving plate 56 attached to the second film member 52 is moved in a direction decreasing the volume of the pressure chamber 53. At this time, center portion of the pressure receiving plate 56 contacts the end of the rod member 62 with the second film member 52 in between.

The reactive force required for displacing the second film member 52 in this state is referred to as Wd. When ink is used by the recording head 19 further, negative pressure P2 is produced in the pressure chamber 53. If the inequality P2>W1+P1+Wd is satisfied, the second film member 52 is moved toward the rod member 62 and presses rod member 62.

As a result, the second film member 52 contacts the projections 103, and the plate member 63 is separated from the sealing member 66, which opens the valve. At this time, since the length of each projection 103 in the main scanning direction is determined such that the inequality L3<L4 is satisfied, the movement of the second film member 52 is restricted, and the plate member 63 of the valve body 61 does not contact the spring seat 45*a*.

That is, the load applied to the second film member 52 when the pressure in the pressure chamber 53 is significantly lowered and the valve body 61 is maximally opened is chiefly applied to the contacting area of the projections 103 and the second film member 52. As a result, the load acting on the valve body 61 is decreased, and the valve body 61 is prevented from being deformed.

Therefore, ink in the ink supply chamber 46 is supplied to the pressure chamber 53 through the support hole 59 extending from the ink supply chamber 46. If the projections 103 are replaced with an annular member surrounding the support hole 59, the ink channel is blocked and the supply of ink cannot be performed. However, as shown in FIG. 31, the projections 103 are formed by making four equally spaced notches in the annular member, ink flows into the pressure chamber 53 through the notches. As a result, ink flowing into the pressure chamber 53 eliminates the negative pressure in the pressure chamber 53. Accordingly, the valve body 61 is moved and the valve is closed as shown in FIG. 30. Then, the supply of ink from the ink supply chamber 46 to the pressure chamber 53 is stopped.

Figure 32:
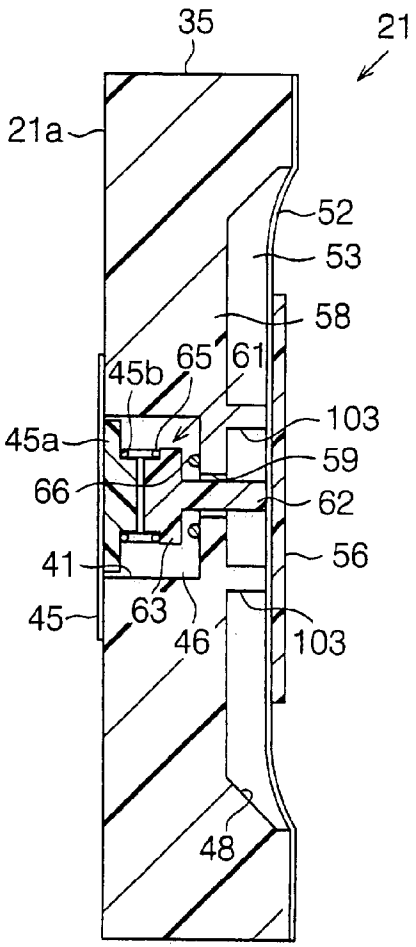
FIG. 32 is a cross-sectional view showing an opened state of the valve unit shown in FIG. 30.

In this embodiment, the valve body 61 is not frequently switched between the state of FIG. 30 and the state of FIG. 32. In a real printing operation, the second film member 52 is in equilibrium contacting the end of the rod member 62, which forms the valve body 61. As ink is used, the second film member 52 gradually opens and successively supplies ink to the pressure chamber 53.

As the first embodiment, the present invention has the passage valve 30 (see FIG. 3), and the passage valve 30 is opened and closed in the same manner as the first embodiment. Accordingly, the filling factor of the pressure chamber 53 of the valve unit 21 is improved. Since the operation of the passage valve 30 is the same as that of the first embodiment, the description is omitted.

In addition to the advantages (1) through (14) of the first embodiment, the ninth embodiment provides the following advantages.

(31) In the ninth embodiment, the projection 103 limits the displacement of the second film member 52 when the second film member 52 presses the valve body 61. This prevents the second film member 52 from excessively pressing the valve body 61. Thus, the valve body 61 is not deformed.

(32) In the ninth embodiment, the length of each projection 103 in the main scanning direction is determined such that an inequality L3<L4 is satisfied. Therefore, the valve body 61 is reliably prevented from contacting the spring seat 45*a* and thus from being deformed.

(33) In the ninth embodiment, the projections 103 are formed by making four equally spaced notches in an annular member. Therefore, if the projections 103 are replaced with an annular member surrounding the support hole 59, the ink channel is blocked and the supply of ink cannot be performed. However, in this embodiment, the projections 103 are formed by making notches, ink flows into the pressure chamber 53 through the notches.

A liquid injecting apparatus according to a tenth embodiment of the present invention will now be described with reference to FIGS. 33 and 34. The ninth embodiment is different from the ninth embodiment in the structure of the valve unit 21. Thus, like or the same reference numerals are given to those components that are like or the same as the corresponding components of the ninth embodiment.

Figure 33:
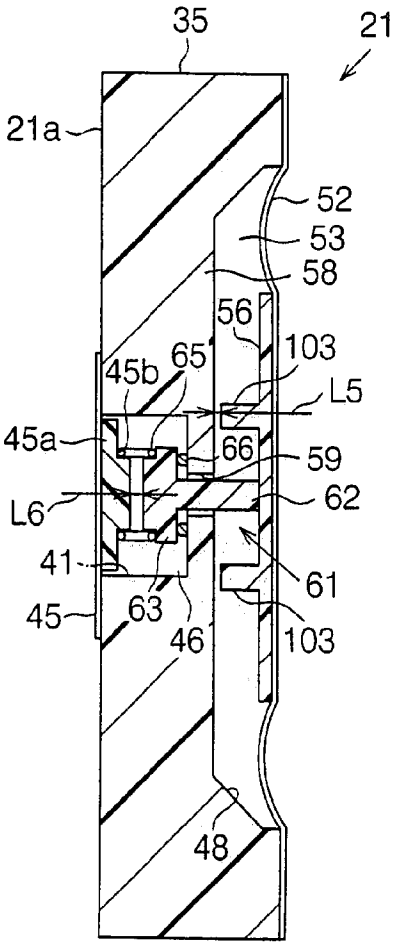
FIG. 33 is a cross-sectional view showing a valve unit according to a tenth embodiment.

As shown in FIG. 33, the pressure receiving plate 56 is attached to a side of the second film member 52 facing the pressure chamber 53. Like the ninth embodiment, there are four projections 103. In this embodiment, the projections 103 project from the side of the pressure receiving plate 56 in the pressure chamber 53 toward the ink supply chamber 46. The projections 103 project in the main scanning direction of the carriage 15.

When the valve body 61 contacts the sealing member 66, or when the valve is opened, the distance between the end of each projection 103 closer to the ink supply chamber 46 and the partition 58 of the unit case 35 is represented by L5. The distance between the spring seat 45*a* and the valve body 61 is represented by L6. The length of each projection 103 in the main scanning direction is determined such that an inequality L5<L6 is satisfied.

In this embodiment, the projections 103 are integrally formed with the pressure receiving plate 56. However, the projections 103 may be formed by two-color molding elastomer resins with the pressure receiving plate 56. The projections 103 may be formed with rubber and then attached to the pressure receiving plate 56.

An operation of the valve unit 21 of this embodiment will now be described.

When the recording head 9 is in the non-printing state, or in a state to use no ink, spring load W1 of the sealing spring 65 of the valve unit 21 acts on the plate member 63 of the valve body 61 as shown in FIG. 33. The plate member 63 also receives the pressure load P1 of the ink supplied to the ink supply chamber 46. Accordingly, the plate member 63 contacts the sealing member 66 to close the valve. That is, the valve unit 21 is in a self-closing state.

Figure 34:
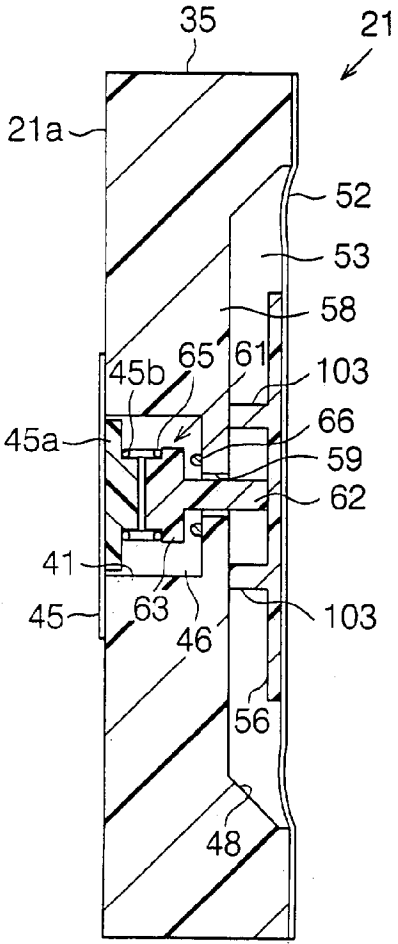
FIG. 34 is a cross-sectional view showing an opened state of the valve unit shown in FIG. 33.

On the other hand, when the recording head 19 is in the printing state and uses ink, the second film member 52 is displaced toward the large recess 48 formed in the unit case 35 as shown in FIG. 34 as the pressure in the pressure chamber 53 decreases. The pressure receiving plate 56 attached to the second film member 52 is moved in a direction decreasing the volume of the pressure chamber 53. At this time, the center portion of the pressure receiving plate 56 contacts the end of the rod member 62 of the valve body 61.

The reactive force required for displacing the second film member 52 at this time is referred to as Wd. When ink is used by the recording head 19 further, negative pressure P2 is produced in the pressure chamber 53. If the inequality P2>W1+P1+Wd is satisfied, the second film member 52 is moved toward the rod member 62 and the pressure receiving plate 56 presses rod member 62.

As a result, the projections 103 of the pressure receiving plate 56 contact the partition 58, and the plate member 63 is separated from the sealing member 66, which opens the valve. At this time, since the length of each projection 103 in the main scanning direction is determined such that the inequality L5<L6 is satisfied, the movement of the pressure receiving plate 56 is restricted, and the plate member 63 of the valve body 61 does not contact the spring seat 45*a*.

That is, the load applied to the second film member 52 when the pressure in the pressure chamber 53 is significantly lowered and the valve body 61 is maximally opened is chiefly applied to the contacting area of the projections 103 and the partition 58. As a result, the load acting on the valve body 61 is decreased, and the valve body 61 is prevented from being deformed.

Therefore, ink in the ink supply chamber 46 is supplied to the pressure chamber 53 through the support hole 59 extending from the ink supply chamber 46. However, the projections 103 are formed by making four equally spaced notches in the annular member, ink flows into the pressure chamber 53 through the notches. As a result, ink flowing into the pressure chamber 53 cancels the negative pressure in the pressure chamber 53. Accordingly, the valve body 61 is moved and the valve is closed as shown in FIG. 33. Then, the supply of ink from the ink supply chamber 46 to the pressure chamber 53 is stopped.

In this embodiment, the actions of the open/close valve of the valve body 61 need not be achieved by repeating the extreme actions shown in FIGS. 33 and 34. In a real printing operation, the pressure receiving plate 56 is in equilibrium contacting the end of the rod member 62, which forms the valve body 61. As ink is used, the second film member 52 gradually opens and successively supplies ink to the pressure chamber 53.

Like the first embodiment, the present invention has the passage valve 30 (see FIG. 3), and the passage valve 30 is opened and closed in the same manner as the first embodiment. Accordingly, the filling factor of the pressure chamber 53 of the valve unit 21 is improved. Since the operation of the passage valve 30 is the same as that of the first embodiment, the description is omitted.

In addition to the advantages (1) through (14) of the first embodiment and the advantage (31) of the ninth embodiment, the tenth embodiment provides the following advantages.

(34) In the tenth embodiment, the length of each projection 103 in the main scanning direction is determined such that an inequality L5<L6 is satisfied. Therefore, the valve body 61 is reliably prevented from contacting the spring seat 45*a* and thus from being deformed.

(35) In the tenth embodiment, the projections 103 are integrally formed with the pressure receiving plate 56. Therefore, the projections 103 are formed by simply changing the structure of the pressure receiving plate 56.

Figure 35:
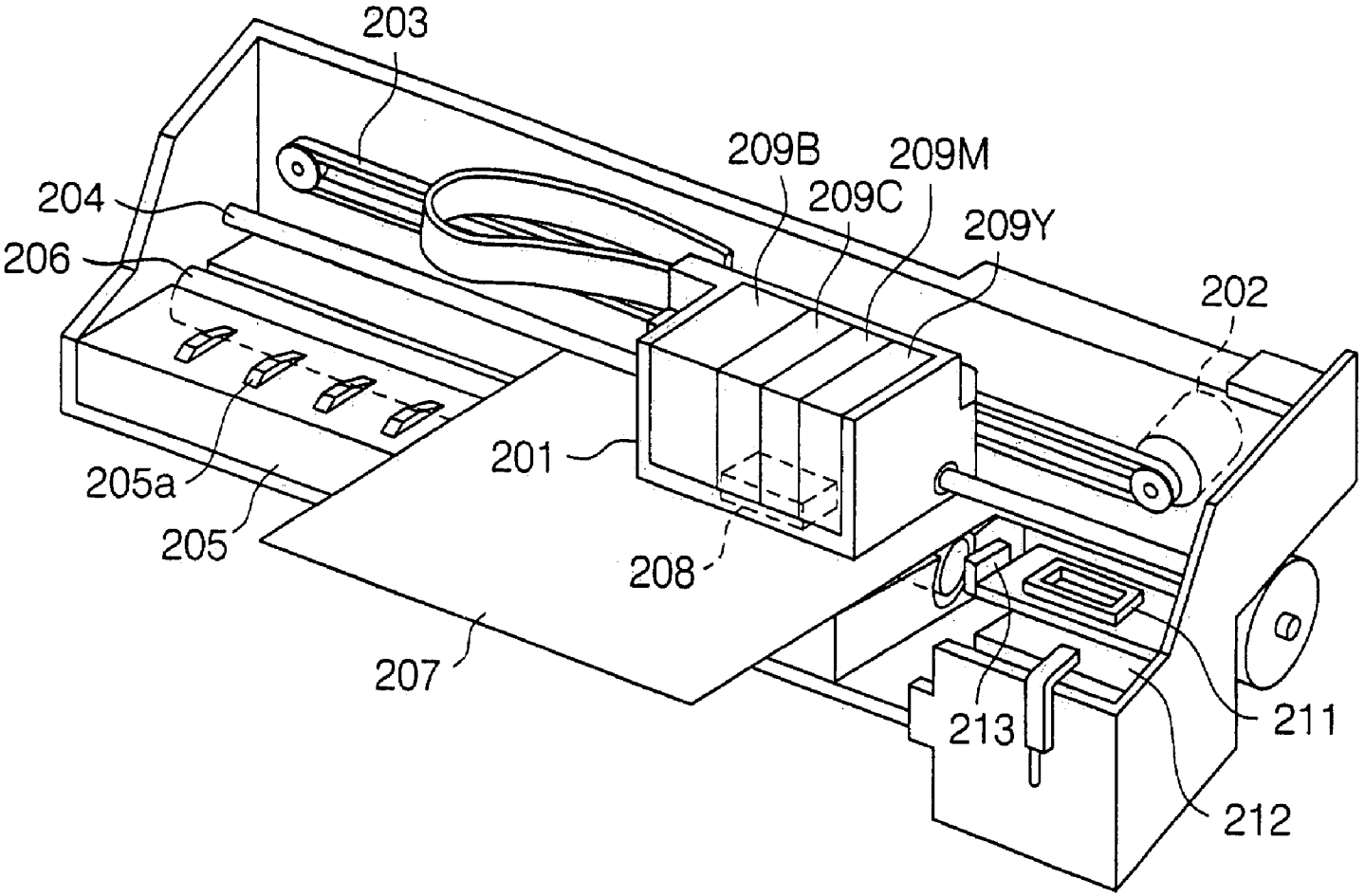
FIG. 35 is a perspective view showing a basic configuration of an inkjet recording device according to an eleventh embodiment of the present invention.

An inkjet recorder using an ink passage valve according to an eleventh embodiment will now be described. As shown in FIG. 35, a carriage 201 is guided by a guiding member 204. The carriage 201 is reciprocated by a timing belt 203 driven by a carriage motor 202 along the longitudinal direction of a paper feeder member 205, or in the main scanning direction.

A feeder roller 206 is provided in the feeder member 205. The feeder roller 206 and a follower roller (not shown) hold recording paper 207. As the feeder roller 206 rotates, the paper 207 is carried in a subscanning direction, which is perpendicular to the main scanning direction. A great number of projections 205*a* are intermittently provided on the upper surface of the paper feeder member 205. The recording paper 207 is carried along the upper surfaces of the projections 205*a*. Accordingly, a predetermined gap is created between a recording head 208 and the recording paper 207. The recording head 208 will be discussed below.

As shown in broking line in FIG. 35, the inkjet recording head 208 is mounted on the lower side of the carriage 201 that faces the recording paper 207. A black ink cartridge 209B and color ink cartridges 209C, 209M, 209Y, which contains cyan ink, magenta ink, and yellow ink, respectively, are detachably mounted on upper side of the carriage 201. The ink cartridges 209B, 209C, 209M, and 209Y are arranged along the main scanning direction.

As shown in FIG. 35, a capping member 211 is located at a non-printing area (home position). When the recording head 208 is directly above the capping member 211, the capping member 211 moves upward and seals the nozzle surface of the recording head, or the lower side of the recording head 208. A suction pump 212 is located below the capping member 211. The suction pump 212 creates negative pressure in the interior of the capping member 211.

During quiescent operation of the recording apparatus, the capping member 211 seals the nozzle surface of the recording head 208 and functions as a lid for preventing ink solvent from evaporating from the nozzle opening. Also, the capping member 211 applies negative pressure created by the suction pump 212 to the recording head 208 to suck ink out of the recording head, thereby maintaining the ink droplet injection function. This is referred to as cleaning operation.

As shown in FIG. 35, a rectangular wiping member 213 is located in a printing area adjacent to the capping member 211. The wiping member 213 is made of an elastic member such as rubber. When the carriage 201 reciprocates on the capping member 211, the wiping member 213 proceeds to the path of the recording head as necessary to wipe and clean the nozzle surface of the recording head 208. This is referred to as wiping operation.

Figure 36:
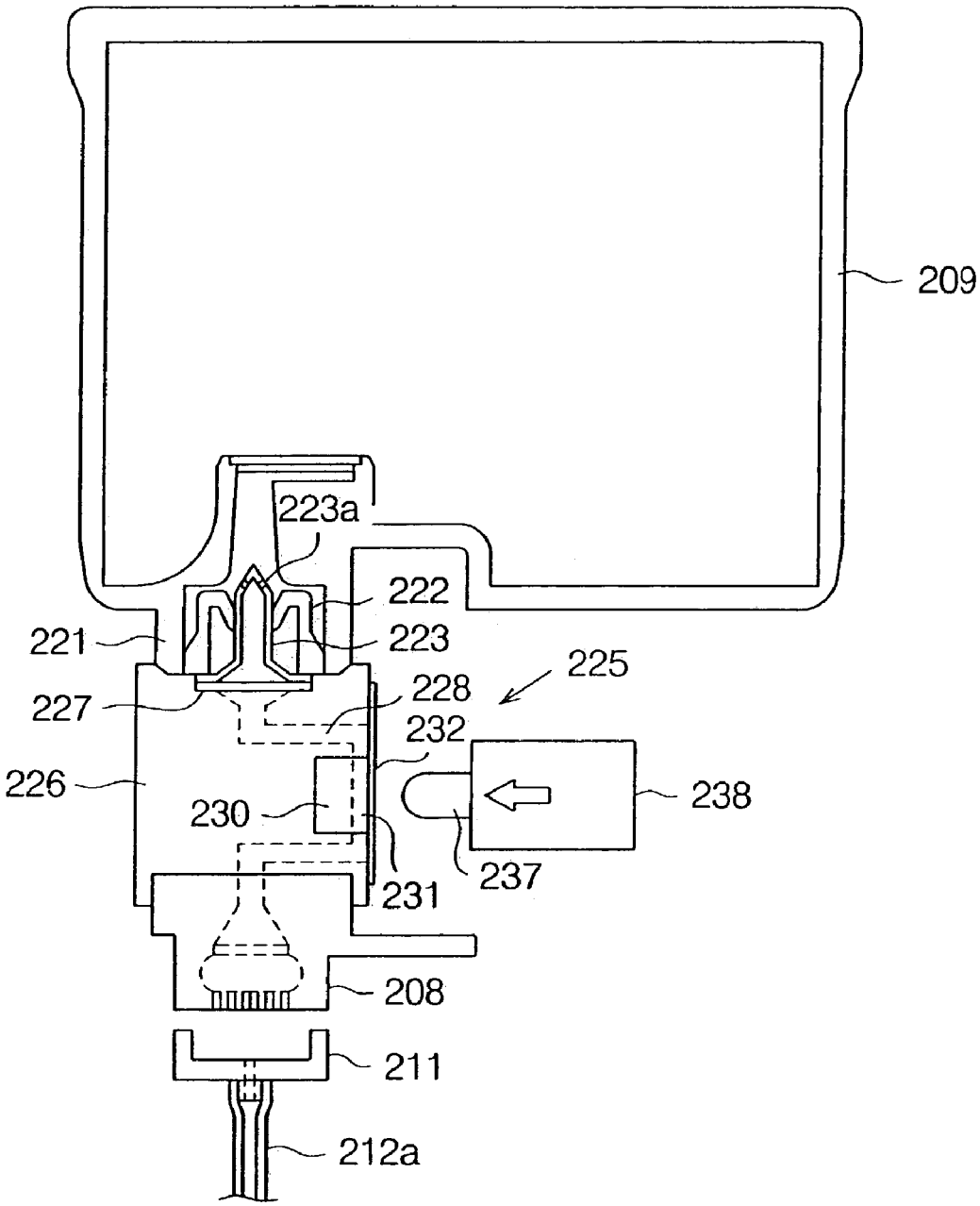
FIG. 36 is a cross-sectional view showing an ink supply path from an ink cartridge to a recording head.

FIG. 36 illustrates an ink passage valve located in an ink channel from an ink cartridge attached to the carriage 201 to the recording head. An ink supply hole 221 is formed in the bottom of an ink cartridge 209 shown in FIG. 36.

A cylindrical rubber packing member 222 is located in the ink supply hole 221. When the ink cartridge 209 is attached to the carriage 201, the packing member 22 is fitted about an hollow ink delivering needle 223, which project upward from the carriage 201. Ink is conducted out of the ink cartridge 209 through an ink discharging hole 223*a* formed in the distal end of the ink delivering needle 223.

In this embodiment, the ink delivering needle 223 is attached to a resin base member 226 forming an ink passage valve 225. A flat filter member 227 is located between the proximal end of the ink delivering needle 223 and the base member 226. An ink channel 228 is defined in the base member 226. The ink channel 228 extends to the recording head 208 via the filter member 227.

An elastic member 230 made of elastomer resin is located at a side of the base member 226. The elastic member 230 is integrally formed with the base member 226 by a two-color molding process. The elastic member 230 and the base member 226 are formed flush.

A groove 231 is formed in the elastic member 230 and the base member 226. A polypropylene film 232 is heat welded to the base member 226 and the elastic member 230 to cover the groove 231. The groove 231 formed on the elastic member 230 and the film member 232 form a control passage. The control passage is represented by numeral 231, which is the same numeral as that of the groove. The ends of the control passage 231 are connected to the ink channel 228 formed in the base member 226.

A control member 237 is arranged to face the film member 232. The control member 237 is supported by an actuator 238 that uses, for example, an electromagnetic plunger. The actuator 238 allows the control member 237 to vertically contact the film member 232. Therefore, when the actuator 238 is driven, the control member 237 contacts the film member 232 and collapses the film member toward the elastic member 230, thereby closing the control passage 231. When electricity to the electromagnetic plunger, which forms the actuator 238, is stopped the control member 237 is retreated as shown in FIG. 36. The elastic member 230 then restores the original shape by its elasticity. This opens the control passage 231 to permit ink to flow therethrough.

Figure 37:
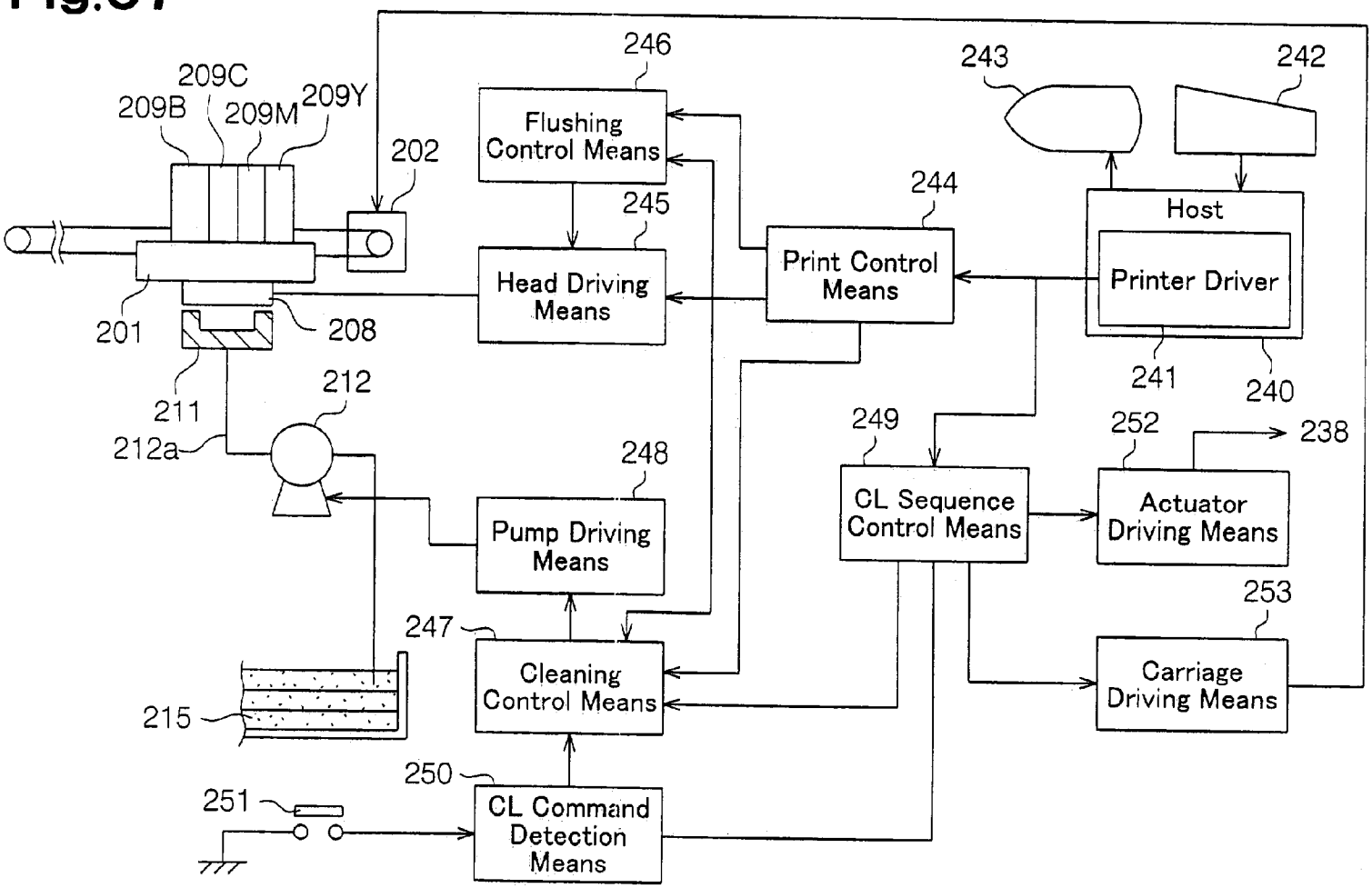
FIG. 37 is a block diagram showing a control circuit that executes a cleaning control.

As shown in FIG. 36, a first end of a tube 212*a*, which is a part of the suction pump (tube pump) 212, is located at the lower side of the capping member 211. The second end of the tube 212*a* is connected to a liquid waste tank 215 as shown in FIG. 37. During the cleaning operation, ink waste discharged to the capping member 211 is discarded to the liquid waste tank 215 through by the tube pump 212.

FIG. 37 is a control circuit loaded on the memory device. Particularly, FIG. 37 shows a cleaning control system for performing maintenance of the ink injecting function of the recording head. A host computer 240 has a printer driver 241. On the utility of the printer driver 241, the size of paper, the selection of black-and-white printing or color printing, the selection of recording mode, data such as the font, and a printing command are inputted.

When the printing command is inputted with the input device 242, the printer driver 241 sends a print data to a printing control device mounted on the recording apparatus. The printing control device 244 generates bitmap data based on the print data sent from the host computer 240. Based on the bitmap data, the printing control device 244 causes the head driving device 245 to generate a drive signal, thereby causing the recording head 208 to inject ink. Other than the drive signal based on the print data, the head driving device 245 receives a flushing command signal from a flushing control device 246. Accordingly, the head driving device 245 outputs a drive signal for flushing operation to the recording head 208.

A pump driving device 248 is started by a command from the cleaning control device 247 shown in FIG. 37, which actuates the suction pump 212. The cleaning control device 247 receives a cleaning command signal from the host computer 240 through the printing control device 244. The cleaning control device 247 receives cleaning command signals from a cleaning sequence control device 249 and a cleaning command detection device 250.

An operational switch 251 is connected to the cleaning command detection device 250. When a user presses the switch 251, the cleaning control device 247 is actuated through the cleaning command detection device 250. Accordingly, a manual cleaning operation is executed. Also, the cleaning control device 247 can be actuated by manipulating the input device 242 of the host computer 240 through the printing control device 244 to execute the manual cleaning operation.

The cleaning sequence control device 249 receives command signals from the host computer 240 and the cleaning command detection device 250 and sends a command signals to the actuator driving device 252 and the carriage driving device 253. The actuator driving device 252 controls electricity to the electromagnetic plunger, which functions as an actuator, thereby driving the control member 237 to selectively opens and closes the ink passage valve 225.

The carriage driving device 253 receives a command from the cleaning sequence control device 249 to drive the carriage motor 202, thereby moving the recording head 208 to a position directly above the capping member 211. The carriage driving device 253 then seals the nozzle surface of the recording head with the capping member 211.

Figure 38:
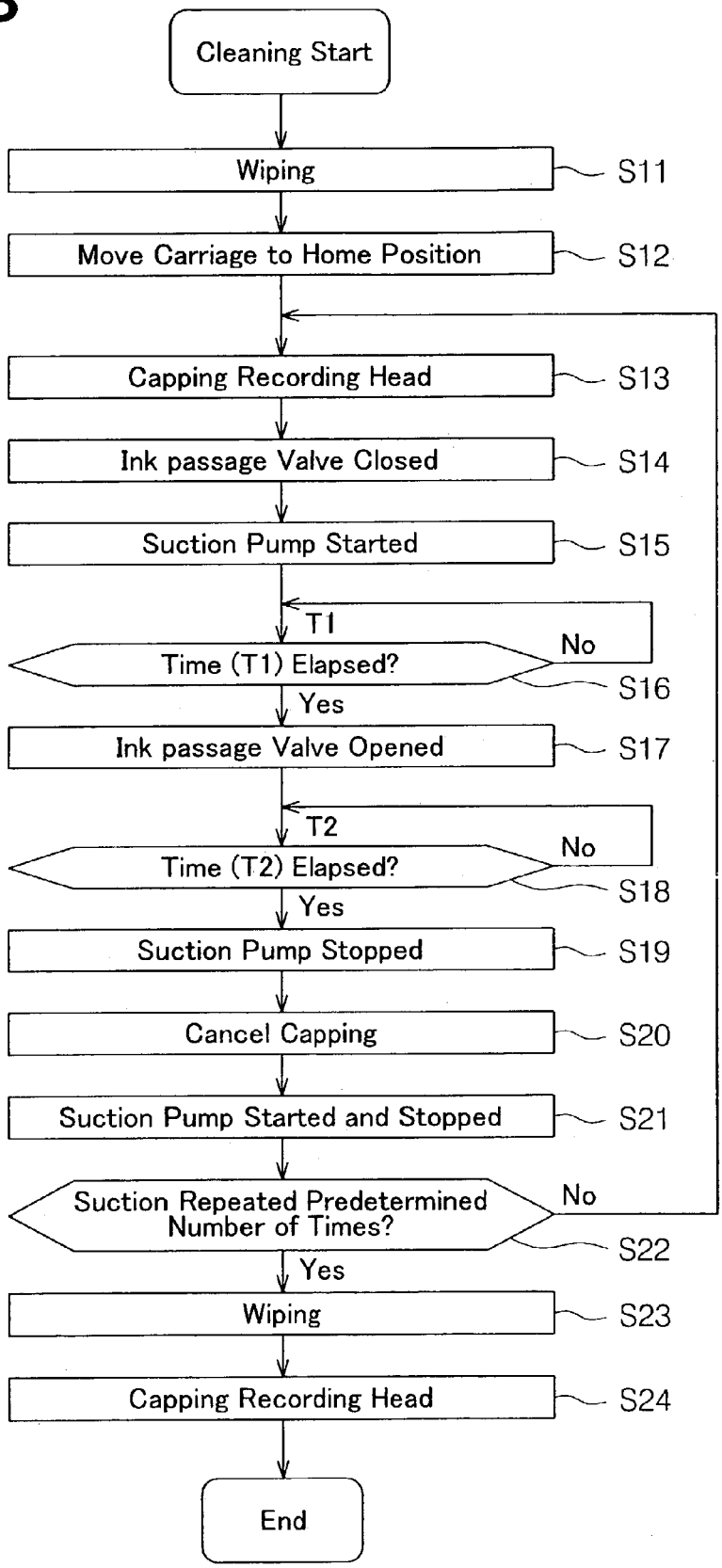
FIG. 38 is a flowchart showing a cleaning sequence executed by the control circuit shown in FIG. 37.

FIG. 38 is a flowchart showing the cleaning operation of the recording head. The sequence of the cleaning operation will now be described with reference to the flowchart of FIG. 38 and the block diagram of FIG. 37. For example, when the operational switch 251 is manipulated or when the input device 242 of the host computer 240 is manipulated and a cleaning operation command is received, the signal is received by the cleaning sequence control device 249. The cleaning sequence control device 249 outputs various control signals to start the cleaning operation.

Then, the cleaning sequence control device 249 sends a command signal to the carriage driving device 253 thereby actuating the carriage motor 202. As the carriage motor 202 is actuated, the carriage 201 passes above the wiping member 213, which is in the path of the carriage 201. Accordingly, as in step S11, the nozzle surface of the recording head 208 is wiped by the wiping member 213. Consequently, as shown in step S12, the carriage 201 continues to move to the home position. Accordingly, as shown in step S13, the nozzle surface of the recording head 208 is capped by the capping member 211.

Simultaneously, as shown in step S14, the ink passage valve 225 is closed. That is, the cleaning sequence control device 249 sends a command signal to the actuator driving device 252, thereby providing the actuator, or the electromagnetic plunger, with electricity. As a result, the control member 237 is actuated to open the ink passage valve 225.

Consequently, as shown in step S15, actuation of the suction pump 212 is started. The actuation of the suction pump 212 is started when the sequence control device 249 shown in FIG. 37 sends a control signal to the cleaning control device 247 and the cleaning control device 247 commands a command signal to the pump driving device 248. Accordingly, the suction pump 212 is actuated to create negative pressure in the interior of the capping member 211. The negative pressure is accumulated and increased.

In this state, whether a predetermined time (T1) has elapsed is determined as shown in step S16. When the time (T1) has elapsed, the ink passage valve 225 is opened as shown in step S17 in a state where the negative pressure in the capping member 211 is maximum or nearly maximum. In this case, the sequence control device 249 controls the predetermined time (T1) and sends a control signal to the actuator driving device 252 to shut off electricity to the electromagnetic plunger to close the ink passage valve 225.

When the ink passage valve 225 is opened, the lapse of a predetermined time (T2) is waited as shown in step S18. When it is determined that the predetermined time (T2) has elapsed in step S18, the suction pump 212 is stopped as shown in step S19. In this case, the sequence control device 249 controls the predetermined time (T2) and sends a control signal to the cleaning control device 247 to stop the operation of the suction pump 212.

Figure 39:
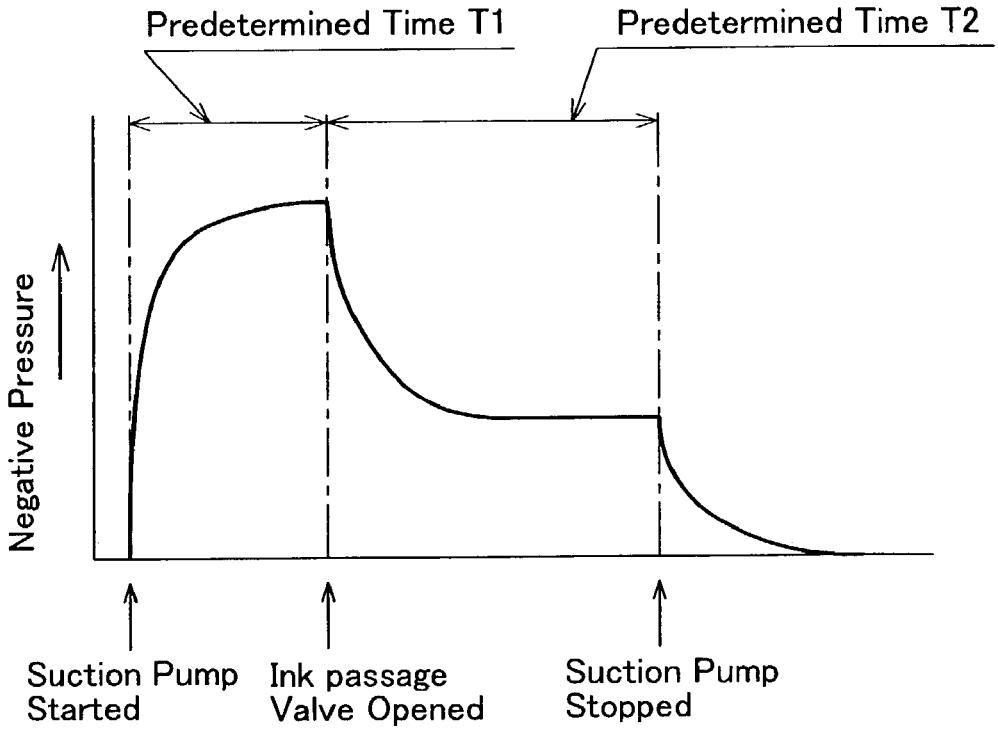
FIG. 39 is a characteristic chart showing the state of applied negative pressure in the cleaning sequence shown in FIG. 38.

FIG. 39 shows changes of the negative pressure produced in the capping member 211 in the control sequence from step S15 to step S19. That is, as shown in FIG. 39, when the suction pump 212 is started, the negative pressure in the interior of the capping member 211 is relatively quickly increased. If the negative pressure is maximum or nearly maximum when the predetermined time (T1) has elapsed, the ink passage valve 225 is opened.

Accordingly, the negative pressure is abruptly cancelled and approaches the atmospheric pressure. However, since the suction pump 212 continues operating, the negative pressure is not increased to the atmospheric pressure but stays at a certain negative pressure. When the predetermined time (T2) has elapsed since the ink passage valve 225 is opened, the suction pump 212 is stopped, and the negative pressure is increased to the atmospheric pressure.

As obvious from the negative pressure characteristics shown in FIG. 39, opening the ink passage valve 225 when the predetermined time (T1) has elapsed creates a fast ink flow in the ink channel from the ink cartridge to the nozzle openings of the recording head 208.

The fast ink flow effectively moves bubbles staying in the ink channel and, particularly, bubbles in the ink delivering needle 223, which is located upstream of the filter member 227. During the predetermined time (T2), the suction pump 212 continues operating to continuously draw ink. Therefore, the bubbles are drained by the flow of ink.

Referring back to FIG. 38, in step S20, the capping member 211 is released from the recording head 208. Consequently, as shown in step S21, actuation of the suction pump 212 is temporarily started and stopped. Ink waste discharged to the capping member 211 is therefore discarded to the liquid waste tank 215 through by the tube pump 212.

In subsequent step S22, whether ink suction has been performed for predetermined number of times is determined. If the outcome is negative, steps S13 through S21 are repeated. When the number of ink suction is determined to have reached a predetermined number, the wiping operation is executed as shown in step S23. Ink on the nozzle surface of the recording head is therefore wiped away by the wiping member 213. Then, as shown in step S24, the recording head 208 is sealed by the capping member 211 and enters a standby state to wait for print data.

In step S22, whether the suction of ink has been performed for the predetermined number of times is determined. However, if a sufficient recovery is achieved by a single suction, step S22 is not necessary.

The cleaning operation described above describes the manual cleaning performed by manipulating the operational switch 251 located on the recording apparatus or by manipulating the input device 242 of the host computer 240. However, for example, it is effective that recording apparatus is programmed to automatically perform the cleaning operation in the initial charging operation where the recording apparatus is first charged with ink. In the initial charging of ink, many bubbles are likely to remain in the ink supplying needles and in the ink channel of the recording head. It is therefore extremely important to reliably discharge bubbles in the initial charging. The discharge of bubbles during the initial charging contributes to stable printing operation.

The cleaning operation is performed on the assumption that the ink passage valve 225 corresponding to the black ink cartridge and the color ink cartridges are simultaneously closed and opened. An ink having a high concentration of color material, for example, black ink, is difficult to be recovered by the cleaning operation compared to other color inks. Therefore, if the above operation is performed, the nozzles of the color inks are first recovered and the color inks are discharged to the interior of the capping member. This hinders the negative pressure from acting on the nozzle of the black ink.

Accordingly, it is preferable that each ink passage valve 225 be independently controlled. If this control process is adopted, one of the ink passage valves 225 that corresponds to a specific color is opened and closed according to the cleaning operation shown FIG. 38. During the operation, the other ink passage valves are controlled to remain closed. Accordingly, the nozzle that injects the specific color ink is intensively maintained.

When a specific nozzle is intensively maintained, the nozzle may be selected on the utility of the printer driver 241 mounted on the host computer 240. Alternatively, the nozzle may be designated by the cleaning command detection device 250 of the recording apparatus.

Figure 40:
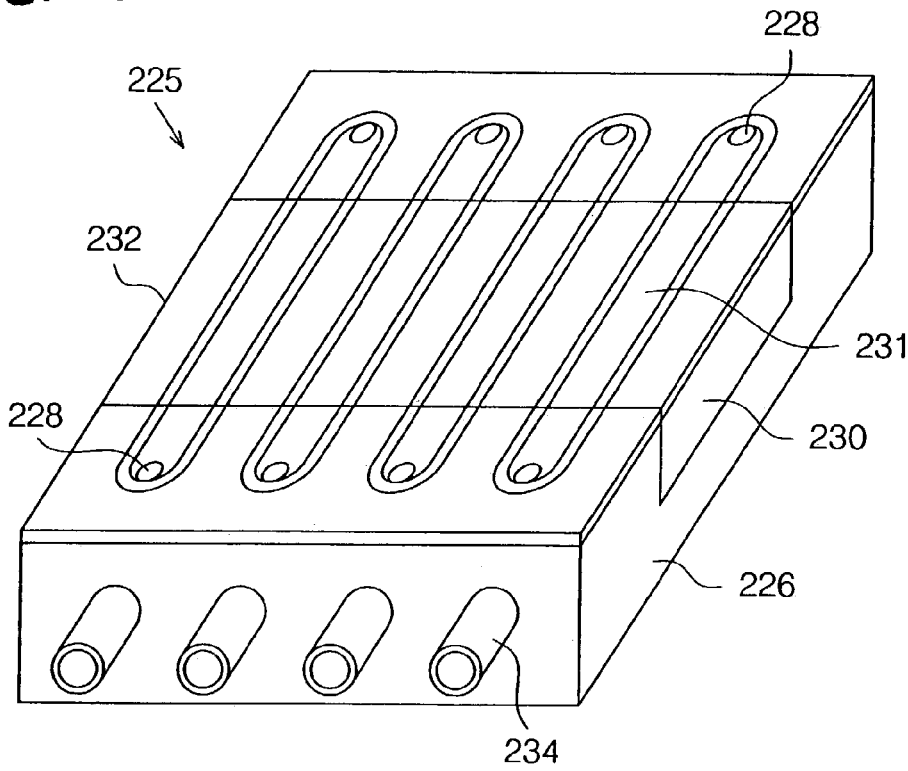
FIG. 40 is a perspective view showing an ink passage valve used in the apparatus shown in FIG. 35.
Figure 41:
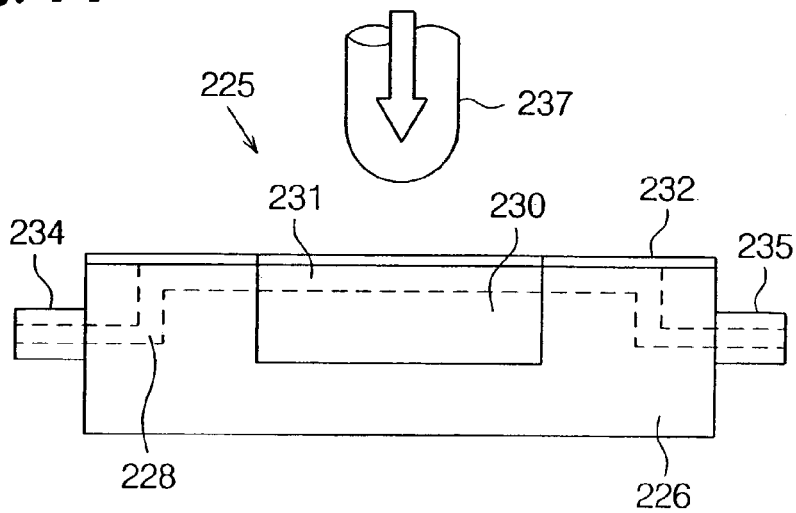
FIG. 41 is a side view showing the ink passage valve of FIG. 40.

FIGS. 40 and 41 illustrate the ink passage valve 225 that is favorably used in the above recording apparatus. For achieving greater versatility, tube connectors 234, 235 are formed at the ends of the base member 226 of the ink passage valve 225 shown in FIGS. 40 and 41.

The tube connectors 234 are connected to ink channels 228 formed in the base member 226 and are communicated with control passages 231 in an elastic member 230 through the ink channels 228. The control passages 231 of the elastic member 230 are communicated with the tube connectors 235 through the ink channels 228 in the base member 226.

As described above, the elastic member 230 is integrally formed with the base member 226 through by two-color molding. When the control member 237 contacts the film member 232, the control passages 231 surrounded by the elastic member 230 and the film member 232 are effectively closed by the base member 226, which is made of a material harder than that of the elastic member 230. Therefore, the thickness of the elastic member 230 needs to be determined in relation to the stroke of the control member 237 such that the elastic member 230 effectively closes the control passages 231.

In this case, the elastomer resin may be selected from relatively soft materials. Thus, the control passages 231 can be closed by a relatively small force. Elastomer resin has a superior elasticity and restoration property. When the force of the control member 237 is cancelled, the elastomer resin immediately restores the control passages 231, which improves the reliability of the closing and opening actions of the ink channel.

In the embodiment of FIG. 40, four ink channels are formed. However, the number of the channels may be for example six in accordance with the types of ink used in the recording apparatus. In a case where all the ink channels are simultaneously opened and closed, a wide control member 237 that extends to cover the control passages 231 formed on the elastic member 230 is used so that the opening and the closing actions can be executed by a single actuator. In a case where each ink channel is independently opened and closed, the number of the control member 237 and the actuator 238 must be increased to correspond to each of the ink channels.

Figure 42:
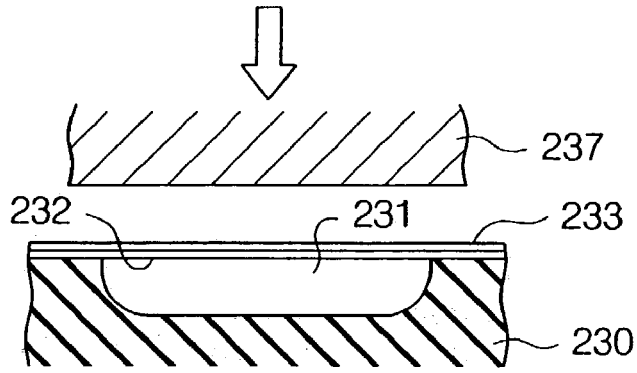
FIG. 42 is an enlarged cross-sectional view showing a first form of an ink channel that is favorably used in the ink passage valve shown in FIG. 40.
Figure 43:
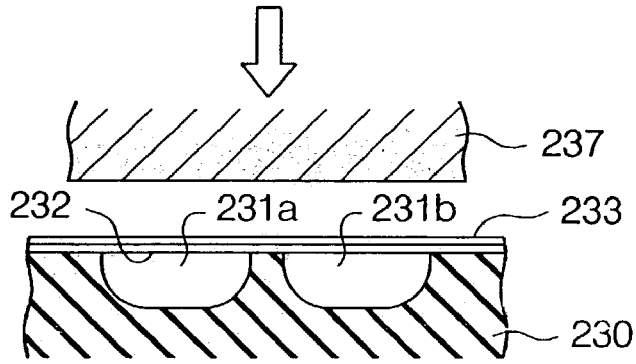
FIG. 43 is an enlarged cross-sectional view showing a second form of an ink channel.
Figure 44:
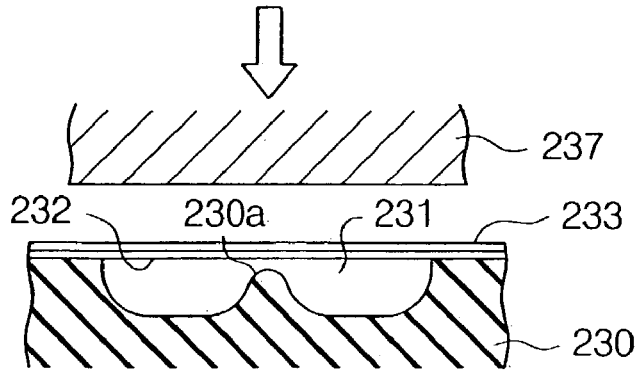
FIG. 44 is an enlarged cross-sectional view showing a third form of an ink channel.

FIGS. 42 through 44 illustrate several modifications of a control passage 231 that is favorably used in the above ink passage valve. As shown in FIGS. 42 through 44, a film 233 having a gas barrier resistance and a water permeability resistance superior to the film member 232 is preferably laminated onto the film member 232. In this embodiment, an aluminum laminate film is used as the film 233, which effectively improves the gas barrier resistance and the water permeability resistance of the ink channel.

The control passage 231 shown in FIG. 42 has a flattened semi ellipse cross-section. This structure permits the ink passage valve to be opened and closed by a relatively short stroke of the control member 237 and therefore is applicable to general purposes.

The ink channel shown in FIG. 43 is divided into two sub channels 231*a*, 231*b* along its longitudinal direction. In this modification, a part of the elastic member 230 located between the sub channels 231*a*, 231*b* is heat welded to the film member 232. The control passage 231 of FIG. 43 has the same advantages as the control passage 231 shown in FIG. 42. Also, the control passage 231 of FIG. 43 permits the control member 237 to reliably open and close the ink channel with a relatively small force.

In a control passage 231 shown in FIG. 44, a projection 230*a* of the elastic member 230 is located in the center of the ink channel. The projection 230*a* faces the film member 232. When the ink channel is opened from a closed state, the restoring force of the projection 230*a* prevents the film member 232 from closely contacting the elastic member 230. Therefore, the reliability of the opening and closing actions of the ink passage valve is further improved.

In the eleventh embodiment, the ink passage valve is used as negative pressure accumulating means during the cleaning operation. However, the ink passage valve according to the present invention may be favorably adopted as a valve function in any other ink channel in the recording apparatus of the same type.

The above embodiments may be modified as follows.

In the first embodiment, the valve unit 21 selectively establishes a supply state and a non-supply state. Specifically, the valve unit 21 supplies and stops supplying ink from the supply tube 28 to the pressure chamber 53 with the second film member 52, the valve body 61, and the ink channel 59*b*. However, the valve unit 21 may be replaced by a valve unit having a different structure as long as that valve unit detects negative pressure produced by a decrease of ink in the pressure chamber 53 and selectively supplies ink to the pressure chamber 53. For example, the valve unit 21 may be replaced by a back pressure adjuster.

In the first through tenth embodiments, the valve actuating member is the second film member 52. However, the valve actuating member may be any member as long as it detects negative pressure in the pressure chamber 53 and actuates the valve body 61. For example, the valve actuating member may be a diaphragm.

In the first through third, and fifth through ninth embodiments, the second film member 52 is attached to the pressure receiving plate 56. However, the second film member 52 does not need to be attached to the pressure receiving plate 56.

In the first through tenth embodiments, the valve body 61 is pressed against the sealing member 66 attached to the partition 58 by the sealing spring 65. The sealing spring 65 may be omitted. In this case, the plate member 63 may be shaped such that the plate member 63 is pressed against the sealing member 66 when receiving the pressure of ink supplied from the supply tube 28.

In the first through tenth embodiments, the valve body 61 includes the rod member 62 and the plate member 63. The valve body 61 may have other structure as long as the valve body 61 opens and closes the ink channel 59*b* in accordance with pressure applied by deformation of the second film member 52.

In the first through tenth embodiments, the ink channels 59*b* is formed by making intermittent notches in the support hole 59. The ink channels 59*b* may be changed as long as the channels 59*b* open and close the channel as the valve body 61 is moved.

In the first through tenth embodiments, the sealing member 66 is provided on the partition 58 of the valve unit 21. The sealing member 66 may be omitted.

In the first through tenth embodiments, the sealing spring 65 is a coil spring. However, the sealing spring 65 may be replaced by other elastic members such as a leaf spring, a conical spring, or rubber.

In the second to eighth embodiment, the projection 103 of the ninth and tenth embodiment is not provided. However, the projection 103 may be provided in the second to eighth embodiments.

In the second through fourth, ninth and tenth embodiments, the negative pressure maintaining spring 100, 100*a*, 100*b* of the fifth through seventh embodiments is not provided. However, the negative pressure maintaining spring 100, 100*a*, 100*b* may be provided in the second through fourth, ninth and tenth embodiments.

In the second through fourth, ninth, and tenth embodiments, the leaf spring 101 of the eight embodiment is not provided. However, the leaf spring 101 may be provided.

In the second through fourth embodiments, the passage valve 30 of the first embodiment is not provided. However, the passage valve 30 may be provided.

In the first and fifth through tenth embodiments, the passage valve 30 is upstream of the valve unit 21. However, the passage valve 30 may be downstream of the valve unit 21.

In the first and fifth through tenth embodiment, the passage valve 30 includes the flexible member 71 and the pressing member 72. However, the passage valve 30 may have other structure as long as the valve 30 can changes the flow rate of ink in the supply tubes 28.

In the first and fifth through tenth embodiment, when the flexible member 71 is maximally collapsed by the pressing member 72, the passage valve 30 permits a little ink to flow therethrough. However, the passage valve 30 may completely stop the flow of ink.

In the first and fifth through tenth embodiments, the passage valve 30 is located on the frame 12. However, the passage valve 30 may be located on the carriage 15.

In the second embodiment, the first pressing eccentric cam 81 functions as the drive means. However, the pressure receiving plate 56 may be pressed by other type of drive means. For example, the pressure receiving plate 56 may be pressed by a member similar to the movable member 93 (see FIG. 23) of the third embodiment.

In the third embodiment, the movable member 93 functions as the drive means. However, the first film member 45 may be pressed by other type of drive means. For example, as a second pressing eccentric cam, a cam similar to the first pressing eccentric cam 81 of the second embodiment may be provided at the same location as the movable member 93. In this case, the first film member 45 is pressed by the second pressing eccentric cam when the second cam rotates. This structure permits the valve to be effectively closed.

In the first and fifth through tenth embodiment, the ink outlet of the pressure chamber 53 is located in the lower portion in the gravitational direction. However, like the second through fourth embodiments, the ink outlet may be located at the topmost position in the gravitational direction.

In the first through third and fifth through tenth embodiments, the choke cleaning is performed by opening the valve unit 21 after the suction of the suction pump 31*b* is executed. Alternatively, the valve unit 21 may be opened while the suction of the suction pump 31*b* is being executed.

In the fourth embodiment, the choke cleaning is performed by opening the valve unit 21 while the suction of the suction pump 31*b* is being executed. Alternatively, the valve unit 21 may be opened after the suction of the suction pump 31*b* is executed.

In the first through tenth embodiment, the ink cartridges 23 are accommodated in the cartridge holder 22 provided on the frame 12, and fixed in the moving direction of the carriage 15. The ink cartridges 23 may be mounted on the carriage 15.

In the first through tenth embodiments, the locations of the ink introducing channel 47 and the ink discharging channel 54 in the unit case 35 may be changed.

In the first and fifth through tenth embodiments, ink supplied from the supply tube 28 to the valve unit 21 flows to the ink supply chamber 46 through the ink introducing channel 47. Alternatively, like the third and fourth embodiments, the filter member 89 may be provided in the valve unit 21, and ink may be supplied to the ink supply chamber 46 through the ink introducing channel 47 and the filter member 89.

In the third and fourth embodiments, the filter member 89 is proved in the unit case of the valve unit 21. However, the filter member 89 may be omitted. Alternatively, the position of the filter member 89 in the unit case 35 may be changed.

In the third embodiment, the movable member 93 is moved toward the first film member 45 by the electromagnet. The first film member 45 may be moved by a mechanism other than the electromagnet such as an actuator.

In the fourth embodiment, the second film member 52 is formed of a flexible film, and the drive means includes the suction eccentric cam 95 and the cam receiving portion 98 formed on the pressure receiving plate 56. However, the second film member 52 may be made of a magnetic material and the drive means may be an electromagnet. Alternatively, a magnetic material may be adhered to the second film member 52, and the pressure receiving plate 56 may be formed of a magnetic material. In this structure, magnetic force is generated when electricity is supplied to the electromagnet. The electromagnet then attracts the second film member, thereby closing the valve.

Alternatively, an electromagnetic plunger having a permanent magnet and an electromagnet as the drive means. In this structure, when electricity is supplied to the electromagnet, the permanent magnet attached to the distal end of the electromagnetic plunger is moved toward the second film member 52 to attract the second film member 52. Therefore, the open/close valve is opened and closed by magnetic force.

In the first to tenth embodiments, the liquid injecting apparatus is the inkjet printer 11 (including a fax machine and a copying machine). However, the present invention may be applied to other type of liquid injecting apparatus.

For example, the present invention may be applied to liquid injecting apparatus for injecting liquid such as electrode material or color material used for manufacturing electro luminescent displays and surface light emitting displays. The present invention may also be applied to liquid injecting apparatus for injecting biological organic matter used for manufacturing biochips. Alternatively, the present invention may be applied to sample injecting apparatus such as a precision pipette.

Therefore, the present examples and embodiments are to be considered as illustrative and not restrictive and the invention is not to be limited to the details given herein, but may be modified within the scope and equivalence of the appended claims.

The invention claimed is:

1. A liquid injection apparatus having a liquid reservoir for containing liquid, a recording head for injecting the liquid, and a liquid supply passage for supplying the liquid in the liquid reservoir to the recording head, the apparatus comprising:

a valve unit including a pressure chamber and a valve mechanism, wherein the pressure chamber temporarily retains the liquid at the liquid supply passage, wherein the liquid in the pressure chamber is consumed as the liquid is injected from the recording head, wherein in response to a negative pressure generated by the consumption of the liquid in the pressure chamber, a part of a wall of the pressure chamber is displaced and the valve mechanism selectively establishes a supply state where the liquid is supplied from the liquid supply passage to the pressure chamber and a non-supply state where the liquid is not supplied from the liquid supply passage to the pressure chamber; and a flow rate adjuster for forcibly changing a flow rate of the liquid that flows through the liquid supply passage.

2. The liquid injection apparatus according to claim 1, wherein the valve mechanism includes:

a valve body that selectively establishes the supply state and the non-supply state; and a valve actuator that opens the valve body in response to the negative pressure generated by the consumption of the liquid in the pressure chamber.

3. The liquid injection apparatus according to claim 2, wherein the valve actuator comprises a flexible film member that constitutes a part of the pressure chamber, wherein the film member deforms to selectively open and close the valve body when receiving the negative pressure in the pressure chamber.

4. The liquid injection apparatus according to claim 3, wherein a pressure receiving plate is mounted on the film member, wherein the pressure receiving plate moves to selectively open and close the valve body when the film member deforms.

5. The liquid injection apparatus according to claim 4 further comprising a spring member that contacts and urges the valve actuator to enlarge the volume of the pressure chamber.

6. The liquid injection apparatus according to claim 5, wherein the spring member is arranged such that the urging direction of the spring aligns with the direction of the movement of the pressure receiving plate.

7. The liquid injection apparatus according to claim 6, wherein the spring member includes a coil spring that contacts substantially a center of the pressure receiving plate.

8. The liquid injection apparatus according to claim 6, wherein the spring member includes a coil spring that contacts the periphery of the pressure receiving plate.

9. The liquid injection apparatus according to claim 6, wherein the spring member includes a plurality of coil springs each of which contacts the periphery of the pressure receiving plate.

10. The liquid injection apparatus according to claim 6, wherein the spring member includes a leaf spring having a central section that contacts the pressure receiving plate.

11. The liquid injection apparatus according to claim 2, wherein the flow rate adjuster includes a drive means that forcibly changes the flow rate of the liquid flowing the liquid supply passage by forcibly opening or closing the valve body of the valve unit.

12. The liquid injection apparatus according to claim 11, wherein the valve actuator includes a flexible film member that constitutes a part of the pressure chamber, wherein the film member deforms to selectively open and close the valve body when receiving the negative pressure in the pressure chamber, and wherein the drive means forcibly opens or closes the valve body by deforming the film member.

13. The liquid injection apparatus according to claim 12, wherein a pressure receiving plate is mounted on the film member, the valve body is opened or closed according to the movement of the pressure receiving plate based on the deformation of the film member, wherein the drive means forcibly opens or closes the valve body by selectively pushing and pulling the pressure receiving plate.

14. The liquid injection apparatus according to claim 13, wherein the drive means includes an eccentric cam, wherein the pressure receiving plate is pulled according to the rotation of the eccentric cam.

15. The liquid injection apparatus according to claim 13, wherein the drive means includes a first eccentric cam, wherein the pressure receiving plate is pushed according to the rotation of the first eccentric cam.

16. The liquid injection apparatus according to claim 11, wherein the valve unit has a liquid supply chamber for retaining the liquid, wherein the liquid is supplied to the liquid supply chamber through the liquid supply passage, wherein a positive pressure is applied to the liquid, wherein a first film member constitutes a part of the liquid supply chamber, and wherein the drive means forcibly closes the valve body by deforming the first film member.

17. The liquid injection apparatus according to claim 16, wherein the drive means forcibly closes the valve body by pushing the first film member.

18. The liquid injection apparatus according to claim 17, wherein the drive means includes a movable member that pushes the first film member in a direction where the valve body closes.

19. The liquid injection apparatus according to claim 2, wherein the valve actuator includes the displaceable part of the wall of the pressure chamber.

20. The liquid injection apparatus according to claim 3, wherein a pressure receiving plate is mounted on the film member, wherein the pressure receiving plate moves to selectively open and close the valve body when the film member deforms.

21. The liquid injection apparatus according to claim 3, wherein the valve unit has a liquid supply hole that connects the liquid supply passage to the pressure chamber, and a sealing spring that urges the valve body along a direction to close the liquid supply hole, wherein the valve body opens the liquid supply hole when the film member deforms against the force of the sealing spring.

22. The liquid injection apparatus according to claim 20, wherein the valve body includes:

a plate member that has a first surface for receiving the force of the sealing spring and a second surface for closing the liquid supply passage; and a rod member that is formed integrally with a middle section of the plate member and slides in the liquid supply hole;

wherein the rod member receives a pressure based on the deformation of the film member.

23. The liquid injection apparatus according to claim 20 further comprising a seal member located around the periphery of the liquid supply hole, wherein the plate member of the valve body closes the liquid supply hole when the plate member abuts against the seal member.

24. The liquid injection apparatus according to claim 20, wherein the sealing spring is a coil spring.

25. The liquid injection apparatus according to claim 20 further comprising a restriction member that restricts deformation of the film member.

26. The liquid injection apparatus according to claim 5, wherein the spring member is designed such that the spring member may be further compressed when the valve body opens maximally.

27. The liquid injection apparatus according to claim 1, wherein the flow rate adjuster includes a passage valve located on the liquid supply passage.

28. The liquid injection apparatus according to claim 27, wherein the passage valve is located upstream of the valve unit.

29. The liquid injection apparatus according to claim 27, wherein the passage valve includes:

a flexible member;

a passage formed on the flexible member; and a pressing member that changes the flow rate of the liquid flowing the passage, wherein the pressing member squeezes the flexible member to decrease the flow rate of the liquid and wherein the pressing member separates from the flexible member to increase the flow rate of the liquid.

30. The liquid injection apparatus according to claim 27 further comprising a carriage that is reciprocable with respect to a target, wherein the recording head is mounted on the carriage.

31. The liquid injection apparatus according to claim 1, wherein, while the flow rate of the liquid flowing the liquid supply passage is forcibly reduced by the flow rate adjuster, an intake means provided at the recording head side forcibly increases the flow rate of the liquid after the intake means intakes the liquid from the liquid supply passage.

32. The liquid injection apparatus according to claim 1, wherein, while the flow rate of the liquid flowing the liquid supply passage is forcibly reduced by the flow rate adjuster, an intake means provided at the recording head side forcibly increases the flow rate of the liquid while the intake means intakes the liquid from the liquid supply passage.

33. The liquid injection apparatus according to claim 1 further comprising a carriage reciprocable with respect to a target to which the liquid is injected, wherein the recording head is mounted on the carriage, and wherein the liquid reservoir is stationary located.

34. The liquid injection apparatus according to claim 33, wherein the liquid reservoir applies a positive pressure to the valve unit and wherein the liquid is supplied to the valve unit from the liquid reservoir according to the positive pressure.

35. The liquid injection apparatus according to claim 34, wherein the liquid reservoir includes:

a liquid package made of a flexible material that encloses the liquid; and an outer case that airtightly contains the liquid package;

wherein, when compressed air is supplied to a space between the liquid package and the outer case, the liquid reservoir applies the positive pressure to the valve unit.

36. The liquid injection apparatus according to claim 34, wherein the liquid reservoir has an outlet portion located at top of the valve unit in a direction along which force of gravity acts, wherein the positive pressure is applied from the liquid reservoir to the valve unit according to water head.

37. The liquid injection apparatus according to claim 1, wherein an outlet for the liquid is formed at the top of the pressure chamber in a direction along which force of gravity acts.

38. A liquid injection apparatus having a liquid reservoir for containing liquid, a recording head for injecting the liquid, and a liquid supply passage for supplying the liquid in the liquid reservoir to the recording head, the apparatus comprising:

a valve unit including a pressure chamber and a valve mechanism, wherein the pressure chamber temporarily retains the liquid at the liquid supply passage, wherein the liquid in the pressure chamber is consumed as the liquid is injected from the recording head, wherein in response to a negative pressure generated by the consumption of the liquid in the pressure chamber, the valve mechanism selectively establishes a supply state where the liquid is supplied from the liquid supply passage to the pressure chamber and a non-supply state where the liquid is not supplied from the liquid supply passage to the pressure chamber; and a flow rate adjuster for forcibly changing a flow rate of the liquid that flows through the liquid supply passage; wherein an outlet for the liquid is formed at the top of the pressure chamber in a direction along which force of gravity acts.

* * * * *